US007473504B2

(12) United States Patent
Yanagawa et al.

(10) Patent No.: US 7,473,504 B2
(45) Date of Patent: Jan. 6, 2009

(54) ELECTROPHOTOGRAPHIC PHOTORECEPTOR, AND IMAGE FORMING METHOD, APPARATUS AND PROCESS CARTRIDGE THEREFOR USING THE PHOTORECEPTOR

(75) Inventors: Yoshiki Yanagawa, Numazu (JP); Hiroshi Tamura, Susono (JP); Tetsuro Suzuki, Fuji (JP); Naohiro Toda, Yokohama (JP); Yoshiaki Kawasaki, Susono (JP)

(73) Assignee: Ricoh Company, Ltd., Tokyo (JP)

( * ) Notice: Subject to any disclaimer, the term of this patent is extended or adjusted under 35 U.S.C. 154(b) by 431 days.

(21) Appl. No.: 11/136,488

(22) Filed: May 25, 2005

(65) Prior Publication Data

US 2005/0266325 A1 Dec. 1, 2005

(30) Foreign Application Priority Data

May 25, 2004 (JP) ..... 2004-154415
Jul. 30, 2004 (JP) ..... 2004-223448

(51) Int. Cl.
*G03G 15/02* (2006.01)

(52) U.S. Cl. ..... 430/58.7; 430/58.05; 430/59.6; 430/66

(58) Field of Classification Search ..... 430/58.7, 430/58.05, 59.6, 66
See application file for complete search history.

(56) References Cited

U.S. PATENT DOCUMENTS 5,322,753 A 6/1994 Tamura et al.
5,488,137 A 1/1996 Tamura et al.
5,492,784 A 2/1996 Yoshikawa et al.
5,608,010 A 3/1997 Tamura et al.
5,616,534 A 4/1997 Ito et al.
5,871,876 A 2/1999 Ikuno et al.
6,030,733 A 2/2000 Kami et al.
6,066,428 A 5/2000 Katayama et al.
6,151,468 A 11/2000 Kami et al.
6,194,535 B1 2/2001 Katayama et al.
6,210,848 B1 4/2001 Nagi et al.

(Continued)

FOREIGN PATENT DOCUMENTS

EP 0 504 059 A1 9/1992

(Continued)

OTHER PUBLICATIONS

U.S. Appl. No. 11/926,748, filed Oct. 29, 2007, Yanagawa et al.

(Continued)

*Primary Examiner*—Mark A Chapman
(74) *Attorney, Agent, or Firm*—Oblon, Spivak, McClelland, Maier & Neustadt, P.C.

(57) ABSTRACT

An electrophotographic photoreceptor including an electroconductive substrate; and a photosensitive layer located overlying the electroconductive substrate, wherein an outermost layer of the electrophotographic photoreceptor is a crosslinked layer, including:

a urethane oligomer having a radical polymerizing functional group; and a radical polymerizing compound having one functional group with a charge transporting structure, or a radical polymerizing oligomer having a polyester structure;

a radical polymerizing compound having three or more functional groups without a charge transporting structure; and a radical polymerizing compound having one functional group with a charge transport structure, and wherein the outermost layer has an elasticity power not less than 41%.

15 Claims, 3 Drawing Sheets

U.S. PATENT DOCUMENTS

| | | | |
|---|---|---|---|
| 6,432,596 | B2 | 8/2002 | Ikuno et al. |
| 6,686,114 | B2 | 2/2004 | Sakon et al. |
| 6,730,172 | B2 | 5/2004 | Furuya et al. |
| 2003/0077531 | A1 | 4/2003 | Suzuki et al. |
| 2003/0224268 | A1 | 12/2003 | Ikuno et al. |
| 2004/0053152 | A1 | 3/2004 | Nagai et al. |
| 2004/0248024 | A1 | 12/2004 | Suzuki et al. |
| 2004/0253527 | A1 | 12/2004 | Suzuki et al. |

FOREIGN PATENT DOCUMENTS

| | | | |
|---|---|---|---|
| EP | 1 172 701 | A2 | 1/2002 |
| EP | 1 324 141 | A1 | 7/2003 |
| JP | 56-048637 | | 5/1981 |
| JP | 61129655 | | 6/1986 |
| JP | 64-001728 | | 1/1989 |
| JP | 04-281461 | | 10/1992 |
| JP | 05-088399 | | 4/1993 |
| JP | 05-216249 | | 8/1993 |
| JP | 05216249 | | 8/1993 |
| JP | 2000-066425 | | 3/2000 |
| JP | 2002006526 | | 1/2002 |
| JP | 2003005410 | | 1/2003 |
| JP | 2003307860 | | 10/2003 |
| JP | 2004037488 | | 2/2004 |

OTHER PUBLICATIONS

U.S. Appl. No. 11/621,805, filed Jan. 10, 2007, Suzuki et al.
U.S. Appl. No. 11/367,786, filed Mar. 6, 2006, Ohta et al.
U.S. Appl. No. 11/403,012, filed Apr. 13, 2006, Toda.
U.S. Appl. No. 11/684,520, filed Mar. 9, 2007, Toshine et al.
U.S. Appl. No. 11/736,258, filed Apr. 17, 2007, Kawasaki et al.
U.S. Appl. No. 11/272,826, filed Nov. 15, 2005, Kawasaki et al.
U.S. Appl. No. 11/855,510, filed Sep. 14, 2007, Kami et al.
U.S. Appl. No. 11/500,352, filed Aug. 8, 2006, Toshine et al.
U.S. Appl. No. 11/834,240, filed Aug. 6, 2007, Hirose et al.
U.S. Appl. No. 11/480,517, filed Jul. 5, 2006, Yanagawa et al.
U.S. Appl. No. 11/685,441, filed Mar. 13, 2007, Yanagawa et al.
U.S. Appl. No. 11/692,682, filed Mar. 28, 2007, Mori et al.
U.S. Appl. No. 11/068,180, filed Mar. 1, 2005, Tamoto et al.
U.S. Appl. No. 11/082,833, filed Mar. 18, 2005, Suzuki et al.
U.S. Appl. No. 11/033,802, filed Jan. 13, 2005, Yanagawa et al.
U.S. Appl. No. 10/937,687, filed Sep. 10, 2004, Shoshi et al.
U.S. Appl. No. 10/974,814, filed Oct. 28, 2004, Tamoto et al.
U.S. Appl. No. 10/944,003, filed Sep. 20, 2004, Yanagawa et al.
U.S. Appl. No. 11/332,545, filed Jan. 17, 2006, Tamoto et al.
U.S. Appl. No. 11/317,048, filed Dec. 27, 2005, Nagai et al.
U.S. Appl. No. 11/261,751, filed Oct. 31, 2005, Ohshima et al.
U.S. Appl. No. 11/939,239, filed Nov. 13, 2007, Hirose et al.
U.S. Appl. No. 11/941,355, filed Nov. 16, 2007, Ikuno et al.
U.S. Appl. No. 12/000,239, filed Dec. 11, 2007, Fujiwara et al.
U.S. Appl. No. 11/563,710, filed Nov. 28, 2006, Inaba et al.
U.S. Appl. No. 11/616,523, filed Dec. 27, 2006, Fujiwara et al.
U.S. Appl. No. 12/035,016, filed Feb. 21, 2008, Iwamoto et al.
U.S. Appl. No. 12/047,011, filed Mar. 12, 2008, Kami et al.
U.S. Appl. No. 12/030,886, filed Feb. 14, 2008, Toda et al.

ELECTROPHOTOGRAPHIC PHOTORECEPTOR, AND IMAGE FORMING METHOD, APPARATUS AND PROCESS CARTRIDGE THEREFOR USING THE PHOTORECEPTOR

BACKGROUND OF THE INVENTION

1. Field of the Invention

The present invention relates to an electrophotographic photoreceptor, and to an image forming method, an image forming apparatus and a process cartridge therefor using the photoreceptor.

2. Discussion of the Background

Recently, organic photoreceptors (OPCs) have been widely used instead of inorganic photoreceptors for copiers, facsimiles, laser printers and their complex machines because of their good performances and advantages. Specific examples of the reasons include (1) optical properties such as a wide range of light absorbing wavelength and a large amount of absorbing light; (2) electrical properties such as high sensitivity and stable chargeability; (3) choice of the materials; (4) good manufacturability; (5) low cost; (6) non-toxicity, etc.

On the other hand, as image forming apparatuses become smaller, photoreceptors have smaller diameters recently. In addition, photoreceptors are required to have high durability as image forming apparatuses produce images at a higher speed and are free from maintenance. In this respect, the organic photoreceptor typically has a soft surface layer mainly formed from a low-molecular-weight charge transport material and an inactive polymer, and therefore the organic photoreceptor typically has a drawback of being mechanically abraded with an image developer and a cleaner with ease when repeated used in the electrophotographic process. In addition, as toner particles has smaller particle diameters due to requirements for high-quality images, cleaning blades need to have higher rubber hardness and higher contact pressure for the purpose of increasing cleanability, and which also accelerates abrading photoreceptors. Such abrasions of photoreceptors deteriorate electrical properties thereof such as sensitivities and chargeabilities, and cause abnormal images such as image density deterioration and background fouling. When a photoreceptor is locally abraded, images having black stripes due to defective cleaning are produced. At present, photoreceptors are exchanged because of these abrasions and damages.

Therefore, it is indispensable to decrease the abrasion amount of the organic photoreceptor so as to have high durability. This is the most pressing issue to solve in this field. As methods of improving the abrasion resistance of a photoreceptor, (1) Japanese Laid-Open Patent Publication No. 56-48637 discloses a photoreceptor using a hardening binder in its surface layer; (2) Japanese Laid-Open Patent Publication No. 64-1728 discloses a photoreceptor using charge transport polymer material; and (3) Japanese Laid-Open Patent Publication No. 4-281461 discloses a photoreceptor having a surface layer wherein an inorganic filler is dispersed. The photoreceptor using a hardening binder of (1) tends to increase a residual potential and decrease image density because of a poor solubility of the binder with a charge transport material and impurities such as a polymerization initiator and an unreacted residual group. The photoreceptor using charge transport polymer material of (2) and the photoreceptor having a surface layer wherein an inorganic filler is dispersed of (3) have abrasion resistance to some extent, but which is not fully satisfactory. Further, the photoreceptor having a surface layer wherein an inorganic filler is dispersed of (3) tends to increase a residual potential and decrease image density because of a trap present on the surface of the inorganic filler. Any of the photoreceptors of (1) to (3) does not have fully satisfactory integrated durability such as electrical durability and mechanical durability.

To improve the abrasion resistance of the photoreceptor of (1), Japanese Patent No. 2578548 discloses a photoreceptor including hardened urethane acrylate. However, although disclosing that the photosensitive layer includes the hardened urethane acrylate, Japanese Patent No. 2578548 only discloses that a charge transport material may be included therein and does not disclose specific examples thereof. When a low-molecular-weight charge transport material is simply included in a photosensitive layer, the low-molecular-weight charge transport material is not soluble with the hardened urethane acrylate and the low-molecular-weight charge transport material separates out, and which causes deterioration of mechanical strength of the resultant photoreceptor such as a crack. In addition, Japanese Patent No. 2578548 discloses that a polycarbonate resin is included in the photosensitive layer to improve the solubility. However, a content of the hardened urethane acrylate decreases, resulting in insufficient abrasion resistance of the photoreceptor.

As an abrasion resistance technology of a photosensitive layer in place of these technologies, Japanese Patent No. 3194392 discloses a method of forming a charge transport layer using a coating liquid formed from a monomer having a carbon-carbon double bond, a charge transport material having a carbon-carbon double bond and a binder resin. The binder resin includes a binder resin having a carbon-carbon double bond and a reactivity with the charge transport material, and a binder resin having neither a carbon-carbon double bond nor a reactivity with the charge transport material. The photoreceptor has good abrasion resistance and electrical properties. However, when a binder resin not having a reactivity with a charge transport material, such as an acrylic polymer, a styrene polymer, an acrylic styrene copolymer, a polyester resin, a polycarbonate resin and an epoxy resin, a bonding amount between the monomer having a carbon-carbon double bond and the charge transport material having a carbon-carbon double bond decreases, resulting in insufficient crosslinked density of the photosensitive layer. Further, since the binder resin itself does not have toughness, the resultant photosensitive layer does not have satisfactory abrasion resistance. Japanese Laid-Open Patent Publication No. 2000-66425 discloses a photosensitive layer including a hardened positive hole transport compound having two or more chain polymerizing functional groups in the same molecule.

However, since the photosensitive layer includes a bulky positive hole transport material having two or more chain polymerizing functional groups, a distortion appears in the hardened compound and an internal stress increases to cause a roughness and a crack of the surface layer, resulting in insufficient durability of the resultant photoreceptor.

Accordingly, even a conventional photoreceptor having a crosslinked photosensitive layer chemically bonded with a charge transportable structure cannot be said to have sufficient overall characteristics at present.

Because of these reasons, a need exists for an electrophotographic photoreceptor having a hard and tough crosslinked surface layer having almost no variation of electrical properties.

SUMMARY OF THE INVENTION

Accordingly, one object of the present invention is to provide an electrophotographic photoreceptor having a hard and tough crosslinked surface layer having almost no variation of electrical properties.

Another object of the present invention is to provide a high-performance and high-reliability image forming method of producing higher quality images for long periods, using the photoreceptor.

A further object of the present invention is to provide a high-performance and high-reliability image forming apparatus producing higher quality images for long periods, using the photoreceptor.

Another object of the present invention is to provide a high-performance and high-reliability process cartridge for an image forming apparatus, producing higher quality images for long periods, and using the photoreceptor.

These objects and other objects of the present invention, either individually or collectively, have been satisfied by the discovery of an electrophotographic photoreceptor comprising an electroconductive substrate; and a photosensitive layer located overlying the electroconductive substrate, wherein an outermost layer of the electrophotographic photoreceptor is a crosslinked layer, comprising a urethane oligomer having a radical polymerizing functional group; and radical polymerizing compound having at least one radical polymerizing functional group and a charge transporting structure, and wherein the outermost layer has an elasticity power not less than 41%.

In addition, the objects and other objects of the present invention, either individually or collectively, have been satisfied by the discovery of an electrophotographic photoreceptor comprising an electroconductive substrate; and a photosensitive layer located overlying the electroconductive substrate, wherein an outermost layer of the electrophotographic photoreceptor is a crosslinked layer, comprising a radical polymerizing oligomer having a polyester structure; a radical polymerizing compound having three or more radical polymerizing functional groups, without a charge transporting structure; and a radical polymerizing compound having at least one radical polymerizing functional group and a charge transport structure, and wherein the outermost layer has an elasticity power not less than 41%.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1A:
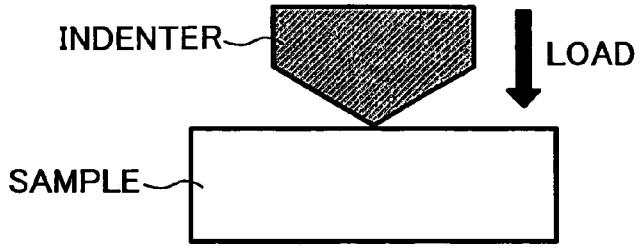
FIG. 1 is a schematic view illustrating an indenter of a microscopic hardness meter for measuring an elasticity power of the present invention.

The present invention provides an electrophotographic photoreceptor having high abrasion resistance and good electrical properties.

The photoreceptor of the present invention includes a urethane oligomer having a radical polymerizing functional group in its surface layer. The urethane oligomer is basically constituted of a soft segment and a hard segment. The surface layer has flexibility, toughness and elasticity due to a balance between the hard segment of a strong hydrogen bonding of urethane groups and the flexible soft segment. The urethane bonding develops a three-dimensional net-work, and therefore the surface layer becomes a very hard crosslinked layer having high crosslinked density and high abrasion resistance. Further, the crosslinked surface layer does not include a polymer material preventing the three-dimensional net-work from developing. In addition, since the crosslinked surface layer does not include a non-reactive polymer material, the crosslinked density of a hardened material from a reaction between the urethane oligomer having a radical polymerizing functional group and the radical polymerizing compound having at least one radical polymerizing functional group and a charge transporting structure is not impaired. The improvement of the hardening speed can form a smooth surface layer and good cleanability thereof can be maintained for long periods. Further, a uniform crosslinked film with less distortion can be formed therein. In addition, including the radical polymerizing compound having at least one radical polymerizing functional group and a charge transporting structure, the crosslinked layer has stable electrical properties for long periods. When the crosslinked surface layer includes a low-molecular-weight charge transport material not having a functional group, the low-molecular-weight charge transport material separates out and becomes clouded, and mechanical strength of the crosslinked surface layer deteriorates. When the crosslinked surface layer includes a charge transport compound having two or more functional groups, the charge transport structure is so bulky that an internal stress in the crosslinked surface layer becomes high, resulting in frequent occurrence of crack and damage thereof. Further, an intermediate structure (a cation radical) when transporting a charge cannot stably be maintained, resulting in deterioration of sensitivity due to a trapped charge and increase of residual potential. The deterioration of these electrical properties causes deterioration of the resultant image density and thinning of letter images.

Further, in the present invention, the crosslinked surface layer has an elasticity power not less than 41%. When less than 41%, a stress applied to an image developer or a cleaner is stored as a heat energy therein, resulting in plastic deformation thereof. The plastic deformation causes an abrasion of a photoreceptor.

Therefore, in the present invention, an electrophotographic photoreceptor including an electroconductive substrate; and a photosensitive layer located overlying the electroconductive substrate, wherein an outermost layer of the electrophotographic photoreceptor is a crosslinked layer, including a urethane oligomer having a radical polymerizing functional group; and a radical polymerizing compound having at least one radical polymerizing functional group and a charge transporting structure, and wherein the outermost layer has an elasticity power not less than 41% can have improved abrasion resistance and produce high-quality images for long periods.

Specific examples of the urethane oligomer having a radical polymerizing functional group include a urethane oligomer having a radical polymerizing acryloyloxy group or a radical polymerizing methacryloyloxy group. The urethane oligomer having an acryloyloxy group can be prepared by, e.g., reacting a polyol having an acryloyloxy group with a polyisocyanate. Specific examples of the polyol and polyisocyanate include typical polyols and polyisocyanates, however, they are not preferably colored as time passes because of being included in the surface layer of a photoreceptor. Specific examples of the polyisocyanates and polyols, but are not limited to, include polyisocyanates having the following formulae (A) to (C), and polyols having the following formulae (D) to (F):

(A)

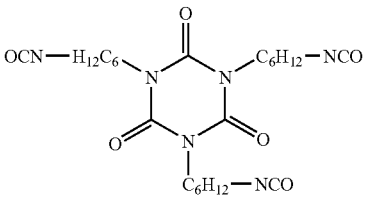

(B)

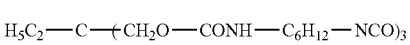

(C)

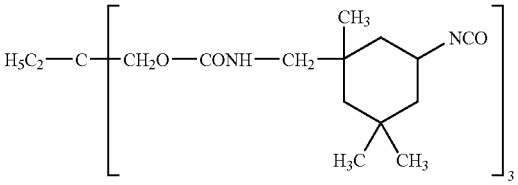

(D)

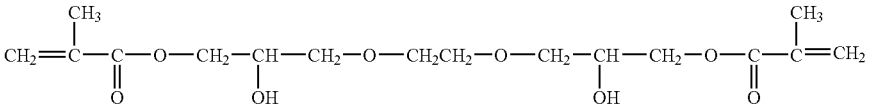

(E)

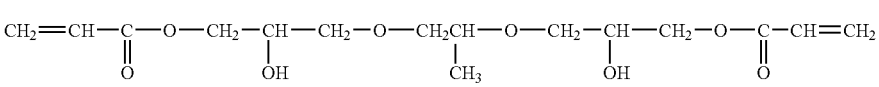

(F)

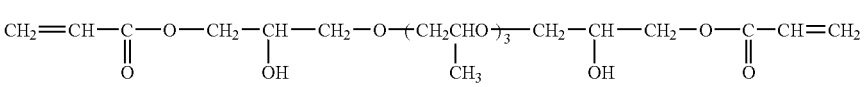

A compound having an acryloyloxy group can be prepared by, e.g., subjecting a compound having a hydroxyl group and an acrylic acid (salt), a halide acrylate or an ester acrylate to an ester reaction or an ester exchange reaction. A compound having a methacryloyloxy group can similarly be prepared as well. The radical polymerizing functional groups of a monomer having two or more radical polymerizing functional groups may be the same or different from one another. A coating liquid does not preferably has a high viscosity in terms of the surface smoothness, and the urethane oligomer preferably has a viscosity not greater than 50,000 mPa·s, and more preferably not greater than 30,000 mPa·s at 70° C.

Specific examples of the urethane oligomer having a radical polymerizing functional group, but is not limited to, include the following compounds:

U-4HA from Shin-nakamura Chemical Corporation, having 4 acrylic functional groups and a viscosity of 20,000 mPa·s/25° C.;

U-6HA from Shin-nakamura Chemical Corporation, having 6 acrylic functional groups and a viscosity of 40,000 mPa·s/50° C.;

U-15HA from Shin-nakamura Chemical Corporation, having 15 acrylic functional groups and a viscosity of 45,000 mPa·s/40° C.;

KAYARAD DPHA-40H from NIPPON KAYAKU CO., LTD., having 2 acrylic functional groups and a viscosity of 40,000±10,000 mPa·s/25° C.; and KAYARAD UX-8101 from NIPPON KAYAKU CO., LTD., having 2 acrylic functional groups and a viscosity of 20,000±10,000 mPa·s/70° C.

The crosslinked surface layer preferably includes the urethane oligomer having a radical polymerizing functional group in an amount of from 10 to 80% by weight, and more preferably from 20 to 70% by weight based on total weight of solid contents included therein in terms of a balance among abrasion resistance, surface smoothness and electrical properties.

The radical polymerizing compound having at least one radical polymerizing functional group and a charge transporting structure for use in the present invention represents a monomer which has a positive hole transport structure such as triarylamine, hydrazone, pyrazoline and carbazole or an electron transport structure such as condensed polycyclic quinone, diphenoquinone, a cyano group and an electron attractive aromatic ring having a nitro group, and has one or more radical polymerizing functional groups. Any radical polymerizing functional groups can be used, provided they have a carbon-carbon double bonding and capable of radically polymerizing. Specific examples of the radical polymerizing functional groups include the following 1-substituted ethylene functional groups and 1,1-substituted ethylene functional groups.

Alternatively, the photoreceptor of the present invention includes a radical polymerizing oligomer having a polyester structure (A) and a radical polymerizing compound having three or more radical polymerizing functional groups, without a charge transporting structure (B) in its surface layer having high abrasion resistance, wherein a three-dimensional network actively develops and a crosslinked density thereof is high. Further, the crosslinked surface layer does not include a polymer material preventing the three-dimensional net-work from developing. In addition, since the crosslinked surface layer does not include a polymer material, compatibility of a hardened material comes from a reaction among the radical polymerizing oligomer having a polyester structure (A), radical polymerizing compound having three or more radical polymerizing functional groups, without a charge transporting structure (B) and a radical polymerizing compound having at least one radical polymerizing functional group and a charge transport structure (C) is no problem. Further, since the radical polymerizing oligomer having a polyester structure (A) comparatively has a large molecule, the crosslinked surface layer can uniformly be formed and occurrence of crack thereof can largely be prevented. Not having a polar group such as a hydroxyl group and a urethane bonding in its molecular skeleton, the radical polymerizing oligomer having a polyester structure (A) has a lower viscosity than a radical polymerizing oligomer having a urethane structure and a radical polymerizing oligomer having an epoxy structure with the same molecular weight. Therefore, the resultant crosslinked surface layer has good surface smoothness and good cleanability thereof can be maintained for long periods. The crosslinked surface layer of the present invention including the radical polymerizing oligomer having a polyester structure (A), the radical polymerizing compound having three or more radical polymerizing functional groups, without a charge transporting structure (B) and the radical polymerizing compound having at least one radical polymerizing functional group and a charge transport structure (C), wherein these are hardened at the same time in a short time to form a crosslinked bonding having high hardness, has improved durability. In addition, including the radical polymerizing compound having at least one radical polymerizing functional group and a charge transporting structure (C), the crosslinked layer has stable electrical properties for long periods. When the crosslinked surface layer includes a low-molecular-weight charge transport material not having a functional group, the low-molecular-weight charge transport material separates out and becomes clouded, and mechanical strength of the crosslinked surface layer deteriorates. When the crosslinked surface layer includes a charge transport compound having two or more functional groups, the charge transport structure is so bulky that an internal stress in the crosslinked surface layer becomes high, resulting in frequent occurrence of crack and damage thereof. Further, an intermediate structure (a cation radical) when transporting a charge cannot stably be maintained, resulting in deterioration of sensitivity due to a trapped charge and increase of residual potential. The deterioration of these electrical properties causes deterioration of the resultant image density and thinning of letter images.

Further, in the present invention, the crosslinked surface layer has an elasticity power not less than 41%. When less than 41%, a stress applied to an image developer or a cleaner is stored as a heat energy therein, resulting in plastic deformation thereof. The plastic deformation causes an abrasion of a photoreceptor.

Therefore, in the present invention, an electrophotographic photoreceptor including an electroconductive substrate; and a photosensitive layer located overlying the electroconductive substrate, wherein an outermost layer of the electrophotographic photoreceptor is a crosslinked layer, including a radical polymerizing oligomer having a polyester structure (A); radical polymerizing compound having three or more radical polymerizing functional groups, without a charge transporting structure (B); and a radical polymerizing compound having at least one radical polymerizing functional group and a charge transport structure (C), and wherein the outermost layer has an elasticity power not less than 41% can have improved abrasion resistance and produce high-quality images for long periods.

Specific examples of the radical polymerizing oligomer having a polyester structure (A) include a radical polymerizing oligomer having two or more radical polymerizing functional groups such as acryloyloxy groups and methacryloyloxy groups.

The radical polymerizing oligomer having a polyester structure (A) for use in the present invention can be prepared by, e.g., condensing a hydroxyl group having a polyester skeleton, synthesized from a polyol and a polybasic acid. Specific examples of the polyol include ethylene glycol, diethyleneglycol, propylene glycol, dipropylene glycol, 1,3-butylene glycol, neopentyl glycol, bisphenol oxy ethyl ether, glycerin, trimethylolpropane, etc. Specific examples of the polybasic acid include a maleic acid, a fumaric acid, an adipic acid, a phthalic acid, an isophthalic acid, a nadic acid, a tetra chloro phthalic acid, a het acid, etc.

The radical polymerizing functional groups of a monomer having two or more radical polymerizing functional groups may be the same or different from one another, and preferably has a viscosity not greater than 50,000 mPa·s, and more preferably not greater than 30,000 mPa·s at 70° C. in terms of the surface smoothness.

Specific examples of the radical polymerizing oligomer having a polyester structure (A) include, but is not limited to, the following compounds:

M-6100 from TOAGOSEI CO., LTD., having 2 acrylic functional groups and a viscosity of from 200 to 450 mPa·s/25° C.;

M-6200 from TOAGOSEI CO., LTD., having 2 acrylic functional groups and a viscosity of from 700 to 3,700 mPa·s/25° C.;

M-6250 from TOAGOSEI CO., LTD., having 2 acrylic functional groups and a viscosity of from 300 to 700 mPa·s/25° C.;

M-6500 from TOAGOSEI CO., LTD., having 2 acrylic functional groups and a viscosity of from 300 to 500 mPa·s/25° C.;

M-7100 from TOAGOSEI CO., LTD., having 3 or more acrylic functional groups and a viscosity of from 6,500 to 12,000 mPa·s/25° C.;

M-8030 from TOAGOSEI CO., LTD., having 3 or more acrylic functional groups and a viscosity of from 500 to 700 mPa·s/25° C.;

M-8060 from TOAGOSEI CO., LTD., having 3 or more acrylic functional groups and a viscosity of from 5,000 to 12,000 mPa·s/25° C.;

M-8100 from TOAGOSEI CO., LTD., having 3 or more acrylic functional groups and a viscosity of from 8,000 to 12,000 mPa·s/25° C.; and M-9050 from TOAGOSEI CO., LTD., having 3 or more acrylic functional groups and a viscosity of from 6,000 to 12,000 mPa·s/25° C.

The crosslinked surface layer preferably includes the radical polymerizing oligomer having a polyester structure (A) in an amount of from 10 to 80% by weight, and more preferably from 20 to 70% by weight based on total weight of solid contents included therein in terms of a balance among abrasion resistance, surface smoothness and electrical properties.

The radical polymerizing compound having three or more radical polymerizing functional groups, without a charge transporting structure (B) for use in the present invention represents a monomer which neither has a positive hole transport structure such as triarylamine, hydrazone, pyrazoline and carbazole nor has an electron transport structure such as condensed polycyclic quinone, diphenoquinone, a cyano group and an electron attractive aromatic ring having a nitro group, and has three or more radical polymerizing functional groups. Any radical polymerizing functional groups can be used, provided they have a carbon-carbon double bonding and capable of radically polymerizing. Specific examples of the radical polymerizing functional groups include the following 1-substituted ethylene functional groups and 1,1-substituted ethylene functional groups.

Specific examples of the 1-substituted ethylene functional groups include functional groups having the following formula (10):

$$CH_2{=}CH{-}X_1{-} \quad (10)$$

wherein $X_1$ represents a substituted or an unsubstituted phenylene group, an arylene group such as a naphthylene group, a substituted or an unsubstituted alkenylene group, a —CO-group, a —COO-group and a —CON($R_{10}$)-group wherein $R_{10}$ represents a hydrogen atom, a methyl group, an alkyl group such as an ethyl group, a benzyl group, a naphthylmethyl group, an aralkyl group such as a phenethyl group, a phenyl group and an aryl group such as a naphtyl group, or a —S-group.

Specific examples of the substituents include vinyl groups, styryl groups, 2-methyl-1,3-butadienyl groups, vinylcarbonyl groups, acryloyloxy groups, acryloylamide groups, vinylthioether groups, etc.

Specific examples of the 1,1-substituted ethylene functional groups include functional groups having the following formula (11):

$$CH_2{=}CH(Y){-}X_2{-} \quad (11)$$

wherein $Y_1$ represents a substituted or an unsubstituted alkyl group, a substituted or an unsubstituted aralkyl group, a substituted or an unsubstituted phenyl group, an aryl group such as a naphtyl group, a halogen atom, a cyano group, a nitro group, an alkoxy group such as a methoxy group or a ethoxy group and a —$COOR_{11}$ group wherein $R_{11}$ represents a hydrogen atom, a substituted or an unsubstituted methyl group, an alkyl group such as an ethyl group, a substituted or an unsubstituted benzyl group, an aralkyl group such as a phenethyl group, a substituted or an unsubstituted phenyl group and an aryl group such as a naphtyl group, or a —$CONR_{12}R_{13}$ wherein $R_{12}$ and $R_{13}$ independently represent a hydrogen atom, a substituted or an unsubstituted methyl group, an alkyl group such as an ethyl group, a substituted or an unsubstituted benzyl group, a naphthylmethyl group, an aralkyl group such as a phenethyl group, a substituted or an unsubstituted phenyl group and an aryl group such as a naphtyl group; $X_2$ represents a substituted or an unsubstituted phenylene group, an arylene group such as a naphthylene group, a substituted or an unsubstituted alkenylene group, a —CO-group, a —COO-group, a —CON($R_{10}$)-group wherein $R_{10}$ represents a hydrogen atom, a methyl group, an alkyl group such as an ethyl group, a benzyl group, a naphthylmethyl group, an aralkyl group such as a phenethyl group, a phenyl group and an aryl group such as a naphtyl group, or a —S-group; and at least either Y or $X_2$ is an oxycarbonyl group.

Specific examples of the substituents include α-acryloyloxy chloride groups, methacryloyloxy groups, α-cyanoethylene groups, α-cyanoacryloyloxy groups, α-cyanophenylene groups, methacryloylamino groups, etc. Specific examples of further substituents for the substituents of $X_1$, $X_2$ and Y include halogen atoms, nitro groups, cyano groups, methyl groups, alkyl groups such as ethyl groups, methoxy groups, alkoxy groups such as ethoxy groups, aryloxy groups such as phenoxy groups, phenyl groups, aryl groups such as naphthyl groups, benzyl groups, aralkyl groups such as phenethyl groups.

Among these radical polymerizing function groups, the acryloyloxy groups and methacryloyloxy groups are effectively used. In addition, a triarylamine structure is effectively used as the charge transport structure. Further, when a compound having the following formula (1) or (2), electrical properties such as a sensitivity and a residual potential are preferably maintained.

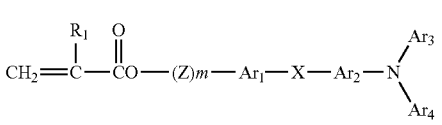
(1)

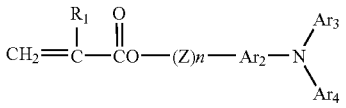
(2)

wherein $R_1$ represents a hydrogen atom, a halogen atom, a substituted or an unsubstituted alkyl group, a substituted or an unsubstituted aralkyl group, a substituted or an unsubstituted aryl group, a cyano group, a nitro group, an alkoxy group, —$COOR_7$ wherein $R_7$ represents a hydrogen atom, a halogen atom, a substituted or an unsubstituted alkyl group, a substituted or an unsubstituted aralkyl group and a substituted or an unsubstituted aryl group and a halogenated carbonyl group or $CONR_8R_9$ wherein $R_8$ and $R_9$ independently represent a hydrogen atom, a halogen atom, a substituted or an unsubstituted alkyl group, a substituted or an unsubstituted aralkyl group and a substituted or an unsubstituted aryl group; $Ar_1$ and $Ar_2$ independently represent a substituted or an unsubstituted arylene group; $Ar_3$ and $Ar_4$ independently represent a substituted or an unsubstituted aryl group; X represents a single bond, a substituted or an unsubstituted alkylene group, a substituted or an unsubstituted cycloalkylene group, a substituted or an unsubstituted alkyleneether group, an oxygen atom, a sulfur atom and vinylene group; Z represents a substituted or an unsubstituted alkylene group, a substituted or an unsubstituted alkyleneether group and alkyleneoxycarbonyl group; and m and n represent 0 and an integer of from 1 to 3.

In the formulae (1) and (2), among substituted groups of $R_1$, the alkyl groups include methyl groups, ethyl groups, propyl groups, butyl groups, etc.; the aryl groups include phenyl groups, naphtyl groups, etc.; aralkyl groups include benzyl groups, phenethyl groups, naphthylmethyl groups, etc.; and alkoxy groups include methoxy groups, ethoxy groups, propoxy groups, etc. These may be substituted by alkyl groups such as halogen atoms, nitro groups, cyano groups, methyl groups and ethyl groups; alkoxy groups such as methoxy groups and ethoxy groups; aryloxy groups such as phenoxy groups; aryl groups such as phenyl groups and naphthyl groups; aralkyl groups such as benzyl groups and phenethyl groups.

The substituted group of $R_1$, is preferably a hydrogen atom and a methyl group.

$Ar_3$ and $Ar_4$ independently represent a substituted or an unsubstituted aryl group, and specific examples thereof include condensed polycyclic hydrocarbon groups, non-condensed cyclic hydrocarbon groups and heterocyclic groups.

The condensed polycyclic hydrocarbon group is preferably a group having 18 or less carbon atoms forming a ring such as a fentanyl group, a indenyl group, a naphthyl group, an azulenyl group, a heptalenyl group, a biphenylenyl group, an As-indacenyl group, a fluorenyl group, an acenaphthylenyl group, a praadenyl group, an acenaphthenyl group, a phenalenyl group, a phenantolyl group, an anthryl group, a fluoranthenyl group, an acephenantolylenyl group, an aceanthrylenyl group, a triphenylel group, a pyrenyl group, a crycenyl group and a naphthacenyl group.

Specific examples of the non-condensed cyclic hydrocarbon groups and heterocyclic groups include monovalent groups of monocyclic hydrocarbon compounds such as benzene, diphenylether, polyethylenediphenylether, diphenylthioether, and diphenylsulfone; monovalent groups of non-condnesed hydrocarbon compounds such as biphenyl, polyphenyl, diphenylalkane, diphenylalkene, diphenylalkine, triphenylmethane, distyrylbenzene, 1,1-diphenylcycloalkane, polyphenylalkane and polyphenylalkene; and monovalent groups of ring gathering hydrocarbon compounds such as 9,9-diphenylfluorene.

Specific examples of the heterocyclic groups include monovalent groups such as carbazole, dibenzofuran, dibenzothiophene and oxadiazole.

Specific examples of the substituted or unsubstituted aryl group represented by $Ar_3$ and $Ar_4$ include the following groups:

(1) a halogen atom, a cyano group and a nitro group;

(2) a straight or a branched-chain alkyl group having 1 to 12, preferably from 1 to 8, and more preferably from 1 to 4 carbon atoms, and these alkyl groups may further include a fluorine atom, a hydroxyl group, a cyano group, an alkoxy group having 1 to 4 carbon atoms, a phenyl group or a halogen atom, an alkyl group having 1 to 4 carbon atoms or a phenyl group substituted by an alkoxy group having 1 to 4 carbon atoms. Specific examples of the alkyl groups include methyl groups, ethyl groups, n-butyl groups, i-propyl groups, t-butyl groups, s-butyl groups, n-propyl groups, trifluoromethyl groups, 2-hydroxyethyl groups, 2-ethoxyethyl groups, 2-cyanoethyl groups, 2-methocyethyl groups, benzyl groups, 4-chlorobenzyl groups, 4-methylbenzyl groups, 4-phenylbenzyl groups, etc.

(3) alkoxy groups (—$OR_2$) wherein $R_2$ represents an alkyl group specified in (2). Specific examples thereof include methoxy groups, ethoxy groups, n-propoxy groups, I-propoxy groups, t-butoxy groups, s-butoxy groups, I-butoxy groups, 2-hydroxyethoxy groups, benzyloxy groups, trifluoromethoxy groups, etc.

(4) aryloxy groups, and specific examples of the aryl groups include phenyl groups and naphthyl groups. These aryl group may include an alkoxy group having 1 to 4 carbon atoms, an alkyl group having 1 to 4 carbon atoms or a halogen atom as a substituent. Specific examples of the aryloxy groups include phenoxy groups, 1-naphthyloxy groups, 2-naphthyloxy groups, 4-methoxyphenoxy groups, 4-methylphenoxy groups, etc.

(5) alkyl mercapto groups or aryl mercapto groups such as methylthio groups, ethylthio groups, phenylthio groups and p-methylphenylthio groups.

(6)

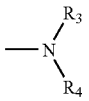

wherein $R_3$ and $R_4$ independently represent a hydrogen atom, an alkyl groups specified in (2) and an aryl group, and specific examples of the aryl groups include phenyl groups, biphenyl groups and naphthyl groups, and these may include an alkoxy group having 1 to 4 carbon atoms, an alkyl group having 1 to 4 carbon atoms or a halogen atom as a substituent, and $R_3$ and $R_4$ may form a ring together. Specific examples of the groups having this formula include amino groups, diethylamino groups, N-methyl-N-phenylamino groups, N,N-diphenylamino groups, N—N-di(tolyl)amino groups, dibenzylamino groups, piperidino groups, morpholino groups, pyrrolidino groups, etc.

(7) a methylenedioxy group, an alkylenedioxy group such as a methylenedithio group or an alkylenedithio group.

(8) a substituted or an unsubstituted styryl group, a substituted or an unsubstituted β-phenylstyryl group, a diphenylaminophenyl group, a ditolylaminophenyl group, etc.

The arylene group represented by $Ar_1$ and $Ar_2$ are derivative divalent groups from the aryl groups represented by $Ar_3$ and $Ar_4$.

The above-mentioned X represents a single bond, a substituted or an unsubstituted alkylene group, a substituted or an unsubstituted cycloalkylene group, a substituted or an unsubstituted alkyleneether group, an oxygen atom, a sulfur atom and vinylene group.

The substituted or unsubstituted alkylene group is a straight or a branched-chain alkylene group having 1 to 12, preferably from 1 to 8, and more preferably from 1 to 4 carbon atoms, and these alkylene groups may further includes a fluorine atom, a hydroxyl group, a cyano group, an alkoxy group having 1 to 4 carbon atoms, a phenyl group or a halogen atom, an alkyl group having 1 to 4 carbon atoms or a phenyl group substituted by an alkoxy group having 1 to 4 carbon atoms. Specific examples of the alkylene groups include methylene groups, ethylene groups, n-butylene groups, i-propylene groups, t-butylene groups, s-butylene groups, n-propylene groups, trifluoromethylene groups, 2-hydroxyethylene groups, 2-ethoxyethylene groups, 2-cyanoethylene groups, 2-methocyethylene groups, benzylidene groups, phenylethylene groups, 4-chlorophenylethylene groups, 4-methylphenylethylene groups, 4-biphenylethylene groups, etc.

The substituted or unsubstituted cycloalkylene group is a cyclic alkylene group having 5 to 7 carbon atoms, and these alkylene groups may include a fluorine atom, a hydroxyl group, a cyano group, an alkoxy group having 1 to 4 carbon atoms. Specific examples thereof include cyclohexylidine groups, cyclohexylene groups and 3,3-dimethylcyclohexylidine groups, etc.

Specific examples of the substituted or unsubstituted alkyleneether groups include ethylene oxy, propylene oxy, ethylene glycol, propylene glycol, diethylene glycol, tetraethylene glycol and tripropylene glycol. The alkylene group of the alkyleneether group may include a substituent such as a hydroxyl group, a methyl group and an ethyl group. The vinylene group has the following formula:

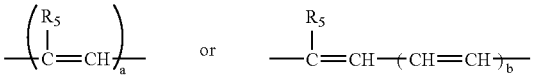

wherein R5 represents a hydrogen atom, an alkyl group (same as those specified in (2)), an aryl group (same as those represented by $Ar_3$ and $Ar_4$); a represents 1 or 2; and b represents 1, 2 or 3. Z represents a substituted or an unsubstituted alkylene group, a substituted or an unsubstituted divalent alkyleneether group and a divalent alkyleneoxycarbonyl group. Specific examples of the substituted or unsubstituted alkylene group include those of X. Specific examples of the substituted or unsubstituted divalent alkyleneether group include those of X. Specific examples of the divalent alkyleneoxycarbonyl group include caprolactone-modified groups.

In addition, the radical polymerizing compound having at least one radical polymerizing functional group and a charge transporting structure, of the present invention is more preferably a compound having the following formula (3):

-continued

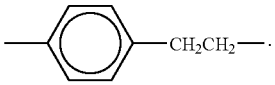

The compound having the formula (3) is preferably a compound having an methyl group or a ethyl group as a substituent of Rb and Rc.

The radical polymerizing compound having at least one radical polymerizing functional group and a charge transporting structure of the formulae (1), (2) and particularly (3) for use in the present invention does not become an end structure because a double bonding between the carbons is polymerized while opened to the both sides, and is built in a chain polymer. In a crosslinked polymer polymerized with a radical polymerizing monomer having three or more radical polymerizing functional groups, the compound is present in a main chain and in a crosslinked chain between the main chains (the crosslinked chain includes an intermolecular crosslinked chain between a polymer and another polymer and an intramolecular crosslinked chain wherein a portion having a folded main chain and another portion originally from the monomer, which is polymerized with a position apart therefrom in the main chain are polymerized). Even when the compound is present in a main chain or a (3)

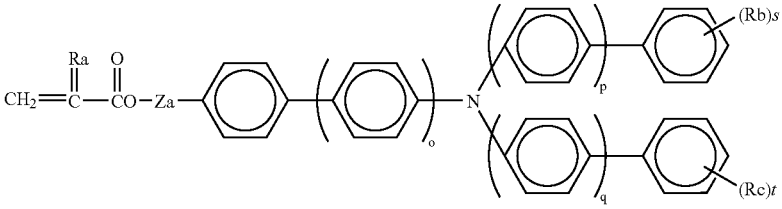

wherein o, p and q independently represent 0 or 1; Ra represents a hydrogen atom or a methyl group; Rb and Rc represents hydrogen, halogen, an alkyl group having 1 to 6 carbon atoms, an alkoxy group having 1 to 6 carbons, an aryl group having 6-14 carbon atoms, an aryloxy group having 6-14 carbon atoms, or can form a benzofused polyaryl group having up to 5 aryl rings, including the phenyl ring to which it is attached, and may be different from each other when having plural carbon atoms; s and t represent 0 or an integer of from 1 to 3; Za represents a single bond, a methylene group, ethylene group,

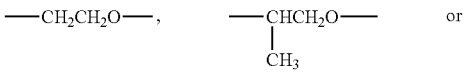

crosslinked chain, a triarylamine structure suspending from the chain has at least three aryl groups radially located from a nitrogen atom, is not directly bonded with the chain and suspends through a carbonyl group or the like, and is sterically and flexibly fixed although bulky. The triarylamine structures can spatially be located so as to be moderately adjacent to one another in a polymer, and has less structural distortion in a molecule. Therefore, it is supposed that the radical polymerizing compound having at least one radical polymerizing functional group and a charge transporting structure in a surface layer of an electrophotographic photoreceptor can have an intramolecular structure wherein blocking of a charge transport route is comparatively prevented.

Specific examples of the radical polymerizing compound having at least one radical polymerizing functional group and a charge transporting structure include compounds having the following formulae, but the compounds are not limited thereto.

No. 1
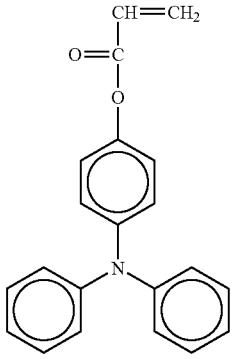
No. 2
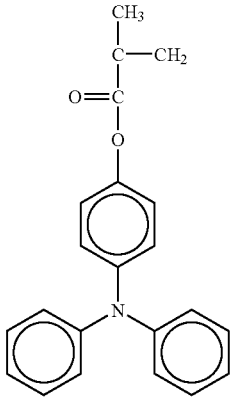
No. 3
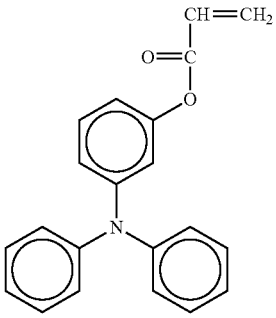
No. 4
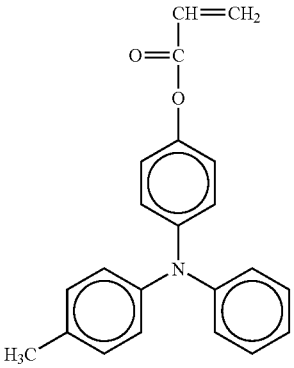
-continued
No. 5
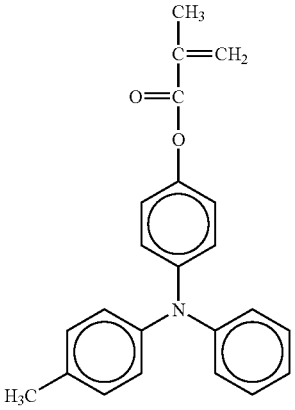
No. 6
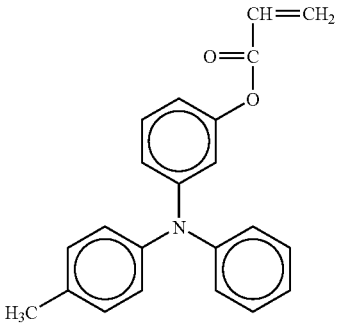
No. 7
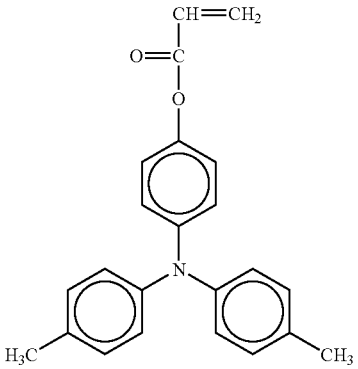
No. 8
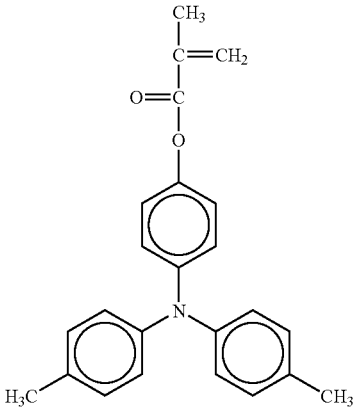

-continued
No. 9
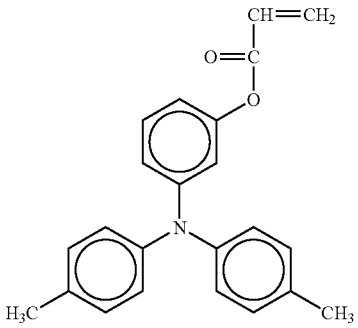
No. 10
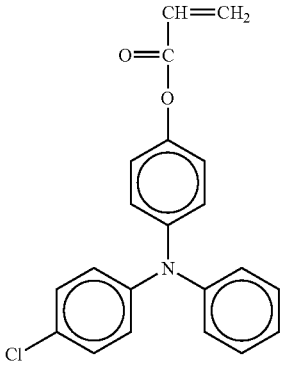
No. 11
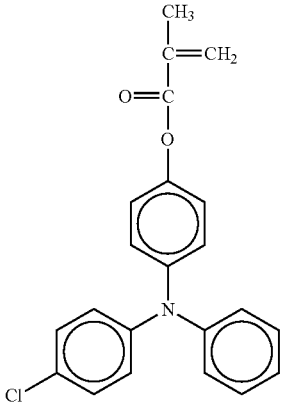
No. 12
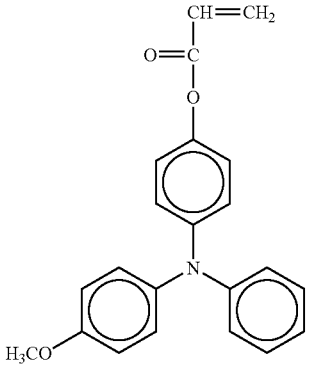
-continued
No. 13
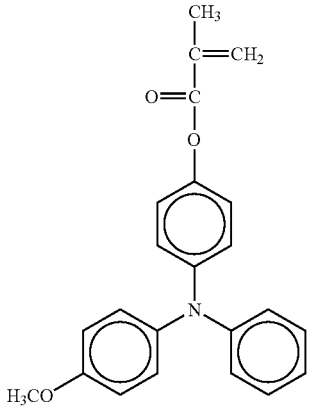
No. 14
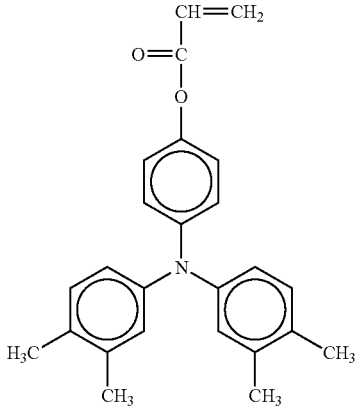
No. 15
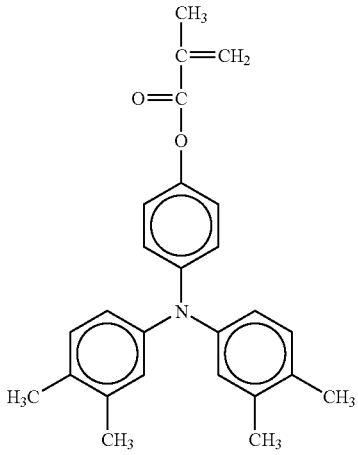

-continued
No. 16
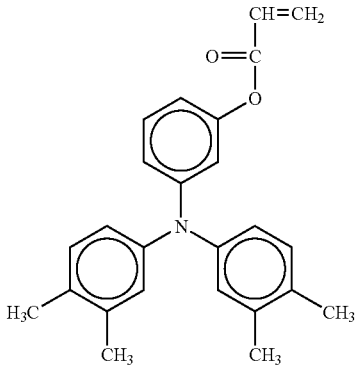
No. 17
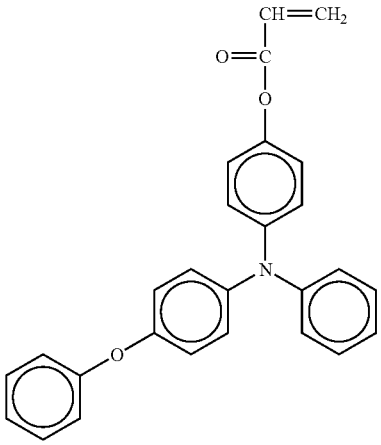
No. 18
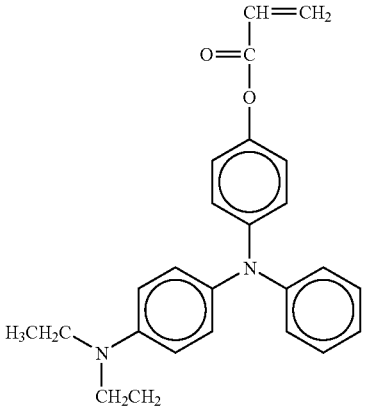
-continued
No. 19
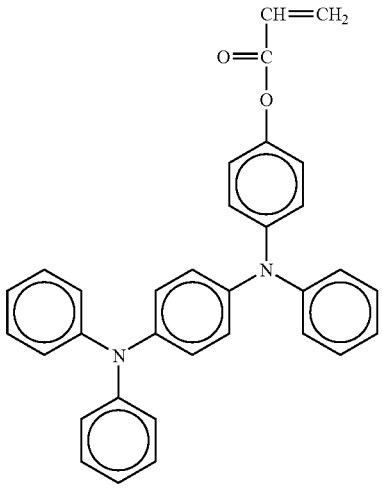
No. 20
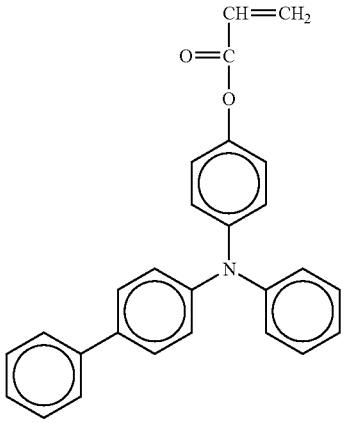
No. 21
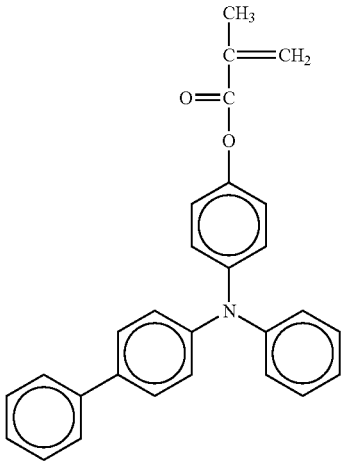

-continued
No. 22
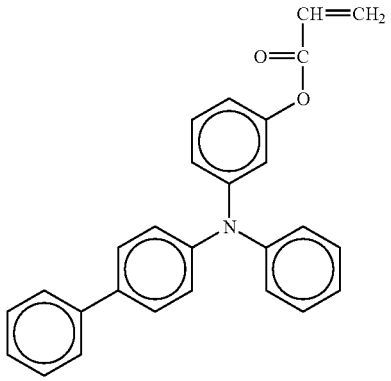
No. 23
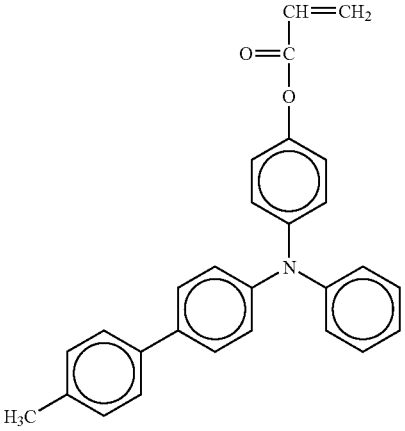
No. 24
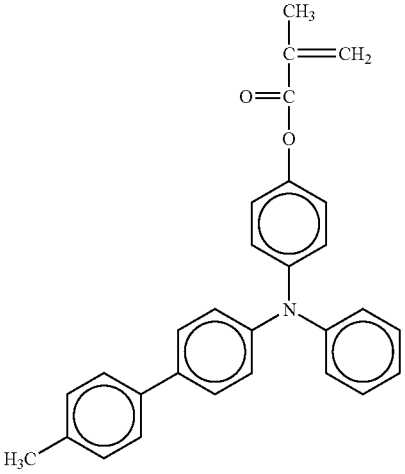
-continued
No. 25
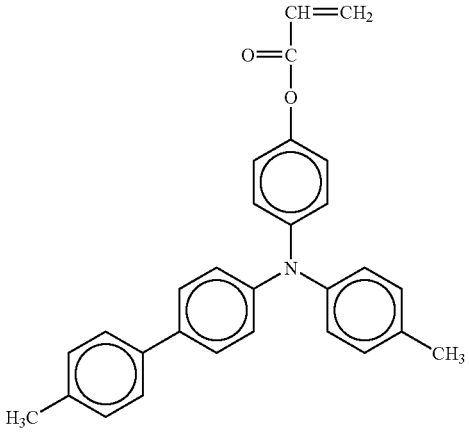
No. 26
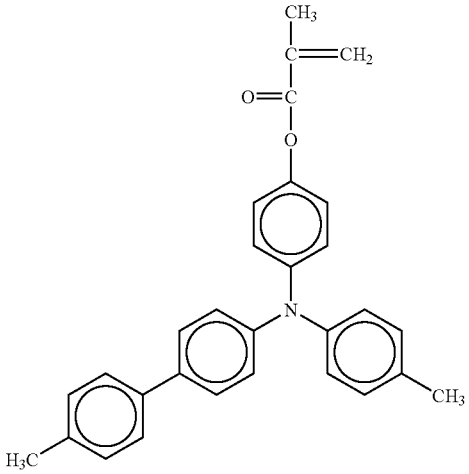
No. 27
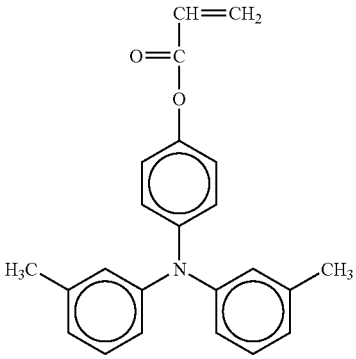

-continued
No. 28
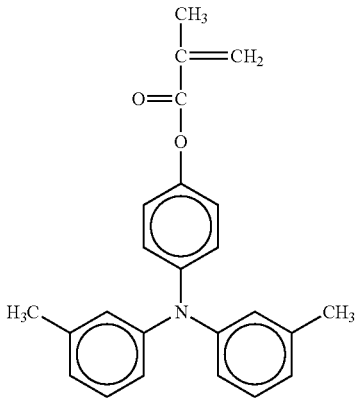
No. 29
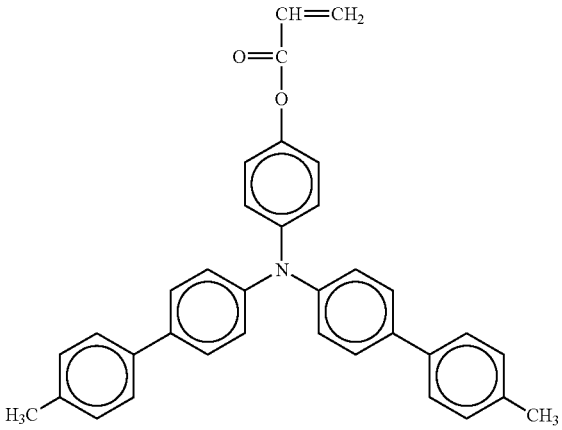
No. 30
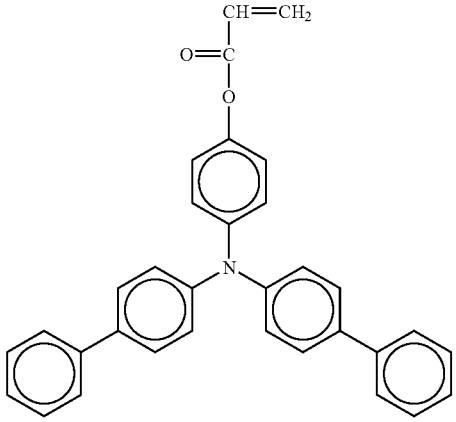
No. 31
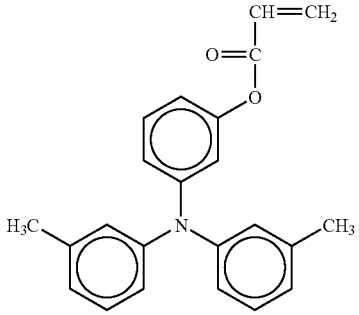
-continued
No. 32
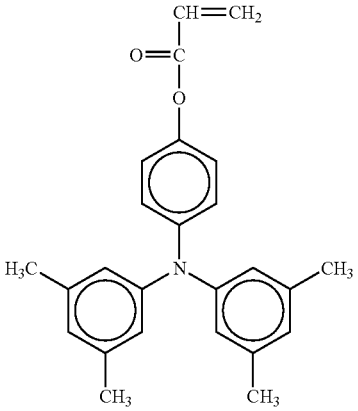
No. 33
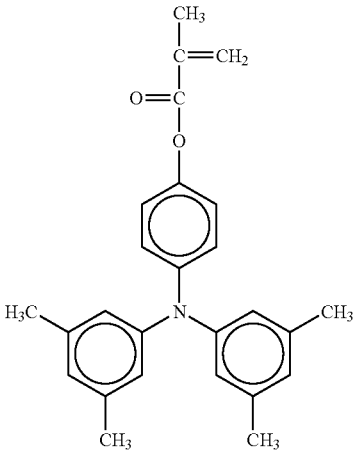
No. 34
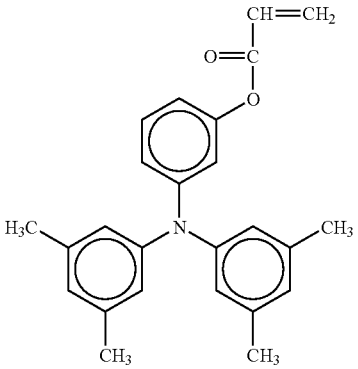
No. 35
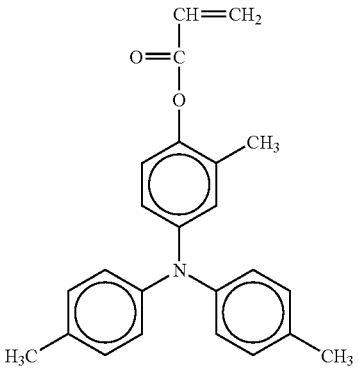

-continued
No. 36
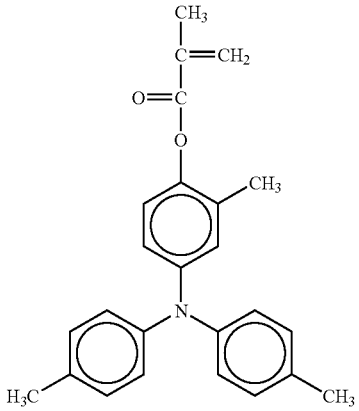
No. 37
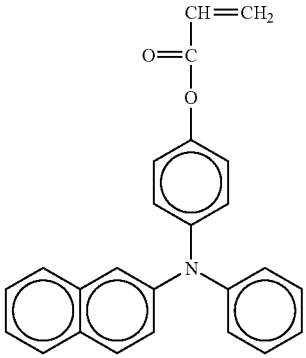
No. 38
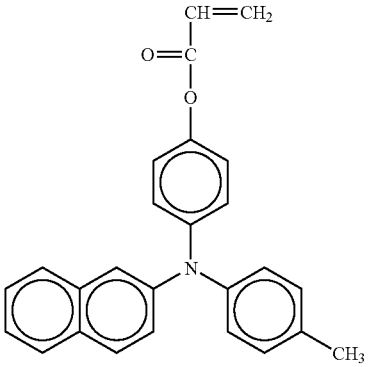
No. 39
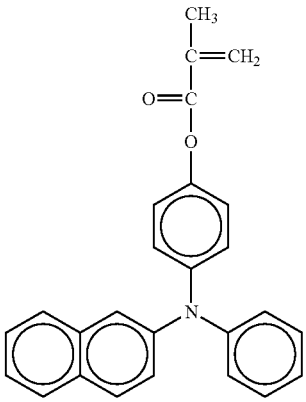
-continued
No. 40
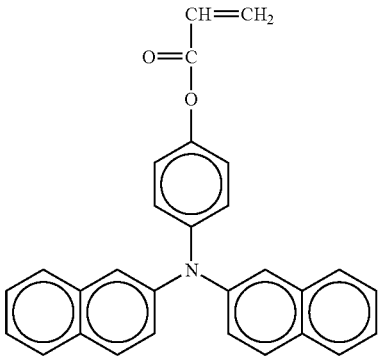
No. 41
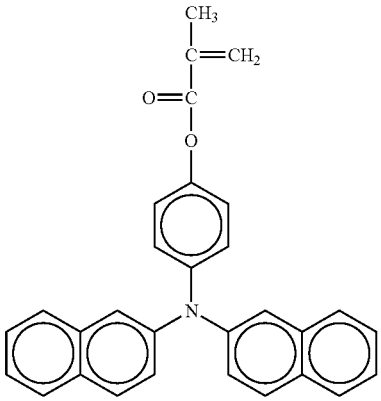
No. 42
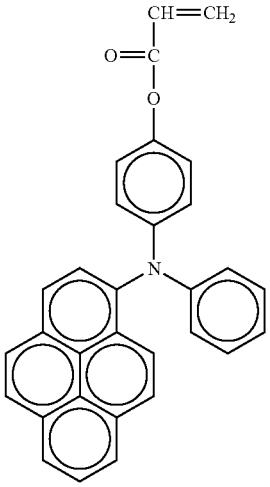

-continued
No. 43
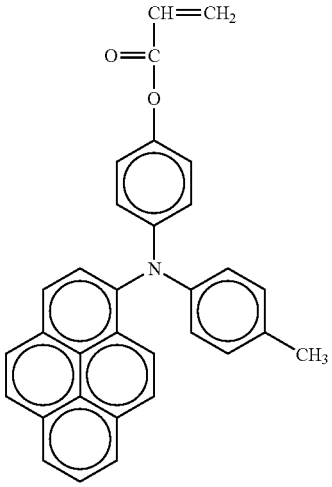
No. 44
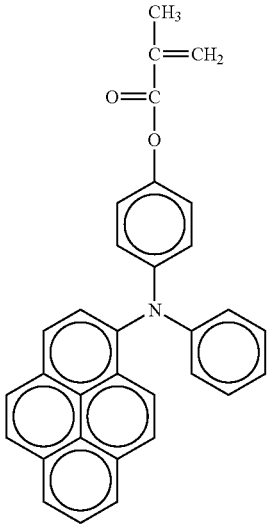
No. 45
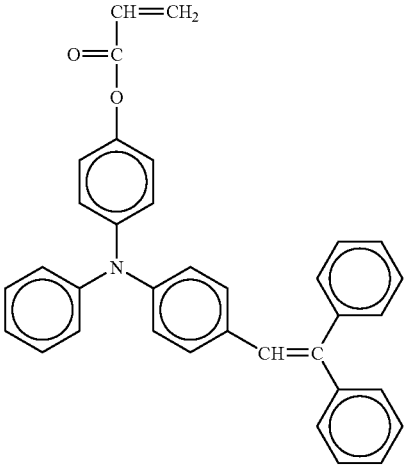
-continued
No. 46
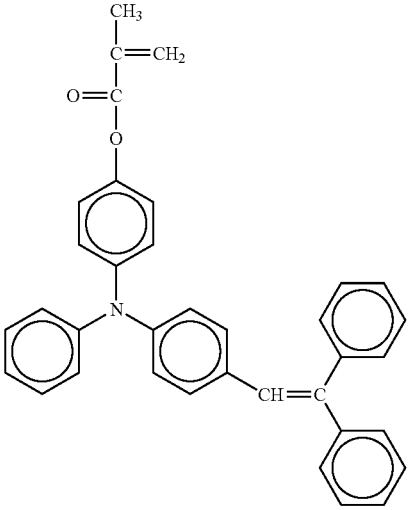
No. 47
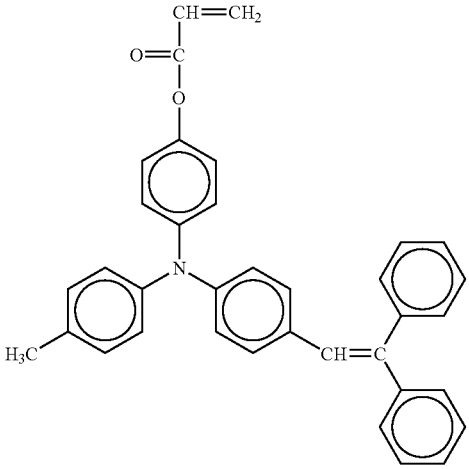
No. 48
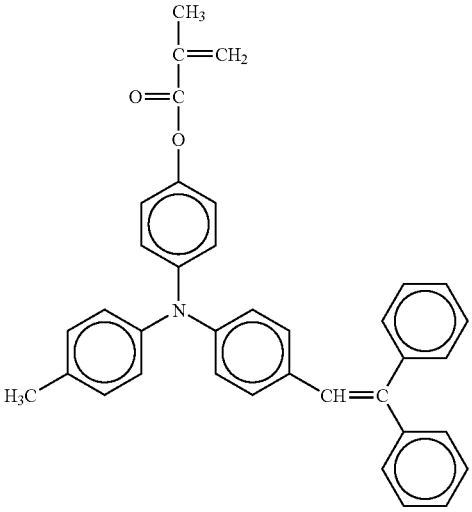

-continued
No. 49
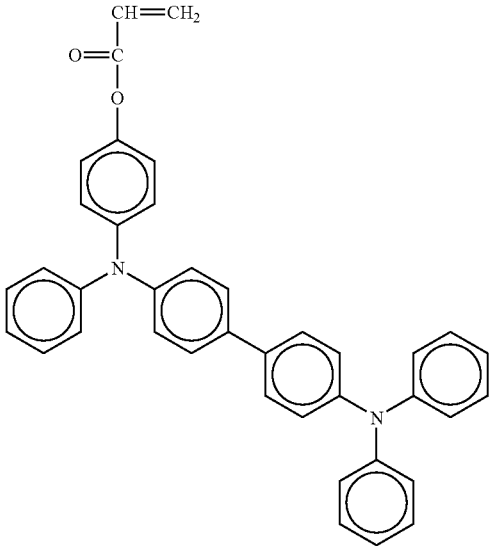
No. 50
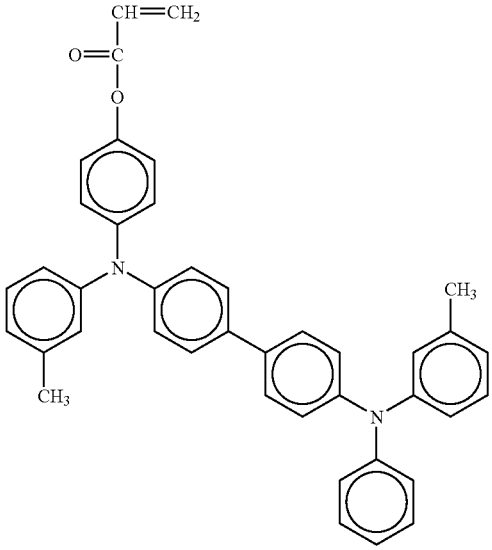
No. 51
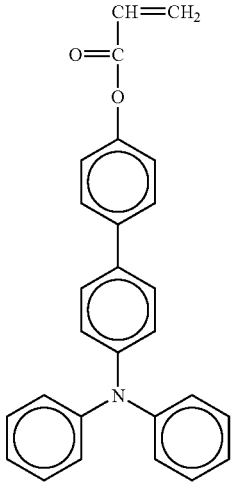
-continued
No. 52
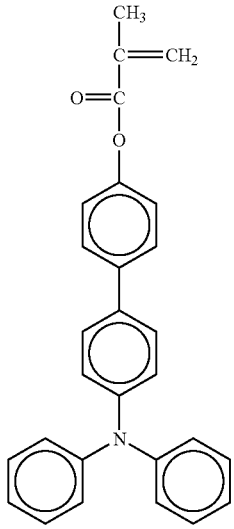
No. 53
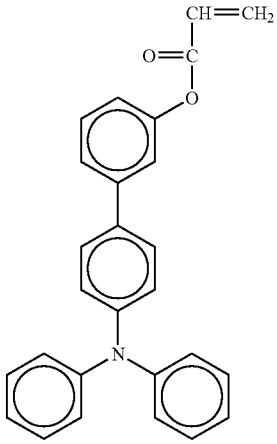
No. 54
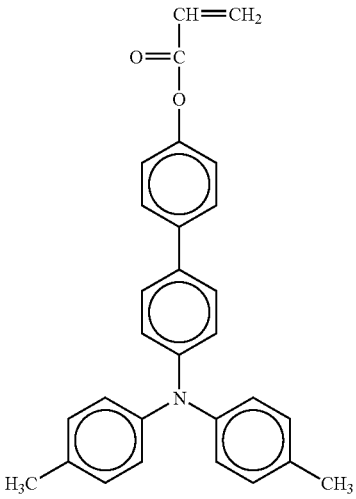

-continued
No. 55
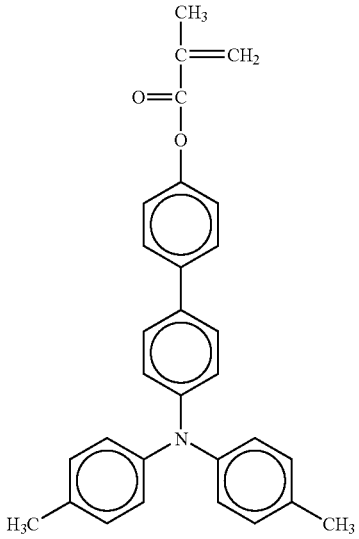
No. 56
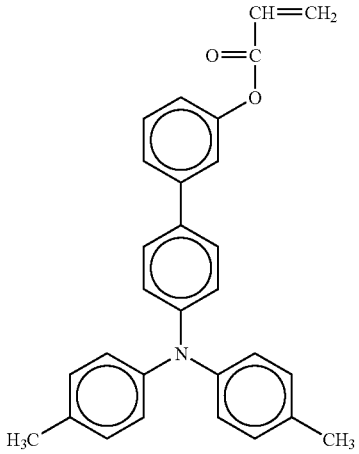
No. 57
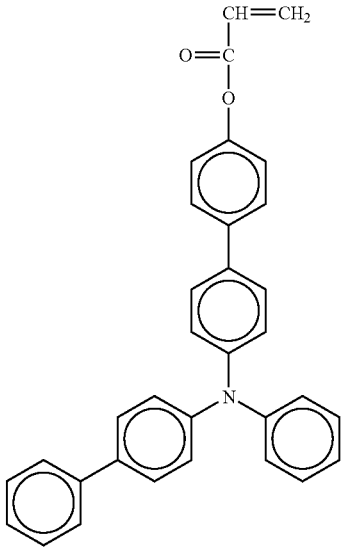
-continued
No. 58
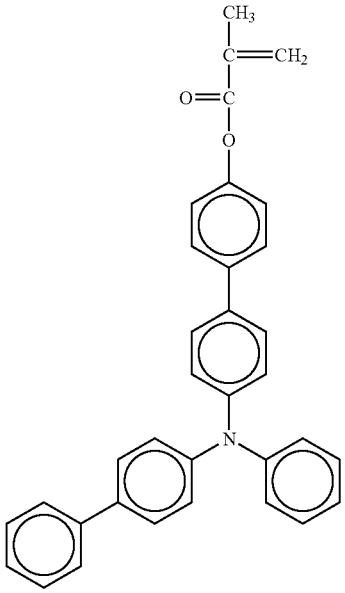
No. 59
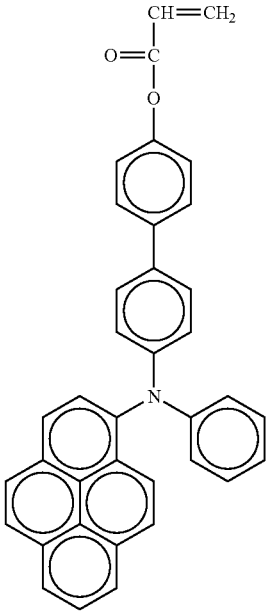

-continued
No. 60
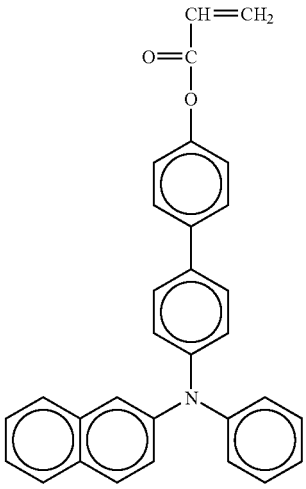
No. 61
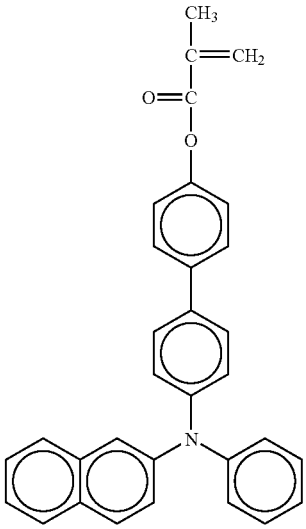
No. 62
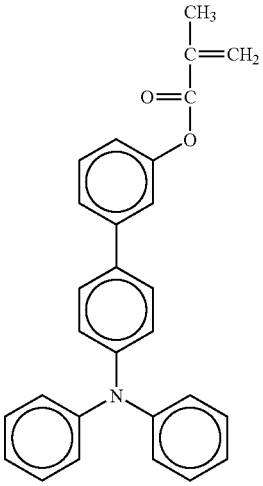
-continued
No. 63
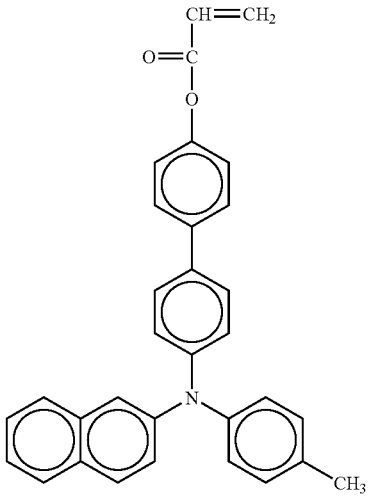
No. 64
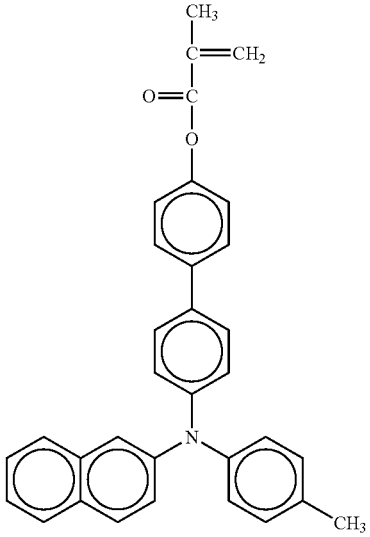
No. 65
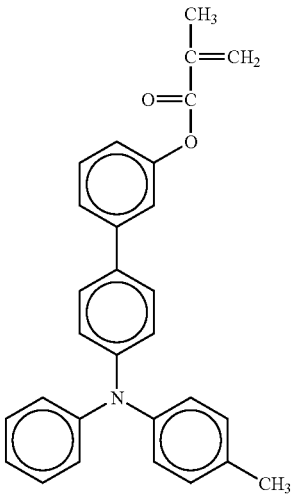

-continued
No. 66
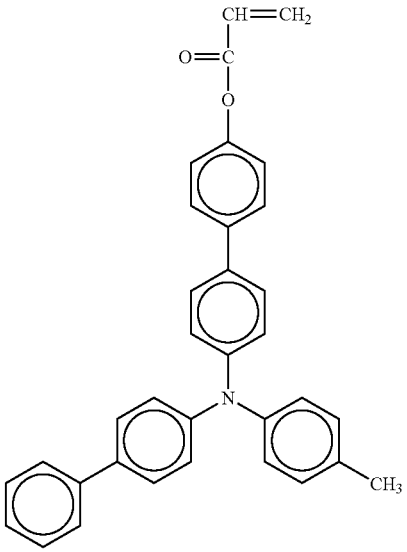
No. 67
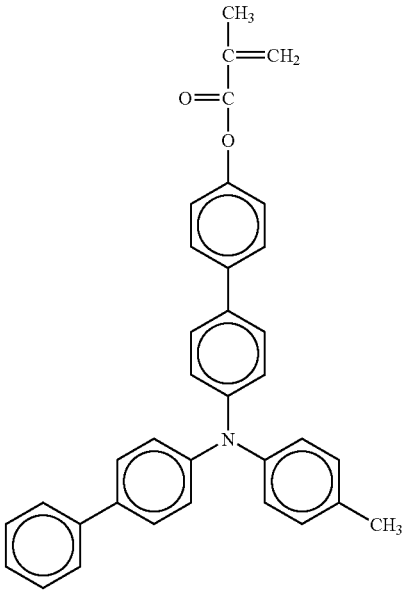
-continued
No. 68
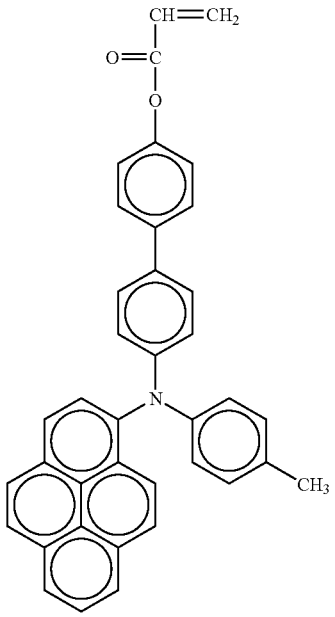
No. 69
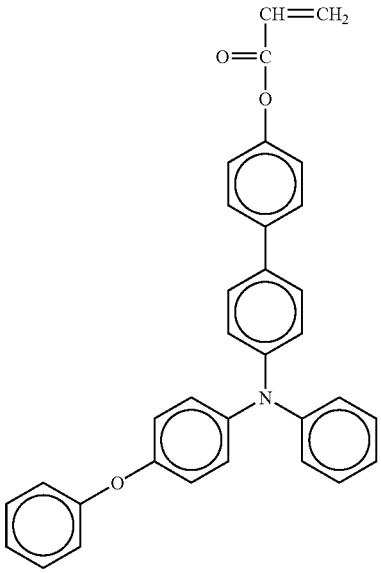

-continued
No. 70
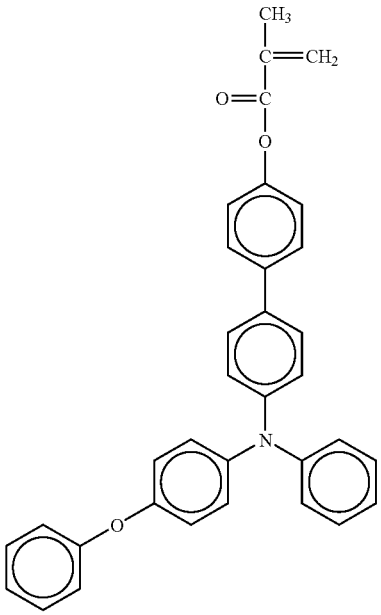
No. 71
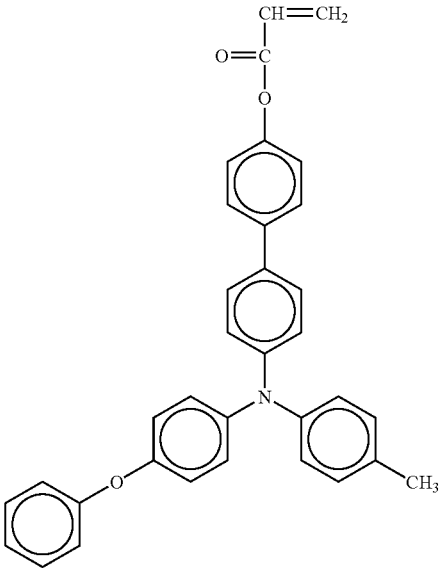
-continued
No. 72
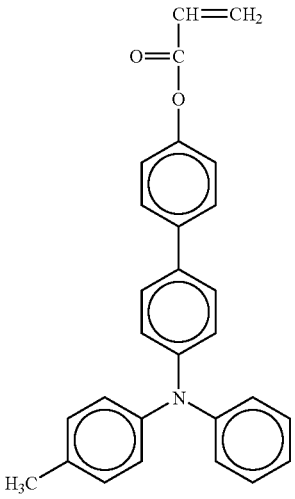
No. 73
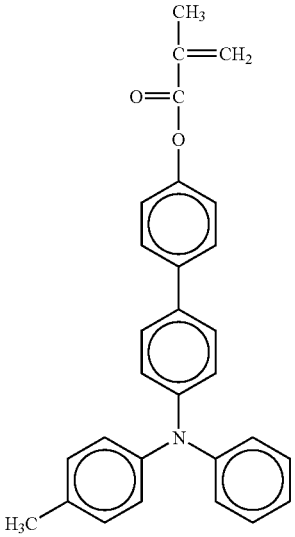
No. 74
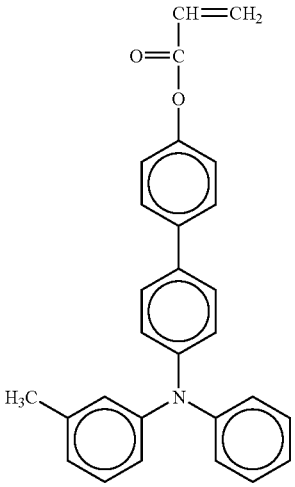

-continued
No. 75
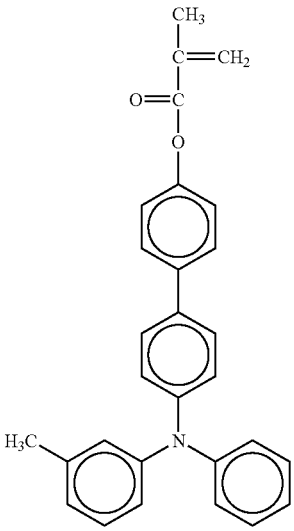
No. 76
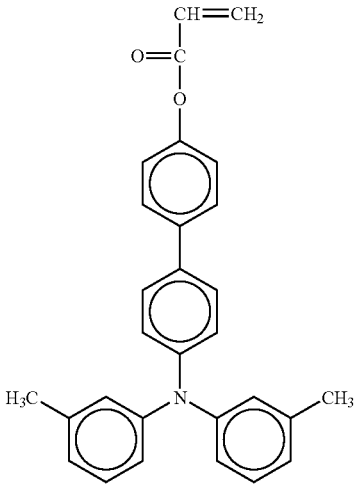
No. 77
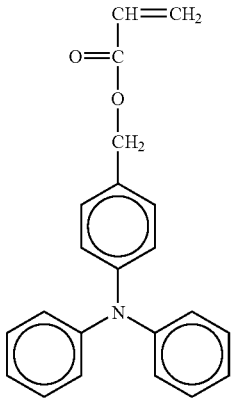
-continued
No. 78
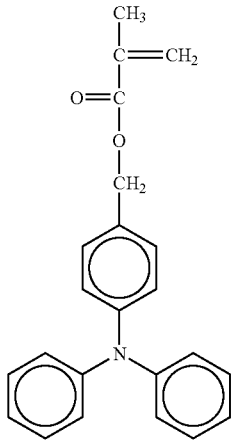
No. 79
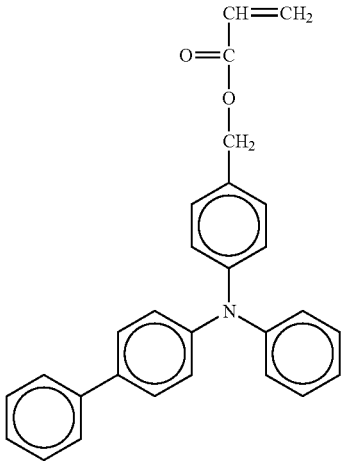
No. 80
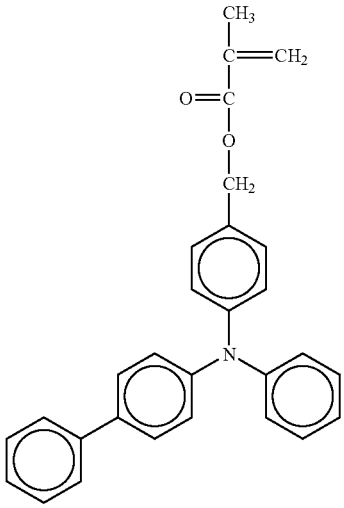

-continued
No. 81
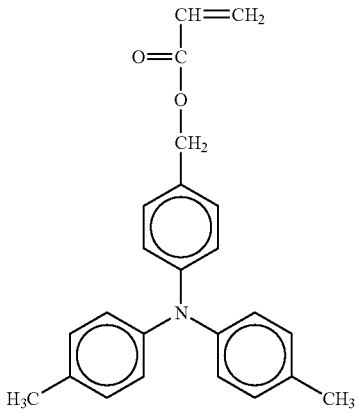
No. 82
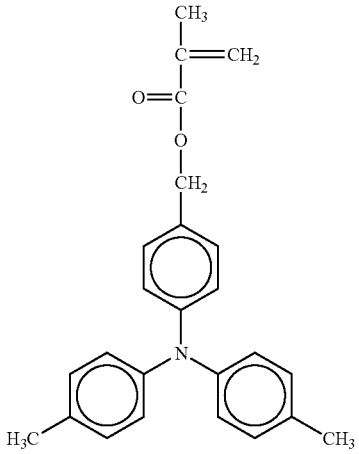
No. 83
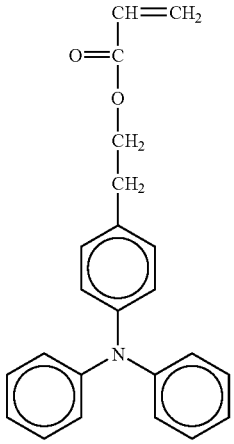
-continued
No. 84
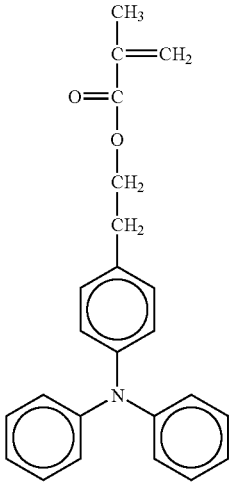
No. 85
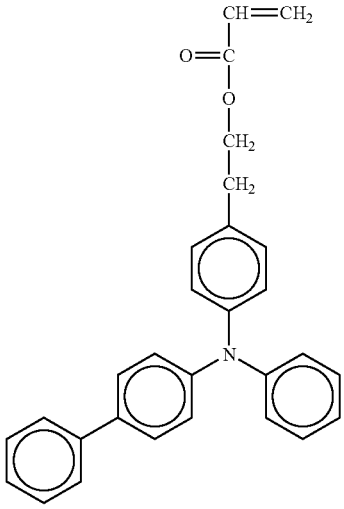
No. 86
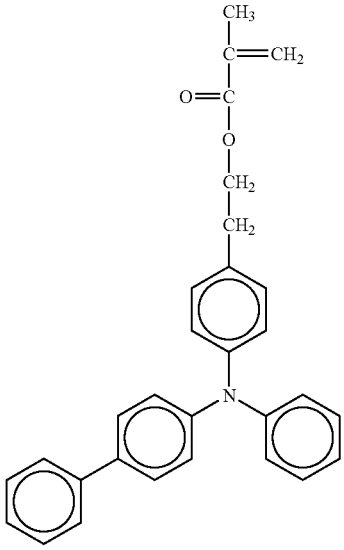

-continued
No. 87
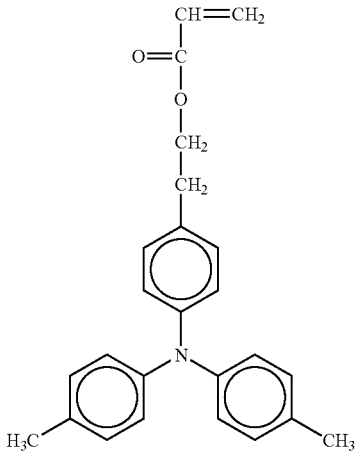
No. 88
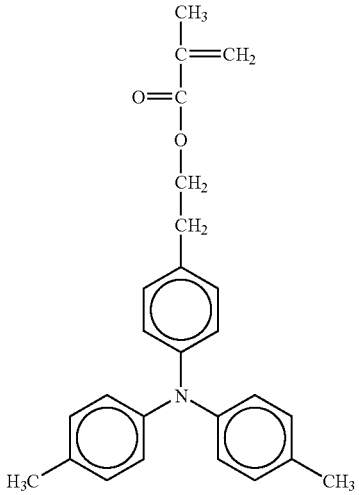
No. 89
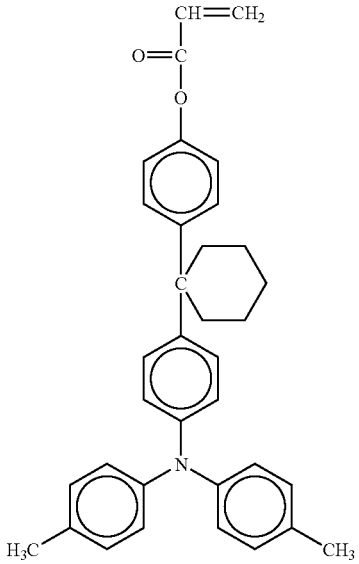
-continued
No. 90
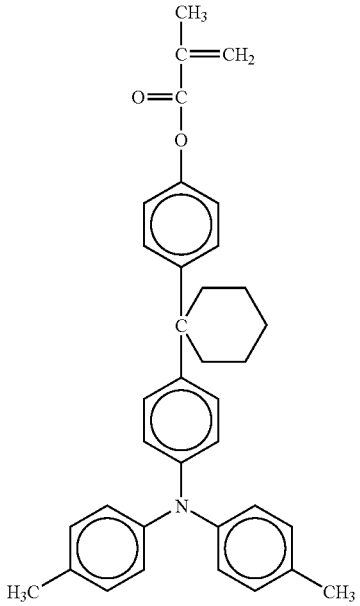
No. 91
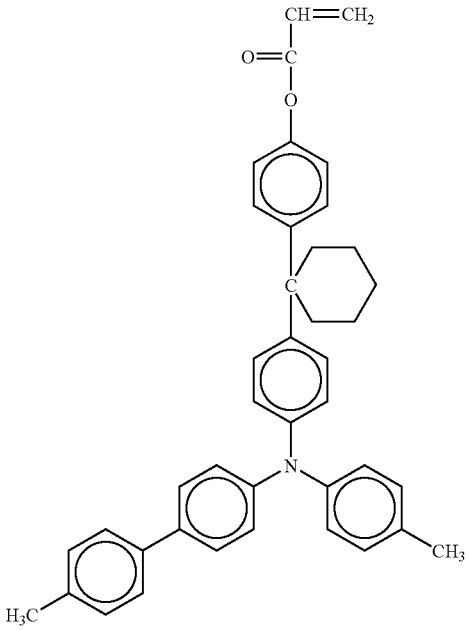

-continued
No. 92
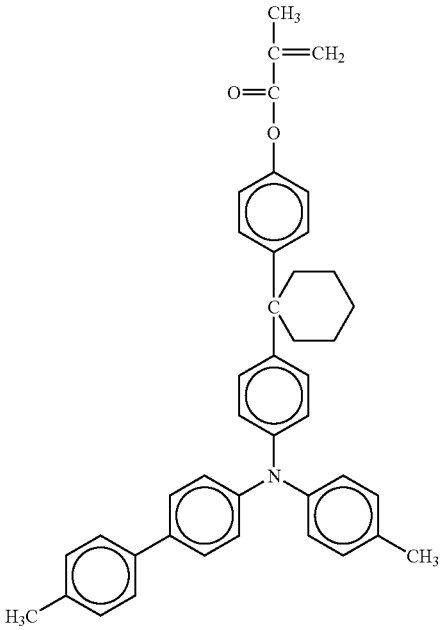
-continued
No. 94
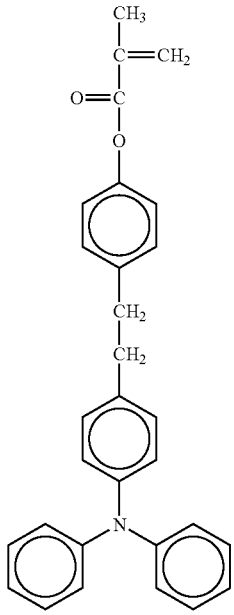
No. 93
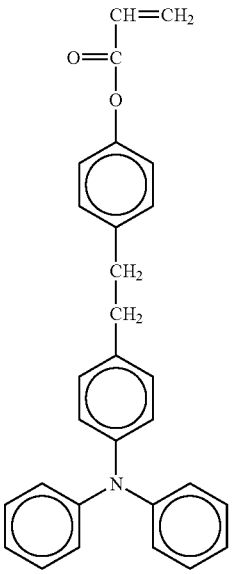
No. 95
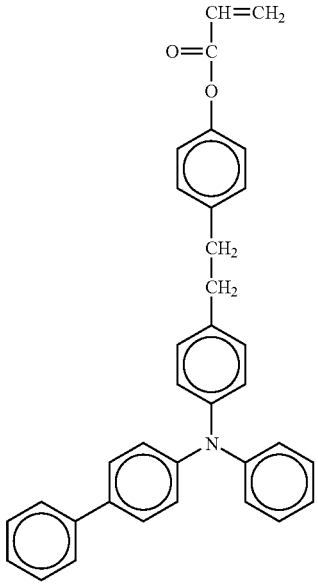

-continued
No. 96
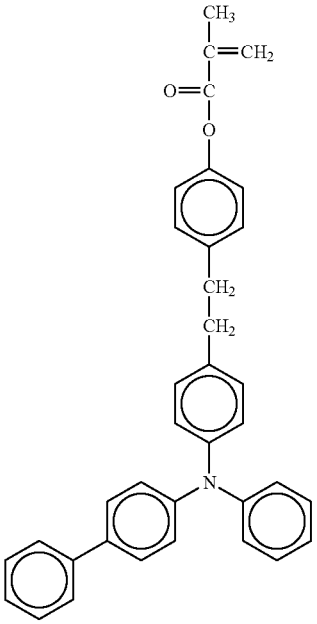
No. 97
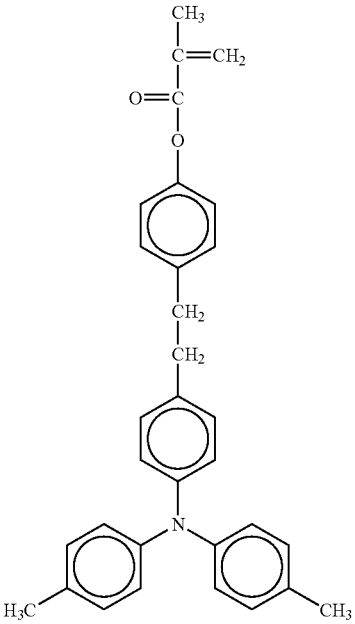
-continued
No. 98
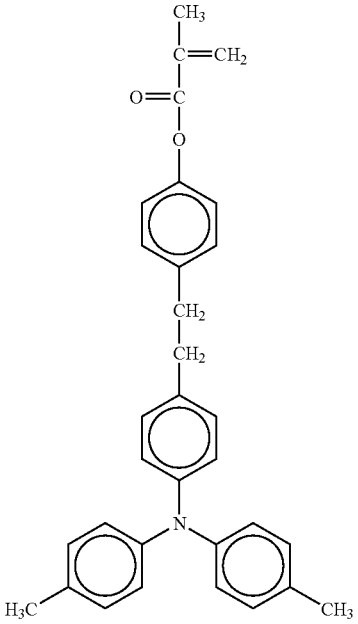
No. 99
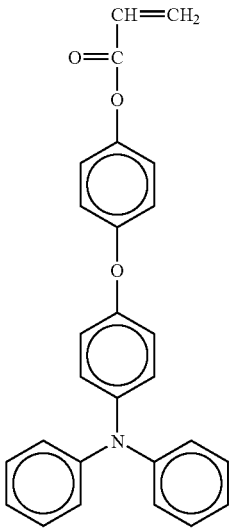

-continued
No. 100
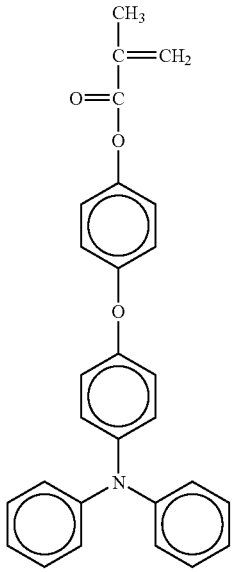
-continued
No. 102
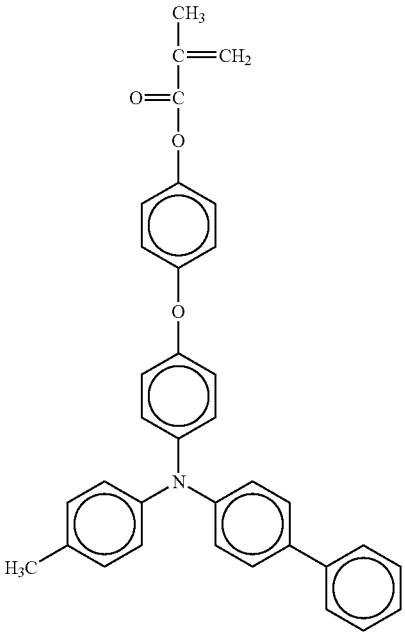
No. 101
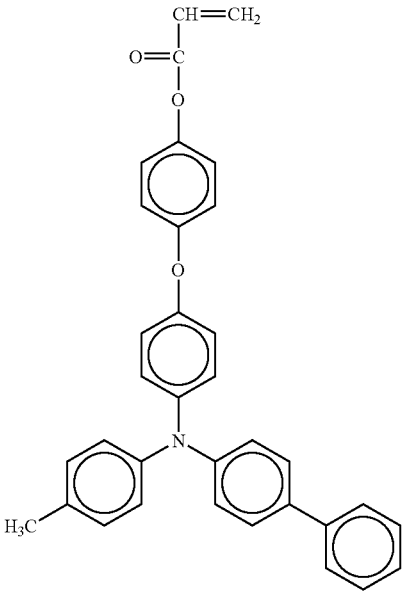
No. 103
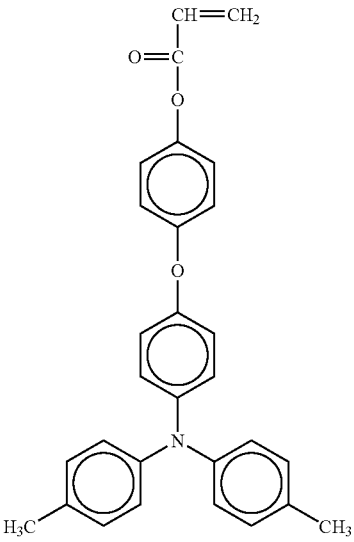

-continued
No. 104
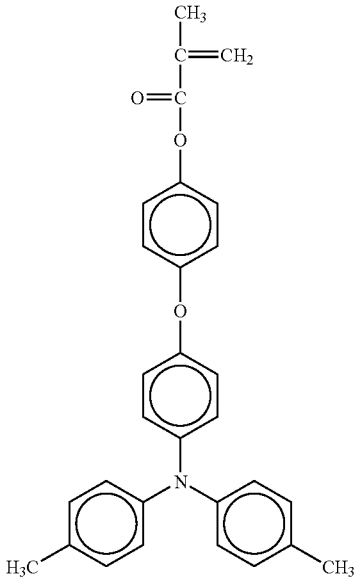
No. 105
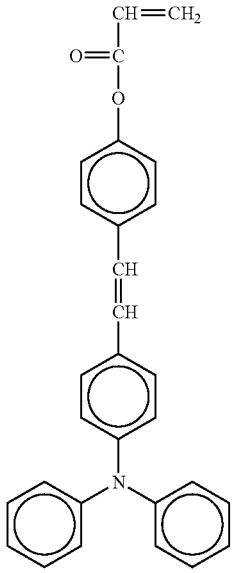
-continued
No. 106
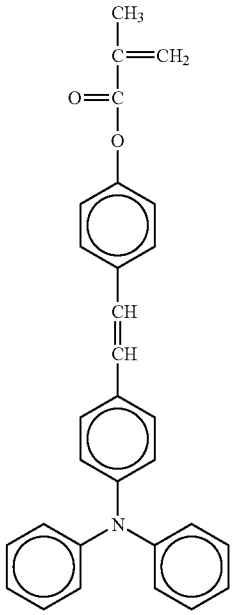
No. 107
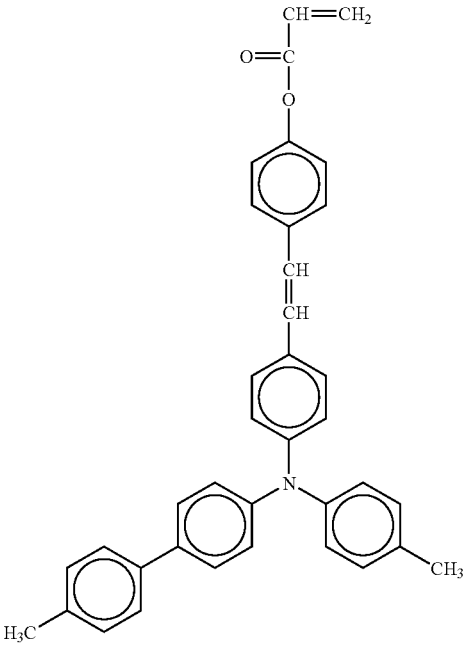

-continued
No. 108
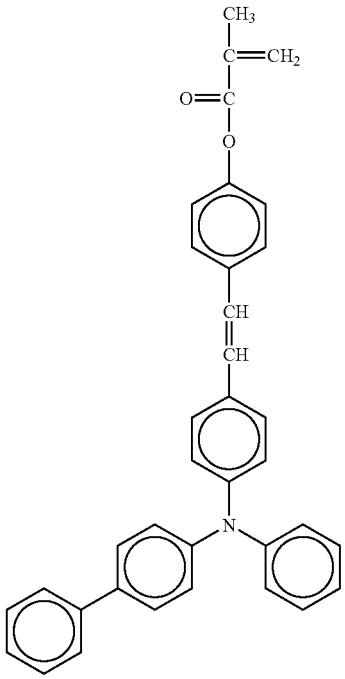
No. 109
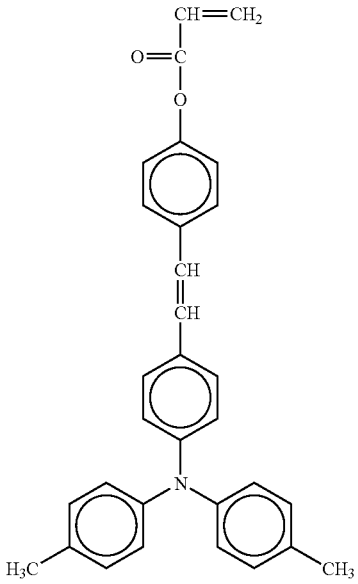
-continued
No. 110
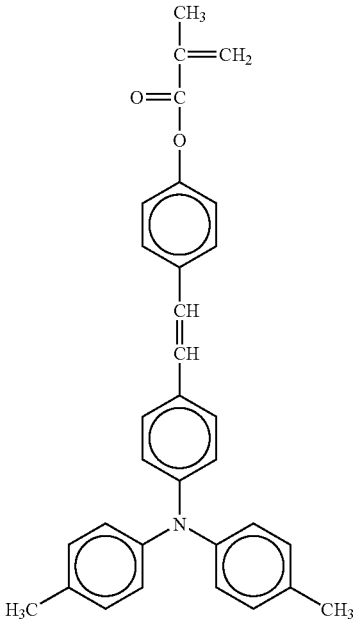
No. 111
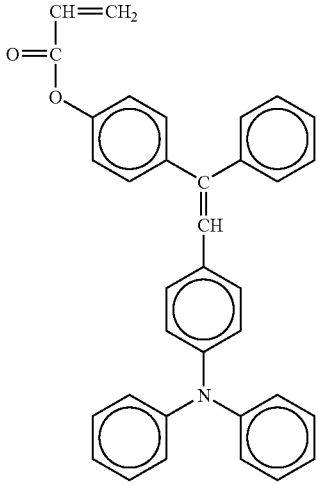
No. 112
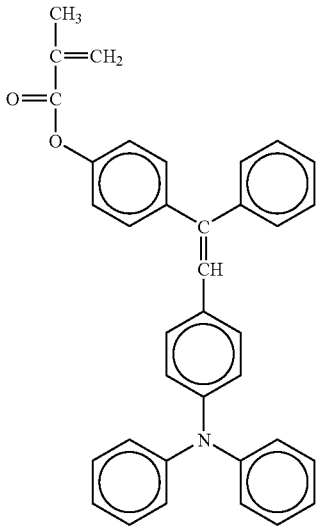

-continued
No. 113
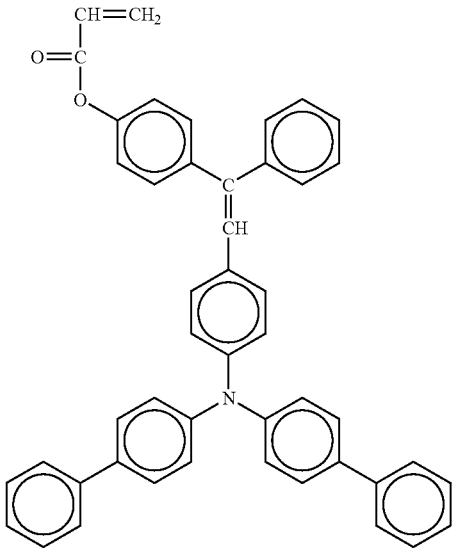
No. 114
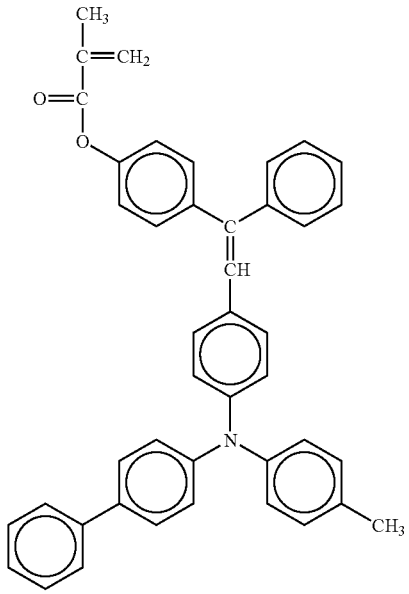
-continued
No. 115
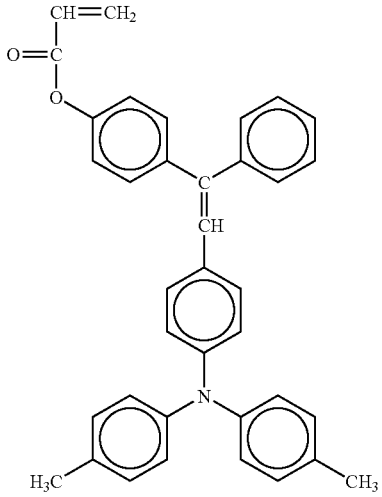
No. 116
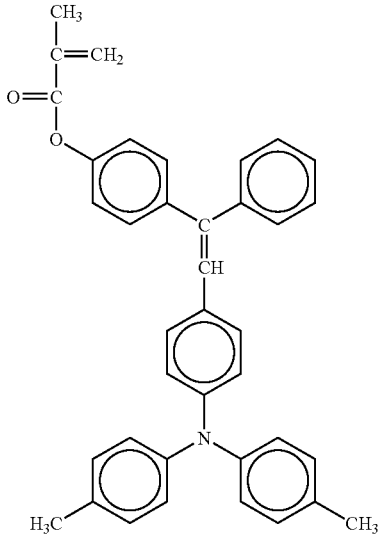
No. 117
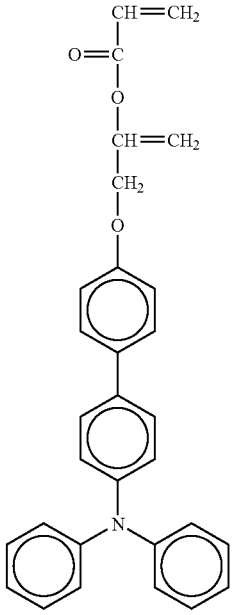

-continued
No. 118
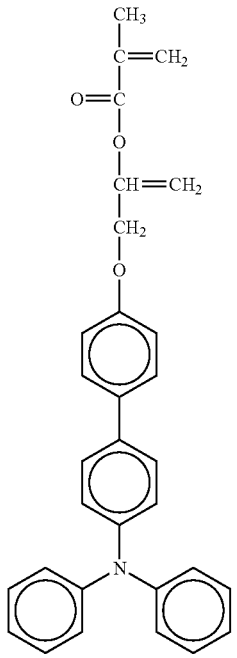
-continued
No. 120
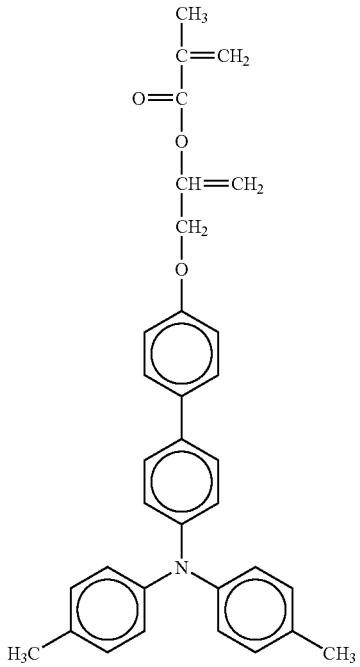
No. 119
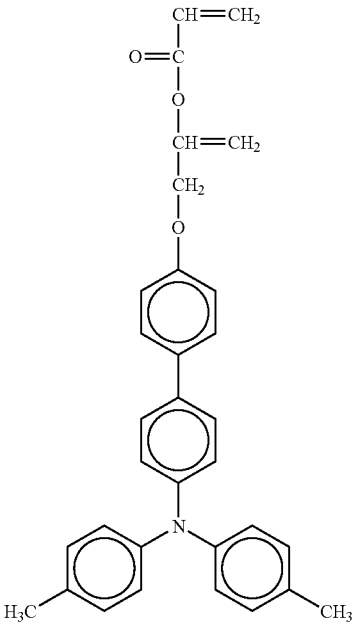
No. 121
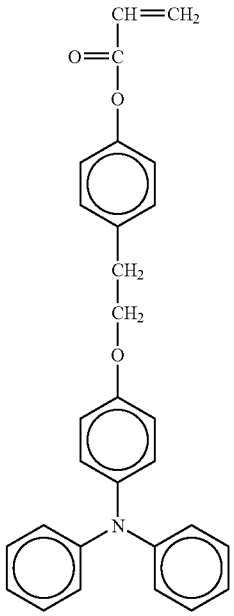

-continued
No. 122
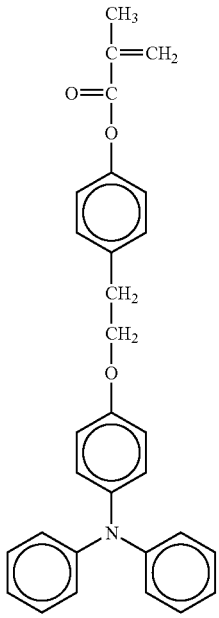
-continued
No. 124
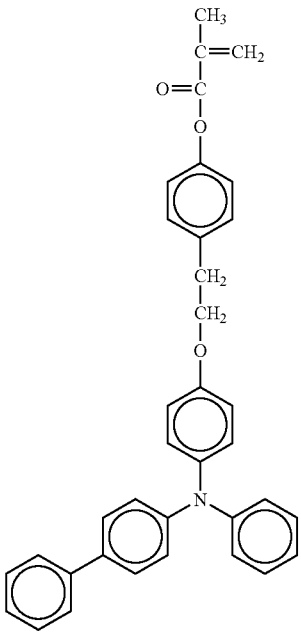
No. 123
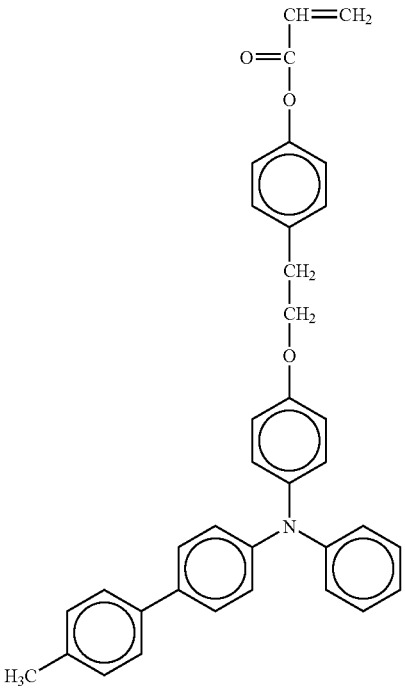
No. 125
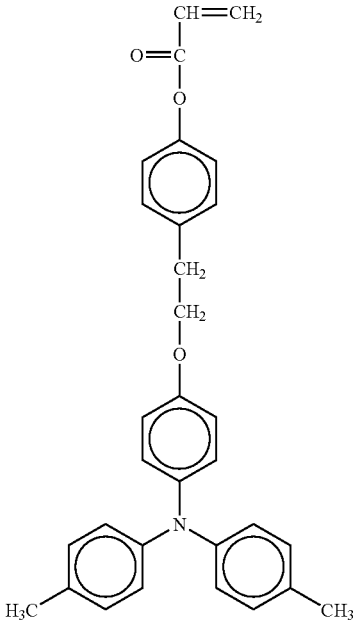

-continued
No. 126
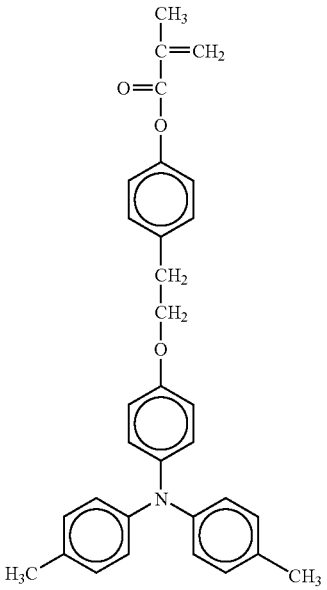
No. 127
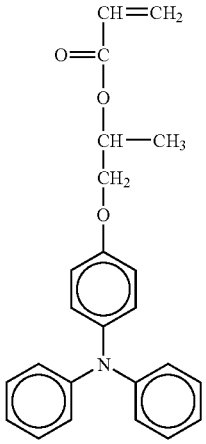
No. 128
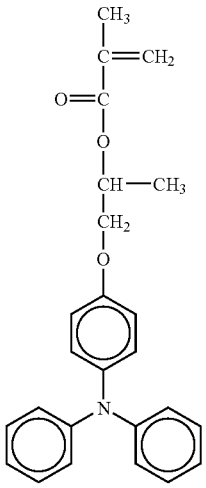
-continued
No. 129
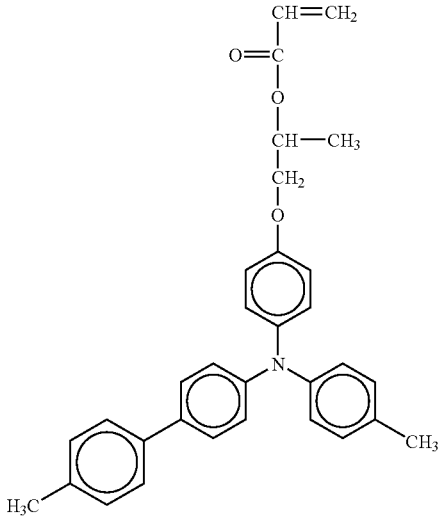
No. 130
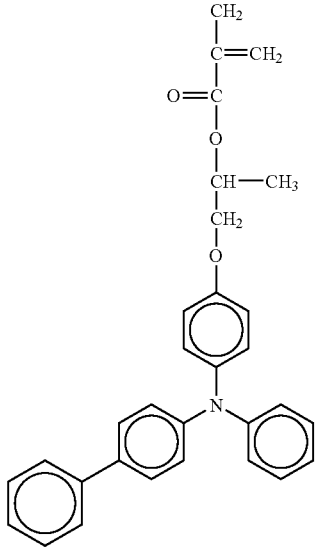
No. 131
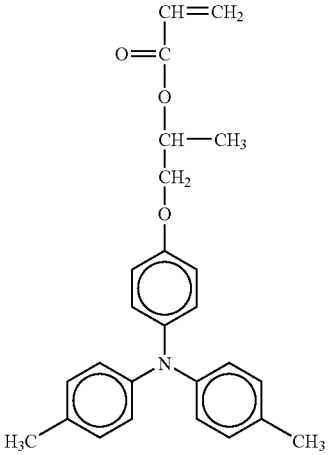

-continued
No. 132
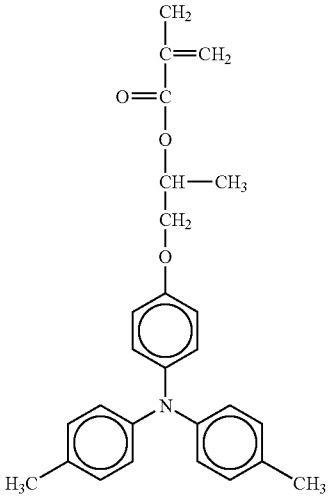
No. 133
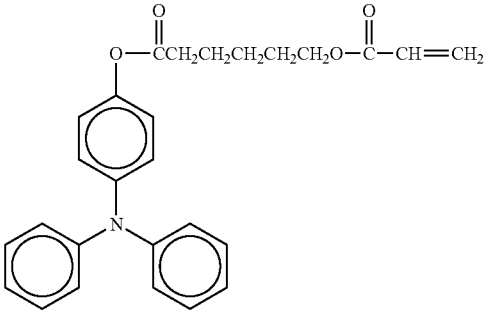
No. 134
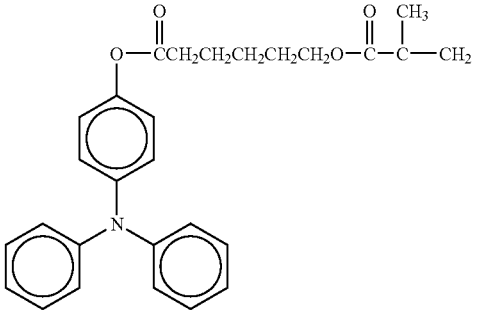
No. 135
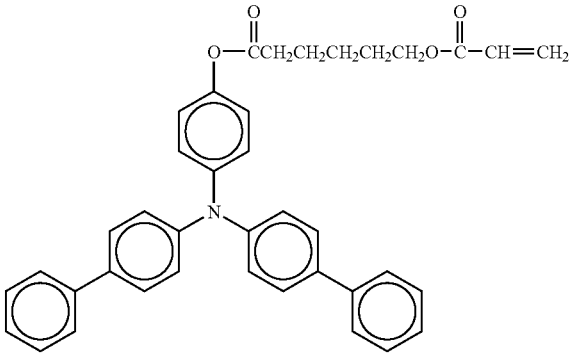
-continued
No. 136
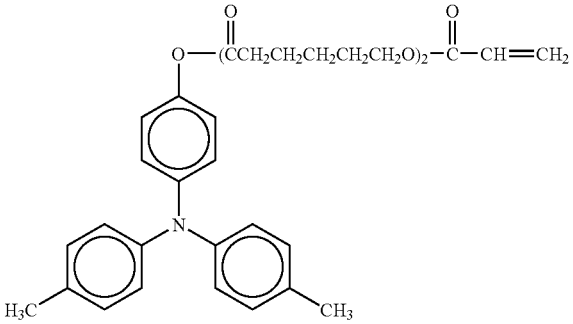
No. 137
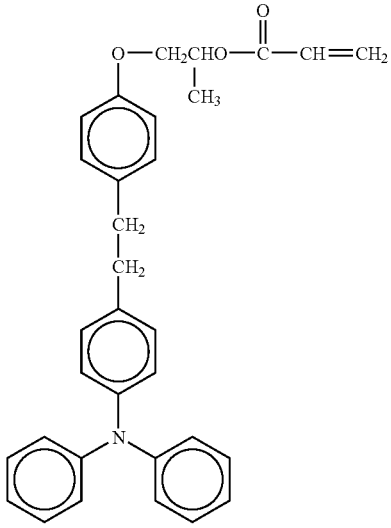
No. 138
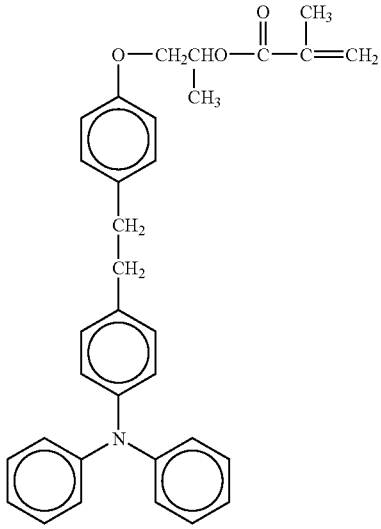

-continued
No. 139
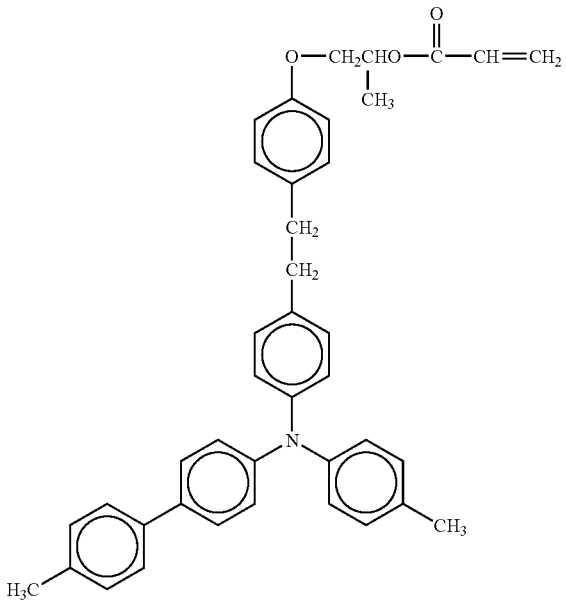
No. 140
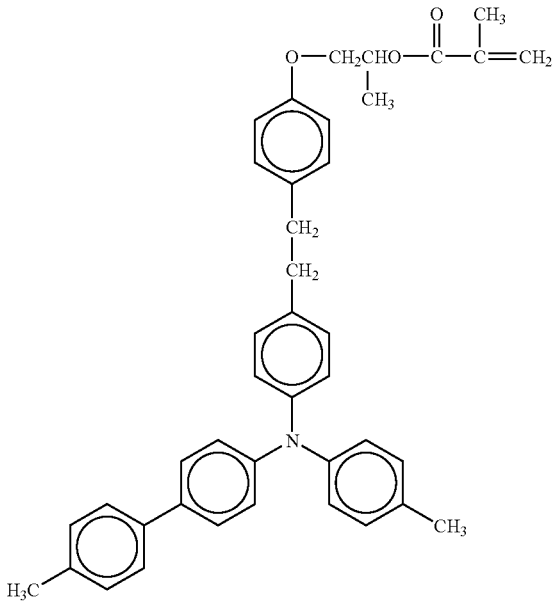
-continued
No. 141
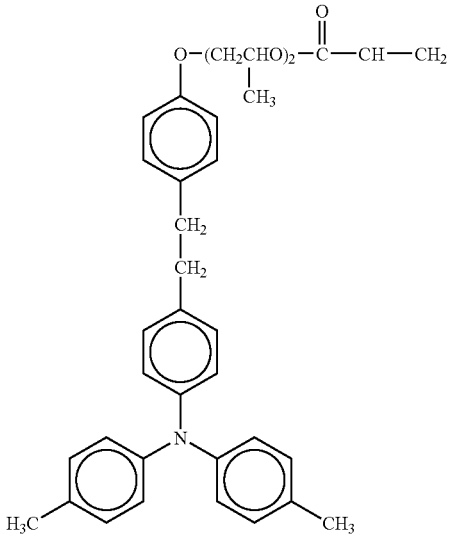
No. 142
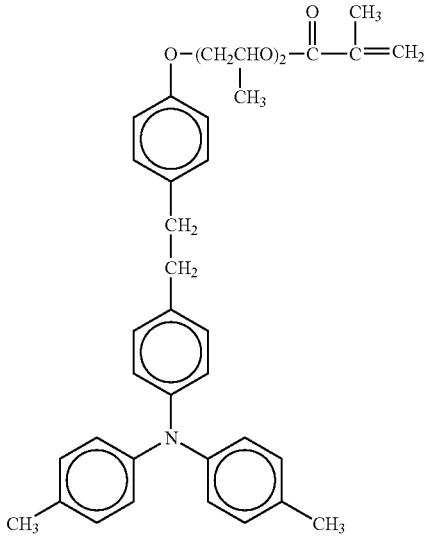
No. 143
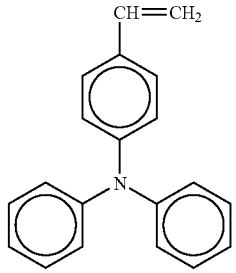
No. 144
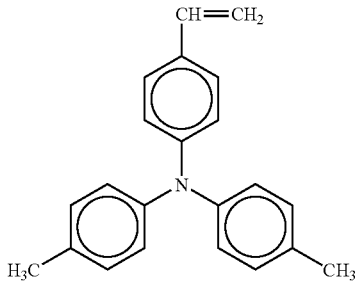

-continued
No. 145
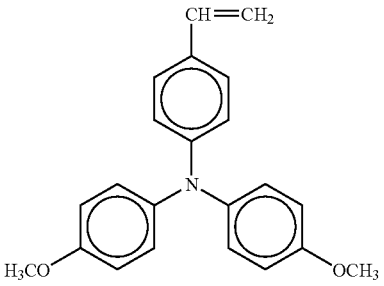
No. 146
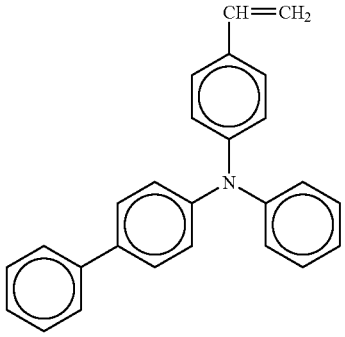
No. 147
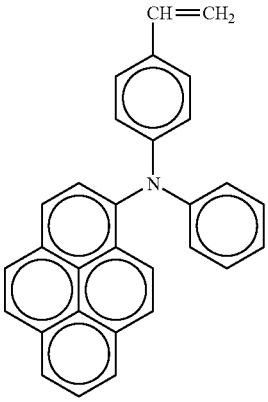
No. 148
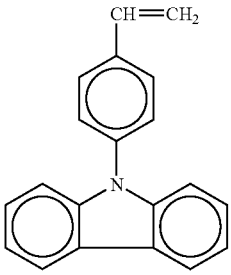
No. 149
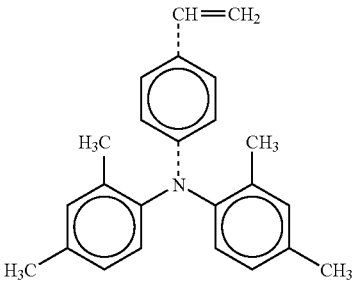
-continued
No. 150
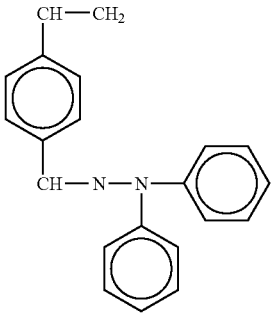
No. 151
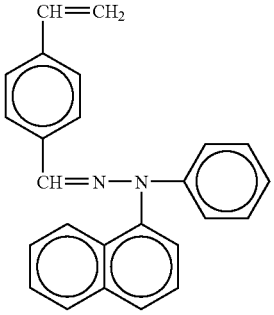
No. 152
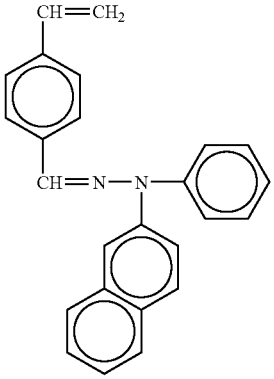
No. 153
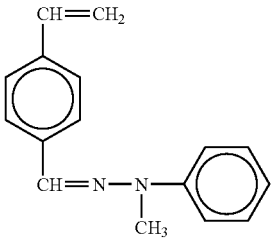
No. 154
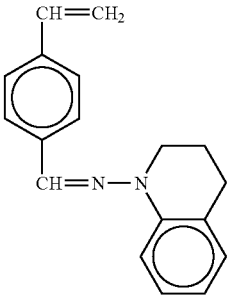

-continued

No. 155

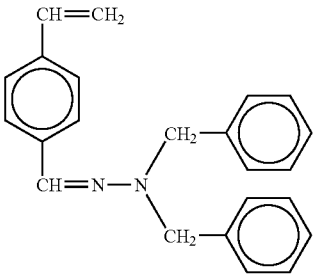

No. 156

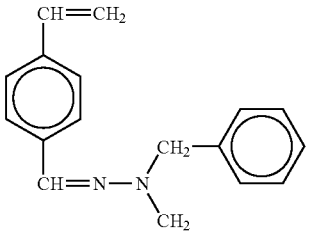

No. 157

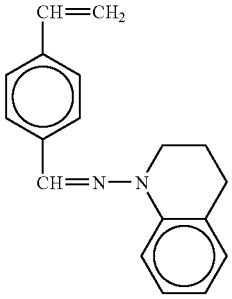

No. 158

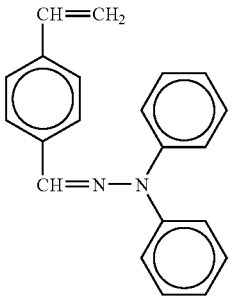

No. 159

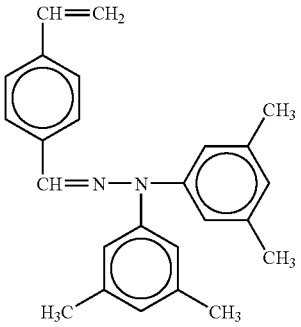

-continued

No. 160

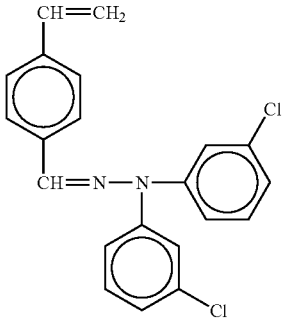

The radical polymerizing compound having at least one radical polymerizing functional group and a charge transporting structure for use in the present invention is essential for imparting a charge transportability to the crosslinked surface layer, and is preferably included therein in an mount of 20 to 80% by weight, and more preferably from 30 to 70% by weight based on total weight thereof. When less than 20% by weight, the crosslinked surface layer cannot maintain the charge transportability, a sensitivity of the resultant photoreceptor deteriorates and a residual potential thereof increases in repeated use. When greater than 80% by weight, a content of the monomer having three or more functional groups without a charge transporting structure decreases and the crosslinked density deteriorates, and therefore the resultant photoreceptor does not have a high abrasion resistance. Although it depends on a required abrasion resistance and electrical properties, in consideration of a balance therebetween, a content of the radical polymerizing compound having one functional group with a charge transporting structure is most preferably from 30 to 70% by weight.

Specific examples of the radical polymerizing monomer having three or more radical polymerizing functional groups, without a charge transporting structure, include the following materials, but which are not limited thereto.

Namely, trimethylolpropanetriacrylate (TMPTA), trimethylolpropanetrimethacrylate, HPA-modified trimethylolpropanetriacrylate, EO-modified trimethylolpropanetriacrylate, PO-modified trimethylolpropanetriacrylate, caprolactone-modified trimethylolpropanetriacrylate, HPA-modified trimethylolpropanetrimethacrylate, pentaerythritoltriacrylate, pentaerythritoltetraacrylate (PETTA), glyceroltriacrylate, ECH-modified glyceroltriacrylate, EO-modified glyceroltriacrylate, PO-modified glyceroltriacrylate, tris(acryloxyethyl)isocyanurate, dipentaerythritolhexaacrylate (DPHA), caprolactone-modified dipentaerythritolhexaacrylate, dipentaerythritolhydroxypentaacrylate, alkyl-modified dipentaerythritolpentaacrylate, alkyl-modified dipentaerythritoltetraacrylate, alkyl-modified dipentaerythritoltriacrylate, dimethylolpropanetetraacrylate (DTMPTA), pentaerythritolethoxytetraacrylate, 2,2,5,5-tetrahydroxymethylcyclopentanonetetraacrylate, etc. are available. These can be used alone or in combination.

The radical polymerizing monomer having three or more radical polymerizing functional groups, without a charge transporting structure, for use in the present invention preferably has a ratio of the molecular weight to the number of functional groups (molecular weight/number of functional groups) in the monomer not greater than 250. The crosslinked surface layer preferably includes the radical polymerizing monomer having three or more radical polymerizing functional groups, without a charge transporting structure, in an amount of from 20 to 80% by weight, and more preferably from 30 to 70% by weight. When less than 20% by weight, a three-dimensional crosslinked bonding density of the crosslinked surface layer is insufficient, and the abrasion resistance thereof does not remarkably improve more than a layer including a conventional thermoplastic resin. When greater than 80% by weight, a content of a charge transporting compound lowers and electrical properties of the resultant photoreceptor deteriorates. Although it depends on a required abrasion resistance and electrical properties, in consideration of a balance therebetween, a content of the radical polymerizing monomer having three or more radical polymerizing functional groups, without a charge transporting structure, is most preferably from 30 to 70% by weight based on total weight of the crosslinked surface layer.

The crosslinked surface layer of the present invention can include a radical polymerizing monomer and a radical polymerizing oligomer having one or two radical polymerizing functional groups as well. Known radical polymerizing monomers and oligomers can be used.

Specific examples of the radical monomer having one functional group include 2-ethylhexylacrylate, 2-hydroxyethylacrylate, 2-hydroxypropylacrylate, tetrahydrofurfurylacrylate, 2-ethylhexylcarbitolacrylate, 3-methoxybutylacrylate, benzylacrylate, cyclohexylacrylate, isoamylacrylate, isobutylacrylate, methoxytriethyleneglycolacrylate, phenoxytetraethyleneglycolacrylate, cetylacrylate, isostearylacrylate, stearylacrylate, styrene monomer, etc. These can be used alone or in combination.

Specific examples of the radical monomer having two functional groups include 1,3-butanediolacrylate, 1,4-butanedioldiacrylate, 1,4-butanedioldimethacrylate, 1,6-hexanedioldiacrylate, 1,6-hexanedioldimethacrylate, diethyleneglycoldiacrylate, neopentylglycoldiacrylate, EO-modified bisphenol A diacrylate, EO-modified bisphenol F diacrylate, etc. These can be used alone or in combination.

Specific examples of the functional monomers include octafluoropentylacrylate, 2-perfluorooctylethylacrylate, 2-perfluorooctylethylmethacrylate, 2-perfluoroisononylethylacrylate, etc. wherein a fluorine atom is substituted; and reactive additives having a radical polymerizing functional group such as reactive silicone additives, e.g., a PO-modified-2-neopentylglycoldiacrylate. These can be used alone or in combination. A coating liquid for forming the crosslinked layer preferably includes the functional monomers in an amount of from 0.01 to 30% by weight, and more preferably from 0.05 to 20% by weight based on total weight of solid contents therein.

Specific examples of the radical polymerizing oligomer includes epoxyacrylate oligomers, urethaneacrylate oligomers and polyetseracrylate oligomers. However, when the crosslinked surface layer includes a large amount of the radical polymerizing monomer and radical polymerizing oligomer having one or two radical polymerizing functional groups, the three-dimensional crosslinked bonding density thereof substantially deteriorates, resulting in deterioration of the abrasion resistance thereof. Therefore, the surface layer of the present invention preferably includes the monomers and oligomers in an amount not greater than 150 parts by weight, and more preferably not greater than 100 parts by weight per 100 parts by weight of the urethane oligomer having a radical polymerizing functional group or the radical polymerizing oligomer having a polyester structure.

The crosslinked surface layer of the present invention can optionally include a polymerization initiator to effectively proceed the crosslinking reaction.

Specific examples of the heat polymerization initiators include peroxide initiators such as 2,5-dimethylhexane-2,5-dihydrooxide, dicumylperoxide, benzoylperoxide, t-butylcumylperoxide, 2,5-dimethyl-2,5-di(peroxybenzoyl)hexyne-3, di-t-butylbeloxide, t-butylhydrobeloxide, cumenehydobeloxide and lauroylperoxide; and azo initiators such as azobisisobutylnitrile, azobiscyclohexanecarbonitrile, azobisisomethylbutyrate, azobisisobutylamidinehydorchloride and 4,4'-azobis-4-cyanovaleric acid.

Specific examples of the photo polymerization initiators include acetone or ketal photo polymerization initiators such as diethoxyacetophenone, 2,2-dimethoxy-1,2-diphenylethane-1-one, 1-hydroxy-cyclohexyl-phenyl-ketone, 4-(2-hydroxyethoxy)phenyl-(2-hydroxy-2-propyl)ketone, 2-benzyl-2-dimethylamino-1-(4-molpholinophenyl)butanone-1,2-hydroxy-2-methyl-1-phenylpropane-1-one and 1-phenyl-1,2-propanedion-2-(o-ethoxycarbonyl)oxime; benzoinether photo polymerization initiators such as benzoin, benzoinmethylether, benzoinethylether, benzoinisobutylether and benzoinisopropylether; benzophenone photo polymerization initiators such as benzophenone, 4-hydroxybenzophenone, o-benzoylmethylbenzoate, 2-benzoylnaphthalene, 4-benzoylviphenyl, 4-benzoylphenylether, acrylated benzophenone and 1,4-benzoylbenzene; thioxanthone photo polymerization initiators such as 2-isopropylthioxanthone, 2-chlorothioxanthone, 2,4-dimethylthioxanthone, 2,4-diethylthioxanthone and 2,4-dichlorothioxanthone; and other photo polymerization initiators such as ethylanthraquinone, 2,4,6-trimethylbenzoyldiphenylphosphineoxide, 2,4,6-trimethylbenzoyldiphenylethoxyphosphineoxide, bis(2,4,6-trimethylbenzoyl)phenylphosphineoxide, bis(2,4-dimethoxybenzoyl)-2,4,4-trimethylpentylphosphineoxi de, methylphenylglyoxyester, 9,10-phenanthrene, acridine compounds, triazine compounds and imidazole compounds. Further, a material having a photo polymerizing effect can be used alone or in combination with the above-mentioned photo polymerization initiators. Specific examples of the materials include triethanolamine, methyldiethanol amine, 4-dimethylaminoethylbenzoate, 4-dimethylaminoisoamylbenzoate, ethyl(2-dimethylamino)benzoate and 4,4-dimethylaminobenzophenone.

The crosslinked surface layer of the present invention can optionally include a particulate filler as well to improve abrasion resistance thereof.

The filler preferably has a primary particle diameter of from 0.01 to 0.5 μm in terms of a light transmittance and an abrasion resistance of the surface layer. When less than 0.01 μm, dispersibility thereof deteriorates and the surface does not have a sufficient abrasion resistance. When greater than 0.5 μm, the filler quickly settles down in a dispersion liquid and filming of a toner over the surface layer occurs.

The higher the concentration of the filler material in the surface layer, the higher the abrasion resistance. However, when the concentration is too high, a residual potential increases and a writing light transmittance of the surface layer deteriorates. Therefore, the filler material preferably has a concentration not greater than 50% by weight, and more preferably not greater than 30% by weight based on total weight of solid contents in the surface layer.

Further, a surface of the filler is preferably treated with a surface treatment agent to improve dispersibility thereof. The dispersibility deterioration of the filler causes not only an increase of a residual potential but also transparency deterioration of the surface layer and a defect thereof, and further deterioration of the abrasion resistance thereof. Therefore, it is probable that the dispersibility deterioration of the filler will be a serious problem impairing a high durability of the resultant photoreceptor or high-quality images produced thereby. Specific examples of the surface treatment agent include any conventional surface treatment agents, but they preferably can maintain an insulation of the filler.

Although an amount of the surface treatment agent depends on the primary particle diameter of a filler, the amount thereof is preferably from 3 to 30% by weight, and more preferably from 5 to 20% by weight base on total weight of the filler. When less than 3% by weight, the filler is not well dispersed. When greater than 30% by weight, a residual potential significantly increases. These filler materials can be used alone or in combination.

Further, a coating liquid for the surface layer of the present invention may optionally include various additives such as plasticizers (to soften a stress and improve adhesiveness thereof), leveling agents and low-molecular-weight charge transport materials without a radical reactivity. Known additives can be used, and specific examples of the plasticizers include plasticizers such as dibutylphthalate and dioctylphthalate used in typical resins. A content thereof is preferably not greater than 20% by weight, and more preferably not greater than 10% based on total weight of solid contents of the coating liquid. Specific examples of the leveling agents include silicone oil such as dimethylsilicone oil and methylphenylsilicone oil; and polymers and oligomers having a perfluoroalkyl group in the side chain. A content thereof is preferably not greater than 3% by weight.

The coating liquid for the surface layer of the present invention can include a binder resin, provided smoothness, electrical properties or durability of a surface of the photoreceptor is not impaired. However, when a polymer material such as a binder resin is included in the coating liquid, the binder resin is insoluble with a polymer produced by a hardening reaction of the radical polymerizing compositions (the radical polymerizing monomer and the radical polymerizing compound having a charge transporting structure) and a phase separation appears, resulting in large concavities and convexities of the crosslinked surface layer. Therefore, it is preferable not to use the binder resin.

The coating liquid can include other components when the radical polymerizing compound or the radical polymerizing oligomer is a liquid, and is optionally diluted with a solvent and coated. Specific examples of the solvent include alcohols such as methanol, ethanol, propanol and butanol; ketones such as acetone, methyl ethyl ketone, methyl isobutyl ketone and cyclohexanone; esters such as ethyl acetate and butyl acetate; ethers such as tetrahydrofuran, dioxane and propylether; halogens such as dichloromethane, dichloroethane, trichloroethane and chlorobenzene; aromatics such as benzene, toluene and xylene; and Cellosoves such as methyl Cellosolve, ethyl Cellosolve and Cellosolve acetate. These solvents can be used alone or in combination. A dilution ratio with the solvent can optionally be decided upon solubility of the compositions, a coating method and a purposed layer thickness. The crosslinked surface layer can be coated by a dip coating method, a spray coating method, a bead coating method, a ring coating method, etc.

In the present invention, after the coating liquid is coated to form layer, an external energy is applied thereto for hardening the layer to form the crosslinked surface layer. The external energy includes a heat, a light and a radiation. A heat energy is applied to the layer from the coated side or from the substrate using air, a gaseous body such as nitrogen, a steam, a variety of heating media, infrared or an electromagnetic wave. The heating temperature is preferably from 100 to 170° C. When less than 100° C., the reaction is slow in speed and is not completely finished. When greater than 170° C., the reaction nonuniformly proceeds and a large distortion appears in the crosslinked surface layer. To uniformly proceed the hardening reaction, after heated at comparatively a low temperature less than 100° C., the reaction is effectively completed at not less than 100° C. Specific examples of the light energy include UV irradiators such as high pressure mercury lamps and metal halide lamps having an emission wavelength of UV light; and a visible light source adaptable to absorption wavelength of the radical polymerizing compounds and photopolymerization initiators. An irradiation light amount is preferably from 50 to 1,000 mW/cm$^2$. When less than 50 mW/cm$^2$, the hardening reaction takes time. When greater than 1,000 mW/cm$^2$, the reaction nonuniformly proceeds and the crosslinked surface layer has a large surface roughness. The radiation energy includes a radiation energy using an electron beam. Among these energies, the heat and light energies are effectively used because of their simple reaction speed controls and simple apparatuses.

The crosslinked surface layer of the present invention has an elasticity power not less than 41%.

Figure 1B:
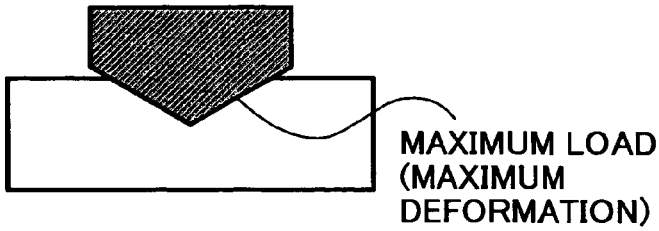
Figure 1C:
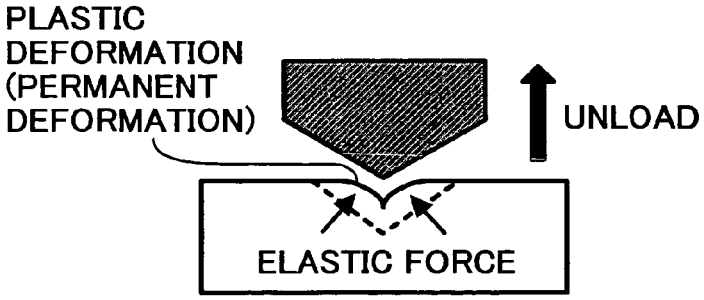
Figure 2:
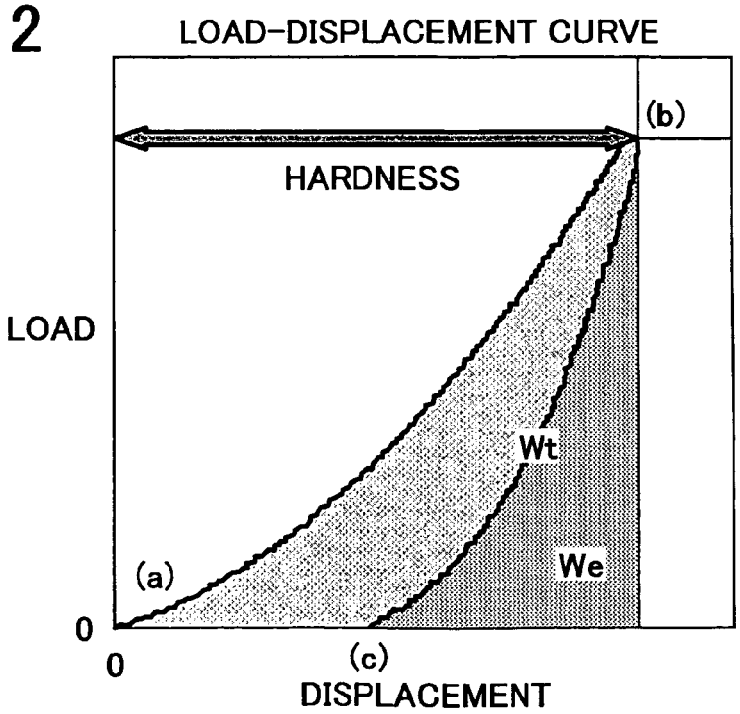
FIG. 2 is a diagram showing a pressing depth and load curve of the indenter of the microscopic hardness meter for measuring an elasticity power of the present invention.

The elasticity power of the present invention is measured by a load-unload test of a microscopic surface hardness meter using a diamond indenter. As shown in FIG. 1, from a point (a) wherein the indenter contacts a sample, the indenter is pressed into the sample at a constant loading speed (loading process), rested for a specified time at a maximum displacement (b) when the indenter receives a predetermined load, pulled up at a constant unloading speed (unloading process) and a point where the indenter receives no load is a plastic displacement (c). A curve of the pressed depth and the load is recorded as shown in FIG. 2, and the elasticity power is a ratio of an elastic deformation workload to a total workload of the indenter performed on the surface layer as follows:

Elasticity power (%)=
elastic deformation workload×100/(plastic deformation workload+elastic deformation workload)

A universal hardness can be determined by a displacement of the indenter receiving a maximum load, and the crosslinked surface layer preferably has a universal hardness not less than 200 N/mm$^2$ in terms of its abrasion resistance.

The elasticity power is measured at a predetermined temperature and a predetermined humidity, and is measured at 22° C. and at 55% relative humidity in the present invention.

In the present invention, the elasticity power is measured by H-100 from Fischer Instruments K. K. using a Vickers indenter at a predetermined load of 9.8 mN. However, any apparatus having similar performance can be used. A photoreceptor having a photosensitive layer including the crosslinked surface layer on an aluminum cylinder was used as a sample. Since the elasticity power is influenced by spring characteristics of a substrate, the substrate is preferably a rigid metal plate or a slide glass. Further, since the elasticity power is also influenced by the hardness and elasticity of an under layer of the crosslinked surface layer, such as a charge transport layer and a charge generation layer, a specified load was controlled such that the maximum displacement is 1/10 of the thickness of the crosslinked surface layer. Only the crosslinked surface layer is not preferably formed on the substrate because the crosslinked surface layer is not always reproduced precisely in a relation with the under layer. The elasticity power is influenced by (1) constituents and their rates of content in a crosslinked surface layer coating liquid, (2) a solvent for diluting the coating liquid and a concentration of solid contents therein, (3) a coating method, (4) a hardening method and conditions and (5) solubility of the under layer. When a large amount of an inactive binder resin and a radical polymerizing compound having few functional groups are mixed in the coating liquid, and when the crosslinked density is not sufficient due to a shortage of an outer energy in forming the crosslinked film, the elasticity power becomes 41% or less.

Since the crosslinked surface layer of the present invention has a different thickness depending on a layer structure of a photoreceptor using the crosslinked surface layer, the thickness will be explained according to the following explanations of the layer structures.

The electrophotographic photoreceptor for use in the present invention will be explained, referring to the drawings.

Figure 3A:
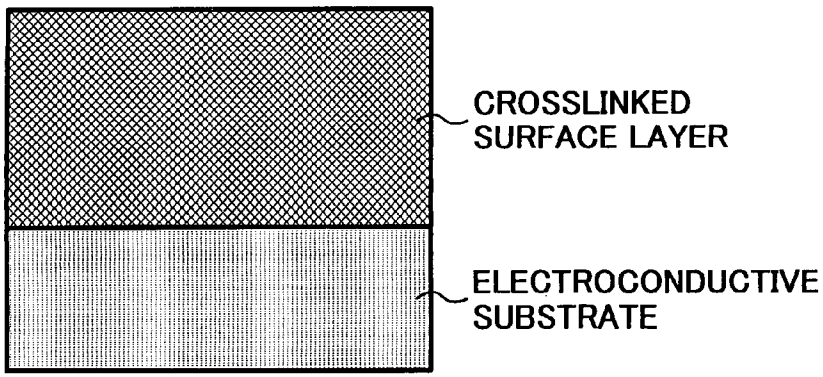
FIG. 3 is a schematic view illustrating a cross-section of an embodiment of the electrophotographic photoreceptor of the present invention.
Figure 3B:
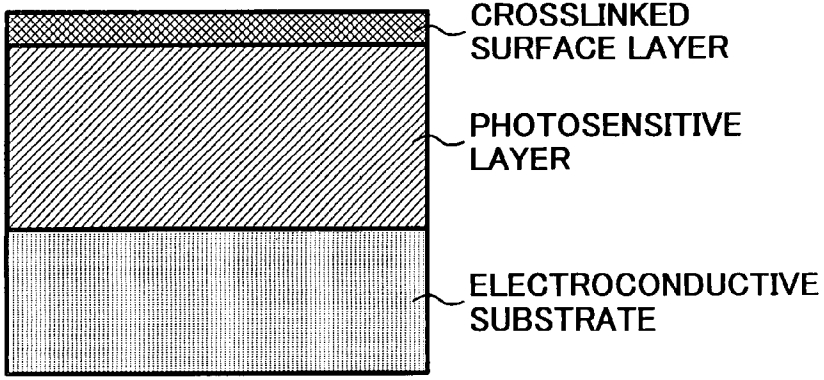

FIG. 3A and FIG. 3B are cross-sectional views of embodiments of layers of the electrophotographic photoreceptor of the present invention, which is a single-layered photoreceptor formed of a photosensitive layer having both a charge generation function and charge transport function and overlying an electroconductive substrate. In FIG. 3A, the photosensitive layer is wholly crosslinked and hardened to form a crosslinked surface layer. In FIG. 3B, a crosslinked surface layer is formed on a surface of the photosensitive layer.

Figure 4A:
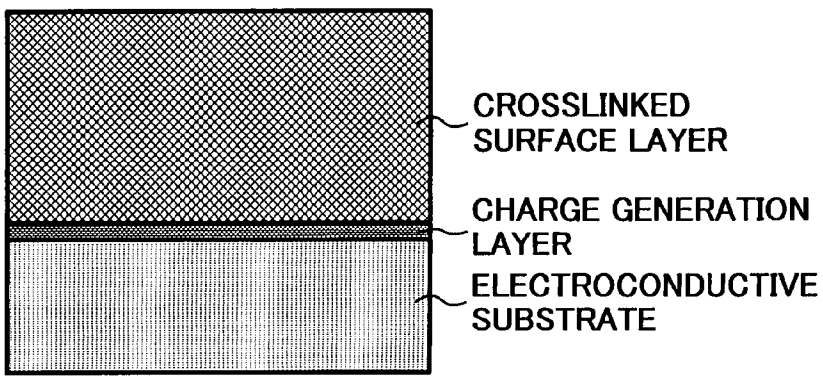
FIG. 4 is a schematic view illustrating a cross-section of another embodiment of the electrophotographic photoreceptor of the present invention.
Figure 4B:
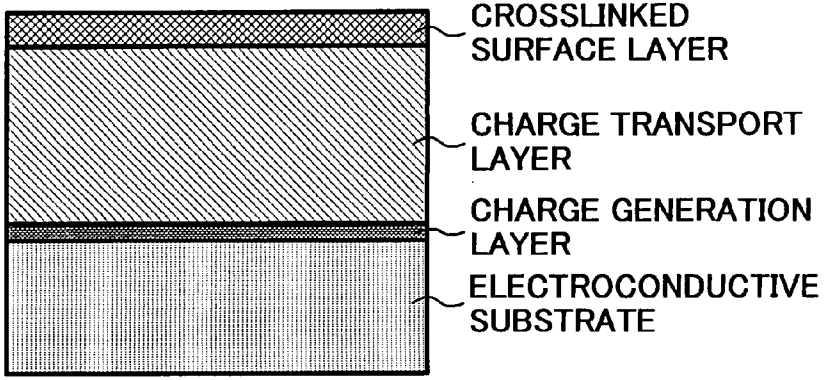

FIG. 4A and FIG. 4B are cross-sectional views of other embodiments of layers of the electrophotographic photoreceptor of the present invention, which is a multilayered photoreceptor formed of a charge generation layer having a charge generation function and a charge transport layer having a charge transport function, and which are overlying an electroconductive substrate. In FIG. 4A, the charge transport layer is wholly crosslinked and hardened to form a crosslinked surface layer. In FIG. 4B, a crosslinked surface layer is formed on a surface of the charge transport layer.

Suitable materials for use as the electroconductive substrate include materials having a volume resistance not greater than $10^{10}\Omega\cdot$cm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is deposited or sputtered. In addition, a plate of a metal such as aluminum, aluminum alloys, nickel and stainless steel and a metal cylinder, which is prepared by tubing a metal such as the metals mentioned above by a method such as impact ironing or direct ironing, and then treating the surface of the tube by cutting, super finishing, polishing and the like treatments, can also be used as the substrate. Further, endless belts of a metal such as nickel and stainless steel, which have been disclosed in Japanese Laid-Open Patent Publication No. 52-36016, can also be used as the substrate.

Furthermore, substrates, in which a coating liquid including a binder resin and an electroconductive powder is coated on the supporters mentioned above, can be used as the substrate.

Specific examples of such an electroconductive powder include carbon black, acetylene black, powders of metals such as aluminum, nickel, iron, Nichrome, copper, zinc, silver and the like, and metal oxides such as electroconductive tin oxides, ITO and the like. Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like resins. Such an electroconductive layer can be formed by coating a coating liquid in which an electroconductive powder and a binder resin are dispersed in a solvent such as tetrahydrofuran, dichloromethane, methyl ethyl ketone, toluene and the like solvent, and then drying the coated liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and TEFLON (registered trademark), with an electroconductive material, can also be preferably used as the substrate.

Next, the photosensitive layer will be explained. The photosensitive layer may be a single-layered or a multilayered. The multilayered photosensitive layer is formed of a charge generation layer having a charge generation function and a charge transport layer having a charge transport function. The single-layered photosensitive layer is a layer having both the charge generation function and charge transport function.

Hereinafter, the multilayered photosensitive layer and single-layered photosensitive layer will be explained respectively.

The charge transport layer (CGL) is mainly formed of a charge generation material, and optionally includes a binder resin. Suitable charge generation materials include inorganic materials and organic materials.

Specific examples of the inorganic charge generation materials include crystalline selenium, amorphous selenium, selenium-tellurium alloys, selenium-tellurium-halogen alloys and selenium-arsenic alloys.

Specific examples of the organic charge generation materials include known materials, for example, phthalocyanine pigments such as metal phthalocyanine and metal-free phthalocyanine, azulenium pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having a distyryloxadiazole skeleton, azo pigments having a distyrylcarbazole skeleton, perylene pigments, anthraquinone pigments, polycyclic quinone pigments, quinoneimine pigments, diphenyl methane pigments, triphenyl methane pigments, benzoquinone pigments, naphthoquinone pigments, cyanine pigments, azomethine pigments, indigoid pigments, bisbenzimidazole pigments and the like materials. These charge transport materials can be used alone or in combination.

Specific examples of the binder resin optionally used in the CGL include polyamide resins, polyurethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinylcarbazole resins, polyacrylamide resins, and the like resins. These resins can be used alone or in combination. In addition, a charge transport polymer material can also be used as the binder resin in the CGL besides the above-mentioned binder resins. Specific examples thereof include polymer materials such as polycarbonate resins, polyester resins, polyurethane resins, polyether resins, polysiloxane resins and acrylic resins having an arylamine skeleton, a benzidine skeleton, a hydrazone skeleton, a carbazole skeleton, a stilbene skeleton, a pyrazoline skeleton, etc.; and polymer materials having polysilane skeleton.

Specific examples of the former polymer materials include charge transport polymer materials disclosed in Japanese Laid-Open Patent Publications Nos. 01-001728, 01-009964, 01-013061, 01-019049, 01-241559, 04-011627, 04-175337, 04-183719, 04-225014, 04-230767, 04-320420, 05-232727, 05-310904, 06-234838, 06-234839, 06-234840, 06-234839, 06-234840, 06-234841, 06-236051, 06-295077, 07-056374, 08-176293, 08-208820, 08-211640, 08-253568, 08-269183, 09-062019, 09-043883, 09-71642, 09-87376, 09-104746, 09-110974, 09-110976, 09-157378, 09-221544, 09-227669, 09-235367, 09-241369, 09-268226, 09-272735, 09-302084, 09-302085, 09-328539, etc.

Specific examples of the latter polymer materials include polysilylene polymers disclosed in Japanese Laid-Open Patent Publications Nos. 63-285552, 05-19497, 05-70595, 10-73944, etc.

The CGL also can include a low-molecular-weight charge transport material.

The low-molecular-weight charge transport materials include positive hole transport materials and electron transport materials.

Specific examples of the electron transport materials include electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-b]thiophene-4-one, 1,3,7-trinitrobenzothiophene-5,5-dioxide, diphenoquinone derivatives, etc. These electron transport materials can be used alone or in combination.

Specific examples of the positive hole transport materials include electron donating materials such as oxazole derivatives, oxadiazole derivatives, imidazole derivatives, monoarylamines derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, enamine derivatives, and other known materials. These positive hole transport materials can be used alone or in combination.

Suitable methods for forming the charge generation layer are broadly classified into a vacuum thin film forming method and a solvent dispersion casting method.

Specific examples of the former vacuum thin film forming method include a vacuum evaporation method, a glow discharge decomposition method, an ion plating method, a sputtering method, a reaction sputtering method, CVD (chemical vapor deposition) methods, etc. A layer of the above-mentioned inorganic and organic materials can be formed by these methods.

The casting method for forming the charge generation layer typically includes the following steps:

(1) preparing a coating liquid by mixing one or more inorganic or organic charge generation materials mentioned above with a solvent such as tetrahydrofuran, dioxane, dioxolan, toluene, dichloromethane, monochlorobenzene, dichloroethane, cyclohexanone, cyclopentanone, anisole, xylene, methyl ethyl ketone, acetone, ethyl acetate, butyl acetate, etc., optionally with a binder resin and a leveling agent such as a dimethylsilicone oil and methylphenyl silicone oil, and then dispersing the materials with a ball mill, an attritor, a sand mill, beads mill, etc. to prepare a CGL coating liquid;

(2) coating the CGL coating liquid, which is diluted if necessary, on a substrate by a method such as dip coating, spray coating, bead coating and ring coating; and (3) drying the coated liquid to form a CGL.

The thickness of the CGL is preferably from about 0.01 to about 5 μm, and more preferably from about 0.05 to about 2 μm.

The charge transport layer (CTL) is a layer having a charge transportability, and the crosslinked surface layer of the present invention is effectively used as a CTL. When the crosslinked surface layer is a whole CTL, as mentioned above, after a coating liquid including the radical polymerizing monomer having three or more functional groups without a charge transporting structure; radical polymerizing compound having one functional group with a charge transporting structure; and reactive silicone compound having a radical polymerizing functional group (hereinafter referred to as the radical polymerizing compositions) of the present invention is coated on the CGL and is optionally dried to form a coated layer thereon, and an external energy is applied thereto to harden the coated layer to form the crosslinked surface layer. The crosslinked surface layer preferably has a thickness of from 10 to 30 μm, and more preferably from 10 to 25 μm. When thinner than 10 μm, a sufficient charged potential cannot be maintained. When thicker than 30 μm, a contraction in volume thereof when hardened tends to cause a separation thereof from a lower layer.

When the crosslinked surface layer is formed on a surface of the CTL, the CTL is formed by coating a CGL with a coating liquid wherein a charge transport material having a charge transportability and a binder resin are dispersed in a proper solvent to form a coated layer thereon, and drying the coated layer. The crosslinked surface layer is formed by coating the CGL with a coating liquid including the above-mentioned radical polymerizing compositions of the present invention to form a coated layer thereon, and crosslinking and hardening the coated layer with an external energy.

Specific examples of the charge transport materials include electron transport materials, positive hole transport materials and charge transport polymer materials used in the CGL. Particularly, the charge transport polymer materials are effectively used to reduce a solution of a lower layer when a surface layer is coated thereon.

Specific examples of the binder resins include thermoplastic or thermosetting resins such as polystyrene, styrene-acrylonitrile copolymers, styrene-butadiene copolymers, styrene-maleic anhydride copolymers, polyester, polyvinylchloride, vinylchloride-vinylacetate copolymers, polyvinylacetate, polyviinylidenechloride, polyarylate resins, phenoxy resins, polycarbonate, cellulose acetate resins, ethylcellulose resins, polyvinylbutyral, polyvinylformal, polyvinyltoluene, poly-N-vinylcarbazole, acrylic resins, silicone resins, epoxy resins, melamine resins, urethane resins, phenol resins and alkyd resins.

The CTL preferably include the charge transport material in an amount of from 20 to 300 parts by weight, and more preferably from 40 to 150 parts by weight per 100 parts by weight of the binder resin. However, the charge transport polymer material can be used alone or in combination with the binder resin.

Specific examples of a solvent used for coating the CTL include the solvents used for coating the CGL, and particularly the solvents solving the charge transport material and binder resin well are preferably used. These solvents can be used alone or in combination. The CTL can be formed by the same coating methods used for coating the CGL.

The CTL may optionally include a plasticizer and a leveling agent.

Specific examples of the plasticizers include plasticizers for typical resins, such as dibutylphthalate and dioctylphthalate, and a content thereof is preferably from 0 to 30 parts by weight per 100 parts by weight of the binder resin.

Specific examples of the leveling agents include silicone oil such as dimethyl silicone oil and methylphenyl silicone oil; and polymers or oligomers having a perfluoroalkyl group in the side chain, and a content thereof is preferably from 0 to 1 part by weight per 100 parts by weight of the binder resin.

The CTL preferably has a thickness of from 5 to 40 μm, and more preferably from 10 to 30 μm.

When the crosslinked surface layer overlies the CTL, as mentioned in the method of forming a crosslinked surface layer, a coating liquid including the radical polymerizing compositions of the present invention is coated on the CTL and optionally dried to form a coated layer thereon, and an external energy is applied thereto to harden the coated layer to form the crosslinked surface layer thereon. The crosslinked surface layer preferably has a thickness of from 1 to 20 μm, and more preferably from 2 to 10 μm. When thinner than 1 μm, uneven thickness thereof causes uneven durability thereof. When thicker than 20 μm, a total thickness of the CTL and crosslinked surface layer is so thick that charges are scattered, resulting in deterioration of image reproducibility of the resultant photoreceptor.

The single-layered photosensitive layer has both a charge generation function and a charge transport function, and the crosslinked surface layer having a charge transporting structure and including a charge generation material having a charge generating function of the present invention is effectively used as a single-layered photosensitive layer. As mentioned in the casting method of forming the CGL, a charge generation material is dispersed in a coating liquid including the radical polymerizing compositions, and the coating liquid is coated on an electroconductive substrate and optionally dried to form a coated layer thereon, then a hardening reaction is performed in the coated layer with an external energy to form the crosslinked surface layer. The charge generation material may previously be dispersed in a solvent to prepare a dispersion, and the dispersion may be added into the coating liquid for forming the crosslinked surface layer. The crosslinked surface layer preferably has a thickness of from 10 to 30 μm, and more preferably from 10 to 25 μm. When thinner than 10 μm, a sufficient charged potential cannot be maintained. When thicker than 30 μm, a contraction in volume thereof when hardened tends to cause a separation thereof from an undercoat layer.

When the crosslinked surface layer overlies a single-layered photosensitive layer, the photosensitive layer can be formed by coating and drying a liquid wherein a charge generation material having a charge generation function, a charge transport material having a charge transport function and a binder resin are dispersed or dissolved in a proper solvent. The photosensitive layer may optionally includes an additive such as plasticizers and leveling agents. The methods of dispersing a charge generation material, charge generation materials, charge transport materials, plasticizers and leveling agents mentioned in the above CGL and CTL can be used. Besides the binder resins mentioned in the above CTL, the binder resins in the above CGL can be mixed therewith. In addition, the above-mentioned charge transport polymer material can effectively be used to prevent components of the lower photosensitive layer from mixing in the crosslinked surface layer. The photosensitive layer preferably has a thickness of from 5 to 30 μm, and more preferably from 10 to 25 μm.

When the crosslinked surface layer overlies a single-layered photosensitive layer, as mentioned in the method of forming a crosslinked surface layer, a coating liquid including the radical polymerizing compositions of the present invention and a binder resin is coated on the photosensitive layer and optionally dried to form a coated layer thereon, and an external energy is applied thereto to harden the coated layer to form the crosslinked surface layer thereon. The crosslinked surface layer preferably has a thickness of from 1 to 20 μm, and more preferably from 2 to 10 μm. When thinner than 1 μm, uneven thickness thereof causes uneven durability thereof.

The single-layered photosensitive layer preferably includes a charge generation material in an amount of from 1 to 30% by weight, a binder resin of from 20 to 80% by weight and a charge transport material of from 10 to 70 parts by weight based on total weight thereof.

The photoreceptor of the present invention can have an intermediate layer between a crosslinked surface layer and a photosensitive layer when the crosslinked surface layer overlies the layer. The intermediate layer prevents components of the lower photosensitive layer from mixing in the crosslinked surface layer to avoid a hardening reaction inhibition and concavities and convexities thereof. In addition, the intermediate layer can improve the adhesiveness between the crosslinked surface layer and photosensitive layer.

The intermediate layer includes a resin as a main component. Specific examples of the resin include polyamides, alcohol-soluble nylons, water-soluble polyvinyl butyral, polyvinyl butyral, polyvinyl alcohol, etc. The intermediate layer can be formed by one of the above-mentioned known coating methods. The intermediate layer preferably has a thickness of from 0.05 to 2 μm.

The photoreceptor of the present invention may have an undercoat between the substrate and photosensitive layer. The undercoat layer includes a resin as a main component. Since a photosensitive layer is typically formed on the undercoat layer by coating a liquid including an organic solvent, the resin in the undercoat layer preferably has good resistance to general organic solvents. Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins, epoxy resins and the like. The undercoat layer may include a fine powder of metal oxides such as titanium oxide, silica, alumina, zirconium oxide, tin oxide and indium oxide to prevent occurrence of moiréin the recorded images and to decrease residual potential of the photoreceptor.

The undercoat layer can also be formed by coating a coating liquid using a proper solvent and a proper coating method similarly to those for use in formation of the photosensitive layer mentioned above. The undercoat layer may be formed using a silane coupling agent, titanium coupling agent or a chromium coupling agent. In addition, a layer of aluminum oxide which is formed by an anodic oxidation method and a layer of an organic compound such as polyparaxylylene (parylene) or an inorganic compound such as SiO, $SnO_2$, $TiO_2$, ITO or $CeO_2$ which is formed by a vacuum evaporation method is also preferably used as the undercoat layer. Besides these materials, known materials can be used. The thickness of the undercoat layer is preferably from 0 to 5 μm.

In the present invention, an antioxidant can be included in each of the layers, i.e., the crosslinked surface layer, charge generation layer, charge transport layer, undercoat layer and intermediate layer to improve the stability to withstand environmental conditions, namely to avoid decrease of photosensitivity and increase of residual potential.

Specific examples of the antioxidant for use in the present invention include the following compound.

(1) Phenolic Compounds 2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)b enzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, tocophenol compounds, etc.

(2) Paraphenylenediamine Compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, etc.

(3) Hydroquinone Compounds 2,5-di-t-octylhydroquinone, 2,6-didodecylhydroquinone, 2-dodecylhydroquinone, 2-dodecyl-5-chlorohydroquinone, 2-t -octyl-5-methylhydroquinone, 2-(2-octadecenyl)-5-methylhydroquinone, etc.

(4) Organic Sulfur-Containing Compounds

Dilauryl-3,3'-thiodipropionate, distearyl-3,3'-thiodipropionate, ditetradecyl-3,3'-thiodipropionate, etc.

(5) Organic Phosphorus-Containing Compounds

Triphenylphosphine, tri(nonylphenyl)phosphine, tri(dinonylphenyl)phosphine, tricresylphosphine, tri(2,4-dibutylphenoxy)phosphine, etc.

These compounds are known as antioxidants for rubbers, plastics, fats, etc., and marketed products thereof can easily be obtained.

Each of the layers preferably includes the antioxidant in an amount of from 0.01 to 10% by weight based on total weight thereof.

Next, the image forming method and image forming apparatus of the present invention will be explained in detail, referring to the drawings.

The image forming method and image forming apparatus of the present invention include a photoreceptor having a smooth transporting crosslinked surface layer having a low surface energy, wherein the photoreceptor is charged and irradiated with an imagewise light to form an electrostatic latent image thereon; the electrostatic latent image is developed to form a toner image; the toner image is transferred onto an image bearer (transfer sheet) and fixed thereon; and a surface of the photoreceptor is cleaned.

The process is not limited thereto in such a method as to directly transfer an electrostatic latent image onto a transfer sheet and develop the electrostatic latent image thereon.

Figure 5:
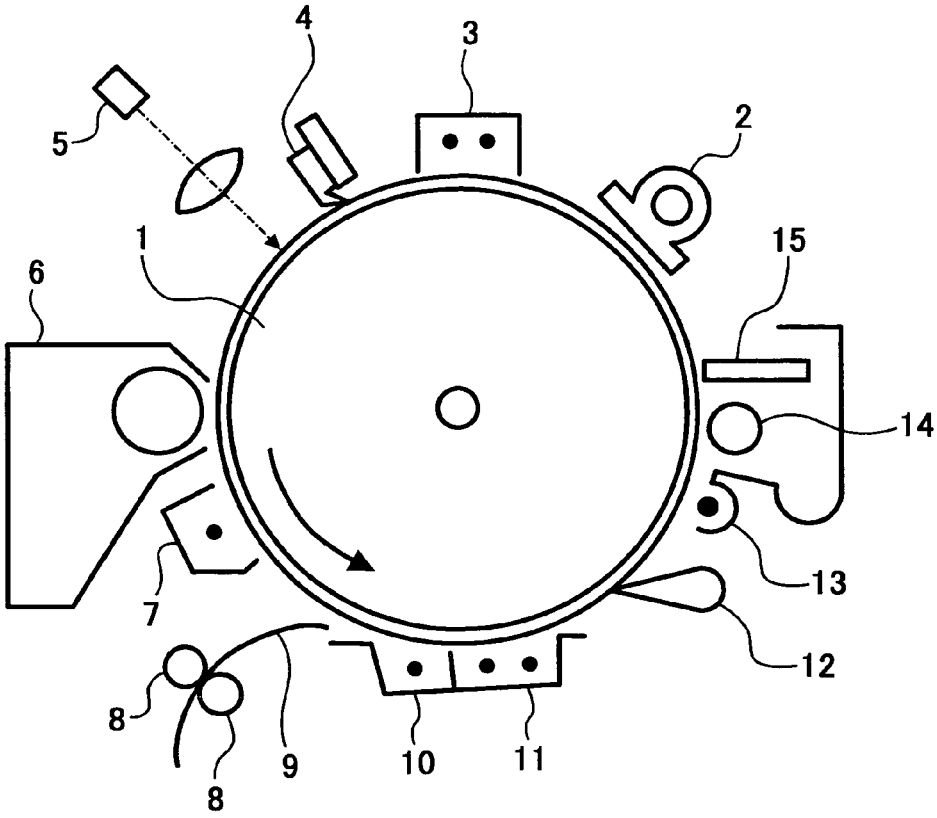
FIG. 5 is a schematic view illustrating an embodiment of the image forming apparatus of the present invention.

FIG. 5 is a schematic view illustrating a partial cross-section of an embodiment of the image forming apparatus of the present invention. A charger (3) is used to uniformly charge a photoreceptor (1). Specific examples of the charger include known chargers such as corotron devices, scorotron device, solid state chargers, needle electrode devices, roller charging devices and electroconductive brush devices.

Next, an imagewise irradiator (5) is used to form an electrostatic latent image on the photoreceptor (1). Suitable light sources thereof include typical light emitters such as fluorescent lamps, tungsten lamps, halogen lamps, mercury lamps, sodium lamps, light emitting diodes (LEDs), laser diodes (LDs), light sources using electroluminescence (EL), etc. In addition, to obtain light having a desired wave length range, filters such as sharp-cut filters, band pass filters, near-infrared cutting filters, dichroic filters, interference filters and color temperature converting filters can be used.

Next, a developing unit (6) is used to visualize an electrostatic latent image formed on the photoreceptor (1). The developing methods include a one-component developing method and a two-component developing method using a dry toner; and a wet developing method using a wet toner. When the photoreceptor positively or negatively charged is exposed to imagewise light, an electrostatic latent image having a positive or negative charge is formed on the photoreceptor. When the latent image having a positive charge is developed with a toner having a negative charge, a positive image can be obtained. In contrast, when the latent image having a positive charge is developed with a toner having a positive charge, a negative image can be obtained.

Next, a transfer charger (10) is used to transfer a toner image visualized on the photoreceptor onto a transfer sheet (9). A pre-transfer charger (7) may be used to perform the transfer better. Suitable transferers include a transferer charger, an electrostatic transferer using a bias roller, an adhesion transferer, a mechanical transferer using a pressure and a magnetic transferer. The above-mentioned chargers can be used for the electrostatic transferer.

Next, a separation charger (11) and a separation pick (12) are used to separate the transfer sheet (9) from the photoreceptor (1). Other separation means include an electrostatic absorption induction separator, a side-edge belt separator, a tip grip conveyor, a curvature separator, etc. The above-mentioned chargers can be used for the separation charger (11).

Next, a fur brush (14) and a cleaning blade (15) are used to remove a toner left on the photoreceptor after transferred therefrom. A pre-cleaning charger (13) may be used to perform the cleaning more effectively. Other cleaners include a web cleaner, a magnet brush cleaner, etc., and these cleaners can be used alone or in combination.

Next, a discharger is optionally used to remove a latent image in the photoreceptor. The discharger includes a discharge lamp (2) and a discharger, and the above-mentioned light sources and chargers can be used respectively.

Known means can be used for other an original reading process, a paper feeding process, a fixing process, a paper delivering process, etc.

Figure 6:
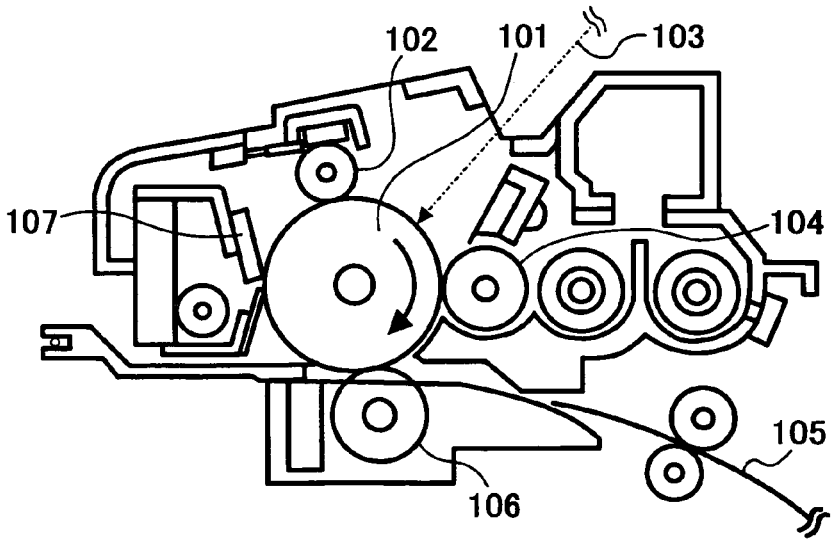
FIG. 6 is a schematic view illustrating an embodiment of the process cartridge of the present invention.

The above-mentioned image forming unit may be fixedly set in a copier, a facsimile or a printer. However, the image forming unit may be detachably set therein as a process cartridge. FIG. 6 is a schematic view illustrating a cross-section of an embodiment of the process cartridge for the image forming apparatus of the present invention.

The process cartridge means an image forming unit (or device) which includes a photoreceptor (101) and at least one of a charger (102), an image developer (104), a transferer (106), a cleaner (107) and a discharger (not shown).

While the photoreceptor (101) rotates in a direction indicated by an arrow, the photoreceptor (101) is charged by the charger (102) and irradiated by an irradiator (103) to form an electrostatic latent image relevant to imagewise light thereon. The electrostatic latent image is developed by the image developer (104) with a toner to form a form a toner image, and the toner image is transferred by the transferer (106) onto a transfer sheet (105) to be printed out. Next, a surface of the photoreceptor after the toner image is transferred is cleaned by the cleaner (107), discharged by a discharger (not shown) and these processes are repeated again.

As is apparent from the explanations mentioned above, the electrophotographic photoreceptor of the present invention can widely be used in electrophotography applied fields such as a laser beam printer, a CRT printer, a LED printer, a liquid crystal printer and a laser engraving.

The compound having a charge transporting structure of the present invention is synthesized by, e.g., a method disclosed in Japanese Patent No. 3164426. The following method is one of the examples thereof.

(1) Synthesis of a Hydroxy Group Substituted Triarylamine Compound Having the Following Formula B 113.85 g (0.3 mol) of a methoxy group substituted triarylamine compound having the formula A, 138 g (0.92 mol) of sodium iodide and 240 ml of sulfolane were mixed to prepare a mixture. The mixture was heated to have a temperature of 60° C. in a nitrogen stream.

A

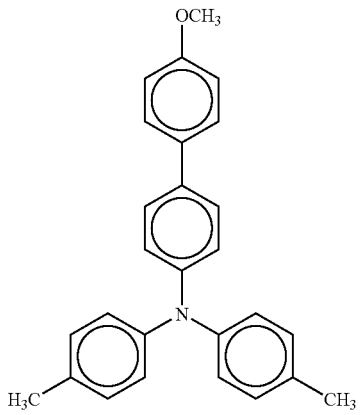

99 g (0.91 mol) of trimethylchlorosilane were dropped therein for 1 hr and the mixture was stirred for 4 hrs at about 60° C. About 1.5 L of toluene were added thereto and the mixture was cooled to have a room temperature, and repeatedly washed with water and an aqueous solution of sodium carbonate. Then, a solvent removed therefrom and refined by a column chromatographic process using silica gel as an absorption medium, and toluene and ethyl acetate (20-to-1) as a developing solvent. Cyclohexane was added to the thus prepared buff yellow oil to separate a crystal out. Thus, 88.1 g (yield of 80.4%) of a white crystal having the following formula B and a melting point of from 64.0 to 66.0° C. was prepared.

B

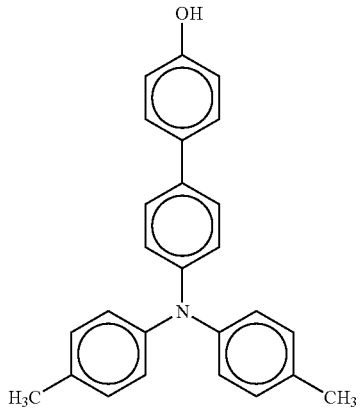

| | Elemental Analysis Value (%) | | |
|---|---|---|---|
| | C | H | N |
| Found value | 85.06 | 6.41 | 3.73 |
| Calculated value | 85.44 | 6.34 | 3.83 |

(2) A triarylamino Group Substituted Acrylate Compound (Compound No. 54 in Table 1)

82.9 g (0.227 mol) of the hydroxy group substituted triarylamine compound having the formula B prepared in (1) were dissolved in 400 ml of tetrahydrofuran to prepare a mixture, and an aqueous solution of sodium hydrate formed of 12.4 g of NaOH and 100 mil of water was dropped therein in a nitrogen stream. The mixture was cooled to have a temperature of 5° C., and 25.2 g (0.272 mol) of chloride acrylate was dropped therein for 40 min. Then, the mixture was stirred at 5° C. for 3 hrs. The mixture was put in water and extracted with toluene. The extracted liquid was repeatedly washed with water and an aqueous solution of sodium carbonate. Then, a solvent removed therefrom and refined by a column chromatographic process using silica gel as an absorption medium and toluene as a developing solvent. N-hexane was added to the thus prepared colorless oil to separate a crystal out. Thus, 80.73 g (yield of 84.8%) of a white crystal of the compound No. 54 having a melting point of from 117.5 to 119.0° C. was prepared.

| | Elemental Analysis Value (%) | | |
|---|---|---|---|
| | C | H | N |
| Found value | 83.13 | 6.01 | 3.16 |
| Calculated value | 83.02 | 6.00 | 3.33 |

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

An undercoat coating liquid, a charge generation coating liquid and charge transport coating liquid, which have the following formulations, were coated in this order on an aluminum cylinder by a dip coating method and dried to prepare a photoreceptor 1 having an undercoat layer of 3.5 μm thick, a CGL of 0.2 μm thick, a CTL of 23 μm thick.

| Undercoat layer coating liquid | |
|---|---|
| Alkyd resin (BEKKOZOL 1307-60-EL from Dainippon Ink & Chemicals, Inc.) | 6 |
| Melamine resin (SUPER BEKKAMIN G-821-60 from Dainippon Ink & Chemicals, Inc.) | 4 |
| Titanium dioxide powder | 40 |
| Methyl ethyl ketone | 50 |
| CGL coating liquid | |
| Bisazo pigment having the following formula: | 2.5 |

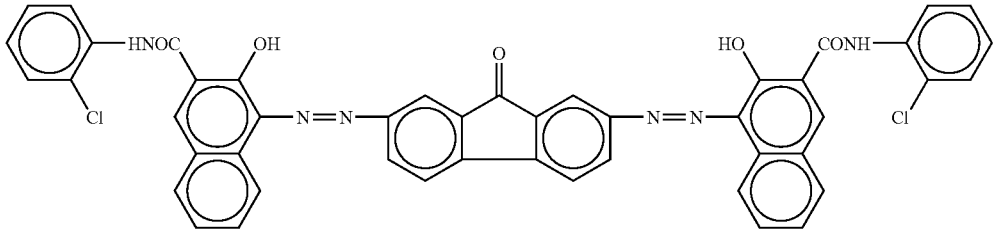

| | |
|---|---|
| Polyvinyl butyral (XYHL from Union Carbide Corp.) | 0.5 |
| Cyclohexanone | 200 |
| Methyl ethyl ketone | 80 |
| CTL coating liquid | |
| Bisphenol Z-type Polycarbonate | 10 |
| Charge transport material having the following formula: | 7 |

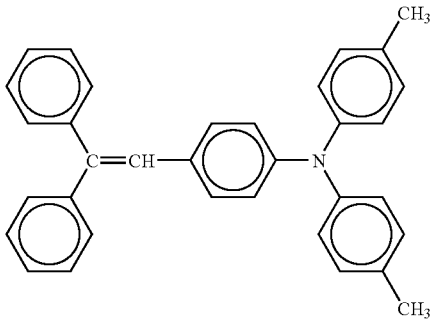

| | |
|---|---|
| Tetrahydrofuran | 100 |
| 1% tetrahydrofuran solution of silicone oil (KF50-100CS from Shin-Etsu Chemical Industry Co., Ltd.) | 1 |

The CTL was further coated with a crosslinked surface layer coating liquid having the following formulation by a spray coating method.

| Crosslinked surface layer coating liquid | |
|---|---|
| Urethane oligomer having a radical polymerizing functional group (KAYARAD DPHA-40H from NIPPON KAYAKU CO., LTD., having a viscosity of 40,000 ± 10,000 Pa · s) | 95 |
| Radical polymerizing compound having one functional group with a charge transporting structure (Compound No. 54) | 95 |
| Photo polymerization initiator (1-hydroxy-cyclohexyl-phenyl-ketone IRGACURE 184 from CIBA SPECIALTY CHEMICALS) | 10 |
| Tetrahydrofuran | 1,200 |

The coated layer was irradiated with a metal halide lamp at an irradiation intensity of 500 mW/cm$^2$ for 40 sec, and further dried at 130° C. for 30 min to form a crosslinked surface layer having a thickness of 5.0 μm. Thus, an electrophotographic photoreceptor was prepared.

Example 2

The procedure for preparation of the electrophotographic photoreceptor in Example 1 was repeated to prepare an electrophotographic photoreceptor except for changing the urethane oligomer having a radical polymerizing functional group included in the crosslinked surface layer coating liquid to the following one:

| | |
|---|---|
| KAYARAD UX-8101<br>from NIPPON KAYAKU CO., LTD., having a viscosity of 20,000 ± 10,000 Pa · s) | 80 |

Example 3

The procedure for preparation of the electrophotographic photoreceptor in Example 1 was repeated to prepare an electrophotographic photoreceptor except for changing the urethane oligomer having a radical polymerizing functional group included in the crosslinked surface layer coating liquid to the following one:

| | |
|---|---|
| U-15HA<br>from Shin-nakamura Chemical Corporation,<br>having a viscosity of 45,000 mPa · s | 120 |

Example 4

The procedure for preparation of the electrophotographic photoreceptor in Example 1 was repeated to prepare an electrophotographic photoreceptor except for changing the crosslinked surface layer coating liquid to the following one:

| Crosslinked surface layer coating liquid | |
|---|---|
| Urethane oligomer having a radical polymerizing functional group<br>(KAYARAD DPHA-40H from NIPPON KAYAKU CO., LTD.) | 47.5 |
| Trimethylolpropanetriacrylate<br>(TMPTA from Tokyo Kasei Kogyo Co., Ltd.) | 47.5 |
| 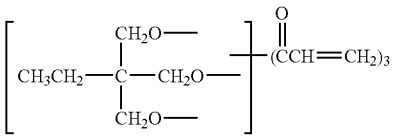 | |
| Radical polymerizing compound having one functional group with a charge transporting structure<br>(Compound No. 54) | 95 |
| Photo polymerization initiator<br>(1-hydroxy-cyclohexyl-phenyl-ketone<br>IRGACURE 184 from CIBA SPECIALTY CHEMICALS) | 10 |
| Tetrahydrofuran | 1,200 |

Example 5

The procedure for preparation of the electrophotographic photoreceptor in Example 4 was repeated to prepare an electrophotographic photoreceptor except for changing the urethane oligomer having a radical polymerizing functional group included in the crosslinked surface layer coating liquid to the following one:

U-15HA from Shin-nakamura Chemical Corporation

Example 6

The procedure for preparation of the electrophotographic photoreceptor in Example 4 was repeated to prepare an electrophotographic photoreceptor except for changing the urethane oligomer having a radical polymerizing functional group included in the crosslinked surface layer coating liquid to the following one:

U-6HA from Shin-nakamura Chemical Corporation

Example 7

The procedure for preparation of the electrophotographic photoreceptor in Example 1 was repeated to prepare an electrophotographic photoreceptor except for changing the radical polymerizing compound having one functional group with a charge transporting structure to the compound No. 16.

Example 8

The procedure for preparation of the electrophotographic photoreceptor in Example 1 was repeated to prepare an electrophotographic photoreceptor except for changing the radical polymerizing compound having one functional group with a charge transporting structure to the compound No. 24.

Example 9

The procedure for preparation of the electrophotographic photoreceptor in Example 1 was repeated to prepare an electrophotographic photoreceptor except for changing the crosslinked surface layer coating liquid to the following one:

| | |
|---|---|
| Urethane oligomer having<br>a radical polymerizing functional group<br>(KAYARAD DPHA-40H from NIPPON KAYAKU CO., LTD.,<br>having a viscosity of 40,000 ± 10,000 Pa · s) | 90 |
| Radical polymerizing compound<br>having one functional group with<br>a charge transporting structure<br>(Compound No. 54) | 90 |
| Photo polymerization initiator<br>(1-hydroxy-cyclohexyl-phenyl-ketone<br>IRGACURE 184 from CIBA SPECIALTY CHEMICALS) | 20 |
| Tetrahydrofuran | 90 |
| Particulate filler<br>(Alumina filler AA-03<br>from Sumitomo Chemical Co., Ltd.) | 20 |

Comparative Example 1

The procedure for preparation of the electrophotographic photoreceptor in Example 1 was repeated to prepare an electrophotographic photoreceptor except for excluding the urethane oligomer having a radical polymerizing functional group reactive silicone compound having a radical polymerizing functional group.

Comparative Example 2

The procedure for preparation of the electrophotographic photoreceptor in Example 1 was repeated to prepare an electrophotographic photoreceptor except for changing the urethane oligomer having a radical polymerizing functional group included in the crosslinked surface layer coating liquid to the following one:

| | |
|---|---|
| Radical polymerizing monomer having the following formula without a charge transporting structure | 95 |

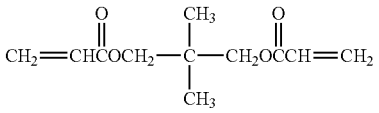

(Bifunctional acrylate KAYARAD NPGDA from NIPPON KAYAKU CO., LTD., having a molecular weight (Mw) of 212, 2 functional groups (Fg) and a ratio (Mw/Fg) of 106)

Comparative Example 3

The procedure for preparation of the electrophotographic photoreceptor in Example 1 was repeated to prepare an electrophotographic photoreceptor except for excluding the radical polymerizing compound having one functional group with a charge transporting structure.

Comparative Example 4

The procedure for preparation of the electrophotographic photoreceptor in Example 1 was repeated to prepare an electrophotographic photoreceptor except for changing the radical polymerizing compound having one functional group with a charge transporting structure included in the crosslinked surface layer coating liquid to the following material:

| | |
|---|---|
| Radical polymerizing compound with a charge transporting structure, having the following formula | 95 |

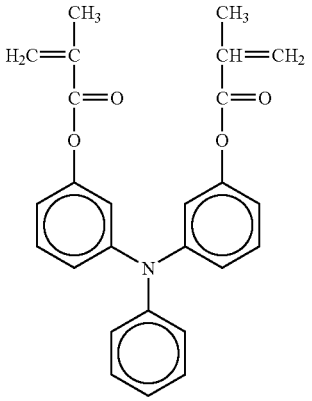

Comparative Example 5

The procedure for preparation of the electrophotographic photoreceptor in Example 1 was repeated to prepare an electrophotographic photoreceptor except for changing the radical polymerizing compound having one functional group with a charge transporting structure included in the crosslinked surface layer coating liquid to the following material:

| | |
|---|---|
| Charge transport material having the following formula: | 10 |

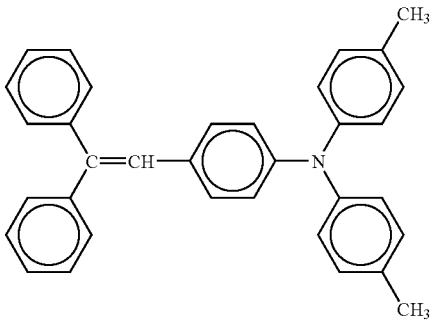

Comparative Example 6

The procedure for preparation of the electrophotographic photoreceptor in Example 1 was repeated to prepare an electrophotographic photoreceptor except for excluding the crosslinked surface layer and forming the CTL having a thickness of 28 μm.

Comparative Example 7

The procedure for preparation of the electrophotographic photoreceptor in Example 1 was repeated to prepare an electrophotographic photoreceptor except for changing the urethane oligomer having a radical polymerizing functional group included in the crosslinked surface layer coating liquid to the following one:

| | |
|---|---|
| Epoxy oligomer having a radical polymerizing functional group KAYARAD EAM-2160 from NIPPON KAYAKU CO., LTD. | 95 |

Comparative Example 8

The procedure for preparation of the electrophotographic photoreceptor in Example 1 was repeated to prepare an electrophotographic photoreceptor except for irradiating the coated layer with a metal halide lamp for 10 sec instead of 40 sec.

Each of the thus prepared electrophotographic photoreceptors was installed in a process cartridge, and the process cartridge was installed in a modified imagio MF2200 using a DC contact charging roller and a LD having a wavelength of 655 nm as a imagewise light source from Ricoh Company, Ltd. After dark space potential thereof was set at 700 (−V), 50,000 images were continuously produced to evaluate an abrasion resistance and a potential of the photoreceptor, and image quality. The evaluation results are shown in Table 3. Further, the surface of each photoreceptor in Examples 1 to 9 and Comparative Examples 2, 4, 6 and 8 was evaluated. The elasticity power and universal harness were measured with H-100 from Fischer Instruments K.K., and ten points average roughness (Rz) was measured by surface roughness measurer SURFCOM 1400D from TOKYO SEIMITSU CO., LTD. The results are shown in Table 4. Further, as for each of Examples 1, 3, 4 and 8 and Comparative Examples 2, 4, and 5, a crack promotion test was performed. A finger grease was adhered to the surface of the photoreceptor, and after left at 50° C. under a normal pressure for 3 days, the surface thereof was observed. The results are shown in Table 5.

TABLE 3

| | Abraded amount (μm) | Inner Potential Initial Dark | Inner Potential Initial Bright | Inner Potential After 50,000 Dark | Inner Potential After 50,000 Bright | Image evaluation |
|---|---|---|---|---|---|---|
| Example 1 | 0.96 | 700 | 95 | 700 | 95 | Good |
| Example 2 | 0.99 | 695 | 90 | 695 | 95 | Good |
| Example 3 | 0.97 | 700 | 95 | 700 | 95 | Good |
| Example 4 | 1.00 | 700 | 85 | 700 | 90 | Good |
| Example 5 | 1.01 | 700 | 85 | 700 | 85 | Good |
| Example 6 | 1.03 | 700 | 85 | 700 | 90 | Good |
| Example 7 | 0.97 | 700 | 95 | 700 | 100 | Good |
| Example 8 | 0.96 | 695 | 90 | 665 | 95 | Good |
| Example 9 | 0.90 | 700 | 110 | 700 | 125 | Good |
| Comparative Example 1 | A crosslinked layer was not formed | | | | | |
| Comparative Example 2 | 2.44 | 695 | 105 | 695 | 125 | Image density slightly lowered |
| Comparative Example 3 | — | 685 | 350 | Not performed | | |
| Comparative Example 4 | 2.44 | 69 | 110 | 690 | 115 | Image density slightly lowered |
| Comparative Example 5 | 3.01 | 690 | 85 | 685 | 95 | Image density slightly lowered |
| Comparative Example 6 | 6.05 | 700 | 45 | 655 | 50 | Image density slightly lowered |
| Comparative Example 7 | — | 700 | 370 | Not performed | | |
| Comparative Example 8 | 5.45 | 700 | 80 | 650 | 75 | Image density slightly lowered |

TABLE 4

| | Elastic power (%) | Universal hardness ($N/mm^2$) | Rz (μm) |
|---|---|---|---|
| Example 1 | 49.8 | 218.3 | 0.31 |
| Example 2 | 48.8 | 219.0 | 0.32 |
| Example 3 | 50.1 | 220.9 | 0.34 |
| Example 4 | 47.6 | 205.5 | 0.32 |
| Example 5 | 47.5 | 204.5 | 0.33 |
| Example 6 | 46.6 | 203.8 | 0.31 |

TABLE 4-continued

| | Elastic power (%) | Universal hardness ($N/mm^2$) | Rz (μm) |
|---|---|---|---|
| Example 7 | 49.7 | 216.5 | 0.32 |
| Example 8 | 49.5 | 215.8 | 0.32 |
| Example 9 | 51.8 | 228.4 | 0.36 |
| Comparative Example 2 | 39.3 | 188.7 | 0.35 |
| Comparative Example 4 | 49.9 | 223.6 | 0.53 |
| Comparative Example 6 | 39.4 | 189.3 | 0.25 |
| Comparative Example 8 | 32.7 | 161.6 | 0.28 |

TABLE 5

| | Initial | After 3 days |
|---|---|---|
| Example 1 | Glossy surface | Glossy surface |
| Example 3 | Glossy surface | Glossy surface |
| Example 4 | Glossy surface | Glossy surface |
| Example 8 | Glossy surface | Glossy surface |
| Comparative Example 2 | Not glossy, dimpled | Cracked |
| Comparative Example 4 | Not glossy | Cracked |
| Comparative Example 5 | Glossy surface | Cracked |

As is apparent from the results shown in Table 3, the electrophotographic photoreceptor having a crosslinked surface layer including a urethane oligomer having a radical polymerizing functional group; and a radical polymerizing compound having at least one radical polymerizing functional group and a charge transporting structure, and having an elasticity power not less than 41% has a noticeably improved abrasion resistance, stable electrical properties and can produce high quality images for long periods. However, the photoreceptors of Comparative Examples neither have improved abrasion resistance nor produce high quality images for long periods. Table 4 shows that the photoreceptor of the present invention has a high hardness and a surface smoothness. Table 5 shows that the photoreceptor of the present invention has no crack, which proves that a compound having a charge transport structure is uniformly included in the crosslinked surface layer.

Example 10

An undercoat coating liquid, a charge generation coating liquid and charge transport coating liquid, which have the following formulations, were coated in this order on an aluminum cylinder by a dip coating method and dried to prepare a photoreceptor 1 having an undercoat layer of 3.5 μm thick, a CGL of 0.2 μm thick, a CTL of 23 μm thick.

| | |
|---|---|
| Undercoat layer coating liquid | |
| Alkyd resin (BEKKOZOL 1307-60-EL from Dainippon Ink & Chemicals, Inc.) | 6 |
| Melamine resin (SUPER BEKKAMIN G-821-60 from Dainippon Ink & Chemicals, Inc.) | 4 |
| Titanium dioxide powder | 40 |
| Methyl ethyl ketone | 50 |
| CGL coating liquid | |
| Bisazo pigment having the following formula: | 2.5 |

-continued

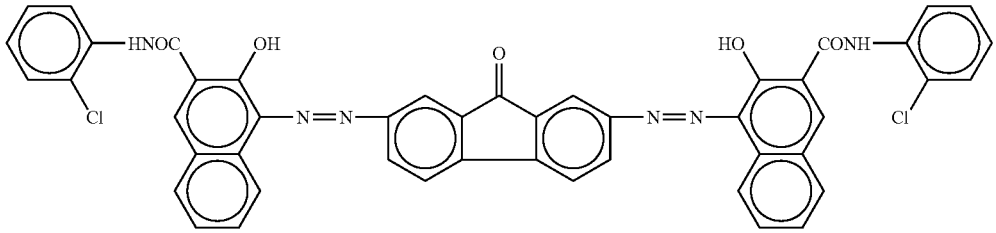

| | |
|---|---|
| Polyvinyl butyral (XYHL from Union Carbide Corp.) | 0.5 |
| Cyclohexanone | 200 |
| Methyl ethyl ketone | 80 |
| CTL coating liquid | |
| Bisphenol Z-type Polycarbonate | 10 |
| Charge transport material having the following formula: | 7 |

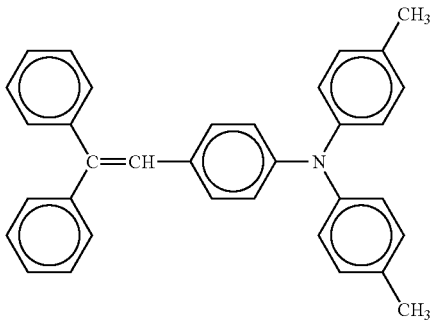

| | |
|---|---|
| Tetrahydrofuran | 100 |
| 1% tetrahydrofuran solution of silicone oil (KF50-100CS from Shin-Etsu Chemical Industry Co., Ltd.) | 1 |
| The CTL was further coated with a crosslinked surface layer coating liquid having the following formulation by a spray coating method. | |
| Crosslinked surface layer coating liquid | |
| Radical polymerizing oligomer having a polyester structure (A) (M-8530 from TOAGOSEI CO., LTD., having a viscosity of from 350 to 650 mPa · s/25° C.) | 47.5 |
| Radical polymerizing compound having three or more functional groups without a charge transporting structure (B) Trimethylolpropanetriacrylate (TMPTA from Tokyo Kasei Kogyo Co., Ltd.) | 47.5 |

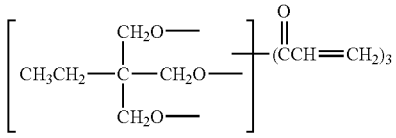

| | |
|---|---|
| Radical polymerizing compound having one functional group with a charge transporting structure (C) (Compound No. 54) | 95 |
| Photo polymerization initiator (1-hydroxy-cyclohexyl-phenyl-ketone IRGACURE 184 from CIBA SPECIALTY CHEMICALS) | 10 |
| Tetrahydrofuran | 1,200 |

The coated layer was irradiated with a metal halide lamp at an irradiation intensity of 500 mW/cm$^2$ for 20 sec, and further dried at 130° C. for 30 min to form a crosslinked surface layer having a thickness of 4.0 μm. Thus, an electrophotographic photoreceptor was prepared.

Example 11

The procedure for preparation of the electrophotographic photoreceptor in Example 10 was repeated to prepare an electrophotographic photoreceptor except for changing the crosslinked surface layer coating liquid to the following one:

| Crosslinked surface layer coating liquid | |
|---|---|
| Radical polymerizing oligomer having a polyester structure (A) | 40 |

-continued

| Crosslinked surface layer coating liquid | |
|---|---|
| (M-8560 from TOAGOSEI CO., LTD., having a viscosity of from 3,000 to 7,000 mPa · s/25° C.) | |
| Radical polymerizing compound having three or more functional groups without a charge transporting structure (B) | 40 |
| Pentaerythritoltetraacrylate (SR-295 from NIPPON KAYAKU CO., LTD.) | |

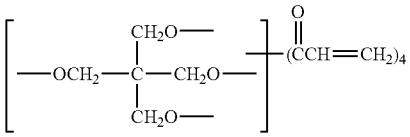

| | |
|---|---|
| Radical polymerizing compound having one functional group with a charge transporting structure (C) (Compound No. 54) | 90 |
| Photo polymerization initiator (1-hydroxy-cyclohexyl-phenyl-ketone IRGACURE 184 from CIBA SPECIALTY CHEMICALS) | 20 |
| Tetrahydrofuran | 90 |

Example 12

The procedure for preparation of the electrophotographic photoreceptor in Example 10 was repeated to prepare an electrophotographic photoreceptor except for changing the crosslinked surface layer coating liquid to the following one:

| Crosslinked surface layer coating liquid | |
|---|---|
| Radical polymerizing oligomer having a polyester structure (A) (M-7100 from TOAGOSEI CO., LTD., having a viscosity of from 6,500 to 12,000 mPa · s/25° C.) | 60 |
| Radical polymerizing compound having three or more functional groups without a charge transporting structure (B) Caprolactone-modified dipentaerythritolhexaacrylate (KAYARAD DPCA-120 from NIPPON KAYAKU CO., LTD.) | 60 |

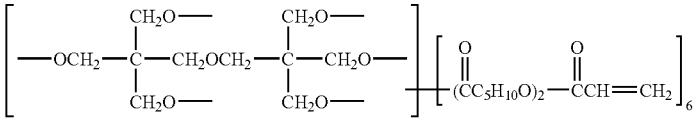

| | |
|---|---|
| Radical polymerizing compound having one functional group with a charge transporting structure (C) (Compound No. 54) | 95 |
| Photo polymerization initiator (1-hydroxy-cyclohexyl-phenyl-ketone IRGACURE 184 from CIBA SPECIALTY CHEMICALS) | 10 |
| Tetrahydrofuran | 1,200 |

Example 13

The procedure for preparation of the electrophotographic photoreceptor in Example 10 was repeated to prepare an electrophotographic photoreceptor except for changing the radical polymerizing compound having a charge transporting structure (C) to the compound No. 16.

Example 14

The procedure for preparation of the electrophotographic photoreceptor in Example 11 was repeated to prepare an electrophotographic photoreceptor except for changing the radical polymerizing compound having a charge transporting structure (C) to the compound No. 24.

Example 15

The procedure for preparation of the electrophotographic photoreceptor in Example 10 was repeated to prepare an electrophotographic photoreceptor except for changing the crosslinked surface layer coating liquid to the following one:

| Crosslinked surface layer coating liquid | |
|---|---|
| Radical polymerizing oligomer having a polyester structure (A) (M-8530 from TOAGOSEI CO., LTD., having a viscosity of from 350 to 650 mPa · s/25° C.) | 45 |
| Radical polymerizing compound having three or more functional groups without a charge transporting structure (B) Trimethylolpropanetriacrylate (TMPTA from Tokyo Kasei Kogyo Co., Ltd.) | 45 |

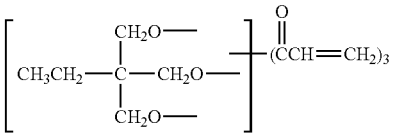

| | |
|---|---|
| Radical polymerizing compound having one functional | 95 |

-continued

| Crosslinked surface layer coating liquid | |
|---|---|
| group with a charge transporting structure (C) (Compound No. 54) | |
| Photo polymerization initiator (1-hydroxy-cyclohexyl-phenyl-ketone IRGACURE 184 from CIBA SPECIALTY CHEMICALS) | 10 |
| Tetrahydrofuran | 1,200 |
| Particulate filler | 20 |

-continued

| Crosslinked surface layer coating liquid |
|---|
| (Alumina filler AA-03 from Sumitomo Chemical Co., Ltd.) |

Comparative Example 9

The procedure for preparation of the electrophotographic photoreceptor in Example 10 was repeated to prepare an electrophotographic photoreceptor except for excluding the radical polymerizing compound having a polyester structure (A).

Comparative Example 10

The procedure for preparation of the electrophotographic photoreceptor in Example 10 was repeated to prepare an electrophotographic photoreceptor except for excluding the radical polymerizing compound having three or more functional groups without a charge transporting structure (B).

Comparative Example 11

The procedure for preparation of the electrophotographic photoreceptor in Example 10 was repeated to prepare an electrophotographic photoreceptor except for changing the radical polymerizing compound having three or more functional groups without a charge transporting structure (B) included in the crosslinked surface layer coating liquid to the following one:

| Radical polymerizing monomer having the following formula without a charge transporting structure | 95 |
|---|---|
| 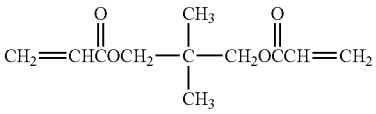 | |
| (Bifunctional acrylate KAYARAD NPGDA from NIPPON KAYAKU CO., LTD., having a molecular weight (Mw) of 212, 2 functional groups (Fg) and a ratio (Mw/Fg) of 106) | |

Comparative Example 12

The procedure for preparation of the electrophotographic photoreceptor in Example 10 was repeated to prepare an electrophotographic photoreceptor except for excluding the radical polymerizing compound having one functional group with a charge transporting structure (C).

Comparative Example 13

The procedure for preparation of the electrophotographic photoreceptor in Example 10 was repeated to prepare an electrophotographic photoreceptor except for changing the radical polymerizing compound having one functional group with a charge transporting structure (C) included in the crosslinked surface layer coating liquid to the following material:

| Radical polymerizing compound with a charge transporting structure, having the following formula | 95 |
|---|---|
| 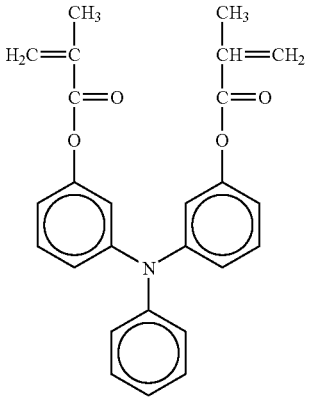 | |

Comparative Example 14

The procedure for preparation of the electrophotographic photoreceptor in Example 10 was repeated to prepare an electrophotographic photoreceptor except for changing the radical polymerizing compound having one functional group with a charge transporting structure (C) included in the crosslinked surface layer coating liquid to the following material:

| Charge transport material having the following formula: | 10 |
|---|---|
| 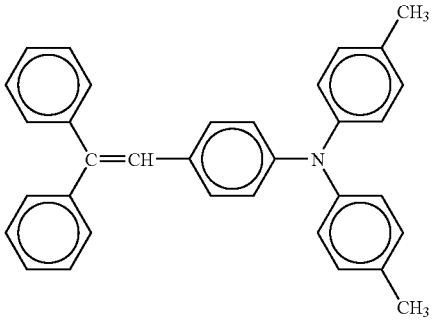 | |

Comparative Example 15

The procedure for preparation of the electrophotographic photoreceptor in Example 10 was repeated to prepare an electrophotographic photoreceptor except for excluding the crosslinked surface layer and forming the CTL having a thickness of 27 μm.

Comparative Example 16

The procedure for preparation of the electrophotographic photoreceptor in Example 10 was repeated to prepare an electrophotographic photoreceptor except for changing the radical polymerizing compound having a polyester structure (A) included in the crosslinked surface layer coating liquid to the following one:

| | |
|---|---|
| Radical polymerizing oligomer having An epoxy group KAYARAD EAM-2160 from NIPPON KAYAKU CO., LTD. | 95 |

Each of the thus prepared electrophotographic photoreceptors was installed in a process cartridge, and the process cartridge was installed in a modified imagio MF2200 using a DC contact charging roller and a LD having a wavelength of 655 nm as a imagewise light source from Ricoh Company, Ltd. After dark space potential thereof was set at 700 (−V), 50,000 images were continuously produced to evaluate an abrasion resistance and a potential of the photoreceptor, and image quality. The evaluation results are shown in Table 6. Further, the surface of each photoreceptor in Examples 10 to 15 and Comparative Examples 11, 13, 14 and 15 was evaluated. The elasticity power and universal harness were measured with H-100 from Fischer Instruments K. K., and ten points average roughness (Rz) was measured by surface roughness measurer SURFCOM 1400D from TOKYO SEIMITSU CO., LTD. The results are shown in Table 7. Further, as for each of Examples 10, 12 and 13, and Comparative Examples 9, 13 and 14, a crack promotion test was performed. A finger grease was adhered to the surface of the photoreceptor, and after left at 50° C. under a normal pressure for 3 days, the surface thereof was observed. The results are shown in Table 8.

TABLE 6

| | Abraded Amount (μm) | Inner Potential Initial Dark | Inner Potential Initial Bright | Inner Potential After 50,000 Dark | Inner Potential After 50,000 Bright | Image evaluation |
|---|---|---|---|---|---|---|
| Example 10 | 1.29 | 700 | 95 | 700 | 95 | Good |
| Example 11 | 1.17 | 695 | 90 | 695 | 95 | Good |
| Example 12 | 0.97 | 700 | 95 | 700 | 95 | Good |
| Example 13 | 1.23 | 700 | 85 | 700 | 90 | Good |
| Example 14 | 1.18 | 700 | 85 | 700 | 85 | Good |
| Example 15 | 0.90 | 700 | 110 | 700 | 125 | Good |
| Comparative Example 9 | 1.30 | 700 | 100 | 700 | 105 | Good |
| Comparative Example 10 | 2.46 | 695 | 105 | 695 | 125 | Image density slightly lowered |
| Comparative Example 11 | 2.50 | 700 | 100 | 690 | 130 | Image density slightly lowered |
| Comparative Example 12 | — | 700 | 350 | Not performed | | |
| Comparative Example 13 | 2.50 | 695 | 110 | 690 | 115 | Image density slightly lowered |
| Comparative Example 14 | 3.11 | 695 | 85 | 685 | 95 | Image density slightly lowered |
| Comparative Example 15 | 6.05 | 700 | 45 | 655 | 50 | Image density slightly lowered |
| Comparative Example 16 | — | 700 | 370 | Not performed | | |

TABLE 7

| | Elastic power (%) | Universal hardness ($N/mm^2$) | Rz (μm) |
|---|---|---|---|
| Example 10 | 45.7 | 205.0 | 0.25 |
| Example 11 | 47.3 | 214.1 | 0.28 |
| Example 12 | 46.1 | 208.9 | 0.26 |
| Example 13 | 46.6 | 207.6 | 0.26 |
| Example 14 | 47.5 | 217.2 | 0.29 |
| Example 15 | 50.1 | 226.1 | 0.35 |
| Comparative Example 11 | 39.4 | 186.2 | 0.33 |
| Comparative Example 13 | 49.5 | 222.4 | 0.51 |
| Comparative Example 14 | 38.8 | 180.5 | 0.48 |
| Comparative Example 15 | 39.1 | 188.3 | 0.23 |

TABLE 8

| | Initial | After 3 days |
|---|---|---|
| Example 10 | Glossy surface | Glossy surface |
| Example 12 | Glossy surface | Glossy surface |
| Example 13 | Glossy surface | Glossy surface |
| Comparative Example 9 | Glossy surface | Cracked |
| Comparative Example 13 | Not glossy | Cracked |
| Comparative Example 14 | Glossy surface | Cracked |

This application claims priority and contains subject matter related to Japanese Patent Applications Nos. 2004-154415 and 2004-223448, filed on May 25, 2004 and Jul. 30, 2004 respectively, the entire contents of each of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An electrophotographic photoreceptor comprising:

an electroconductive substrate; and a photosensitive layer located overlying the electroconductive substrate, wherein an outermost layer of the electrophotographic photoreceptor is a crosslinked layer, comprising:

a urethane oligomer having a radical polymerizing functional group; and a radical polymerizing compound having at least one radical polymerizing functional group and a charge transporting structure, and wherein the outermost layer has an elasticity power not less than 41%.

2. The electrophotographic photoreceptor of claim 1, wherein the crosslinked layer further comprises a radical polymerizing compound having three or more radical polymerizing functional groups, without a charge transport structure.

3. The electrophotographic photoreceptor of claim 2, wherein the radical polymerizing functional group of the urethane oligomer having a radical polymerizing functional group or the radical polymerizing compound having three or more radical polymerizing functional groups, without charge transport structure, is an acryloyloxy group or a methacryloyloxy group.

4. The electrophotographic photoreceptor of claim 1, wherein the crosslinked layer has a universal hardness not less than 200 $N/mm^2$.

5. The electrophotographic photoreceptor of claim 1, wherein the urethane oligomer having a radical polymerizing functional group has a viscosity of 50,000 mPa·s.

6. The electrophotographic photoreceptor of claim 1, wherein the crosslinked layer comprises the urethane oligomer having a radical polymerizing functional group in an amount of 10 to 80% by weight based on total weight of solid contents.

7. The electrophotographic photoreceptor of claim 1, wherein the radical polymerizing functional group of the radical polymerizing compound having at least one radical polymerizing functional group and a charge transporting structure is an acryloyloxy group or a methacryloyloxy group.

8. The electrophotographic photoreceptor of claim 1, wherein the charge transporting structure of the radical polymerizing compound having at least one radical polymerizing functional group is a triarylamine structure.

9. The electrophotographic photoreceptor of claim 1, wherein the radical polymerizing compound having at least one radical polymerizing functional group and a charge transporting structure is at least one compound selected from the group consisting of compounds having the following formulae (1) and (2):

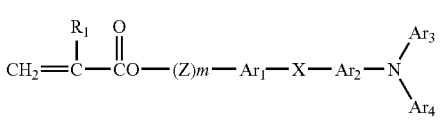

(1)

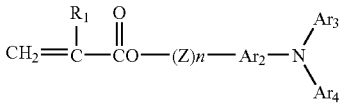

(2)

wherein $R_1$ represents a hydrogen atom; a halogen atom; a substituted or an unsubstituted alkyl group; a substituted or an unsubstituted aralkyl group; a substituted or an unsubstituted aryl group; a cyano group; a nitro group; an alkoxy group; —$COOR_7$ wherein $R_7$ represents a hydrogen atom, a halogen atom, a substituted or an unsubstituted alkyl group, a substituted or an unsubstituted aralkyl group or a substituted or an unsubstituted aryl group; a halogenated carbonyl group; or $CONR_8R_9$ wherein $R_8$ and $R_9$ independently represent a hydrogen atom, a halogen atom, a substituted or an unsubstituted alkyl group, a substituted or an unsubstituted aralkyl group, or a substituted or an unsubstituted aryl group; $Ar_1$ and $Ar_2$ each, independently, represent a substituted or an unsubstituted arylene group; $Ar_3$ and $Ar_4$ each, independently, represent a substituted or an unsubstituted aryl group; X represents a single bond, a substituted or an unsubstituted alkylene group, a substituted or an unsubstituted cycloalkylene group, a substituted or an unsubstituted alkyleneether group, an oxygen atom, a sulfur atom or a vinylene group; Z represents a substituted or an unsubstituted alkylene group, a substituted or an unsubstituted alkyleneether group or an alkyleneoxycarbonyl group; and m and n represent 0 or an integer of from 1 to 3.

10. The electrophotographic photoreceptor of claim 1, wherein the radical polymerizing compound having at least one radical polymerizing functional group and a charge transporting structure is at least one compound having the following formula (3):

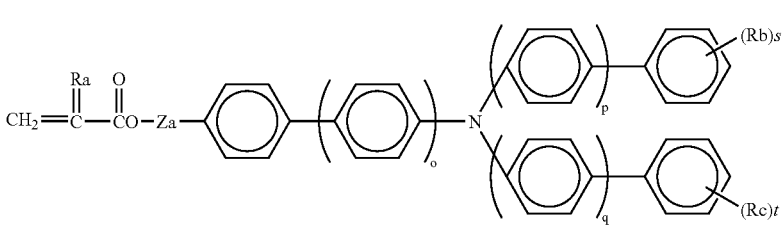

(3)

wherein o, p and q each, independently, represent 0 or 1; Ra represents a hydrogen atom or a methyl group; Rb and Rc each, independently, represents hydrogen, halogen, an alkyl group having 1 to 6 carbon atoms, an alkoxy group having 1 to 6 carbons, an aryl group having 6-14 carbon atoms, an aryloxy group having 6-14 carbon atoms, or can form a benzofused polyaryl group having up to 5 aryl rings, including the phenyl ring to which it is attached, and may be different from each other when having plural carbon atoms; s and t represent 0 or an integer of from 1 to 3; Za represents a single bond, a methylene group, ethylene group,

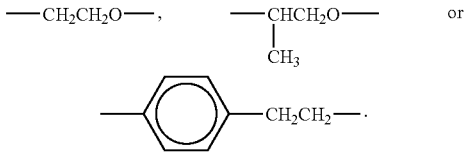

11. The electrophotographic photoreceptor of claim 1, wherein the crosslinked layer is hardened upon application of heat or light.

12. The electrophotographic photoreceptor of claim 1, wherein the photosensitive layer further comprises:

a charge generation layer located overlying the electroconductive substrate; and a charge transport layer located overlying the charge generation layer, comprising the crosslinked layer on a surface thereof.

13. An electrophotographic image forming method comprising:

charging the electrophotographic photoreceptor according to claim 1;

irradiating the electrophotographic photoreceptor with light to form an electrostatic latent image on a surface thereof;

developing the electrostatic latent image with a toner to form a toner image on the electrophotographic photoreceptor; and transferring the toner image onto a receiving material.

14. An electrophotographic image forming apparatus comprising:

the electrophotographic photoreceptor according to claim 1;

a charger configured to charge the electrophotographic photoreceptor;

an irradiator configured to irradiate the electrophotographic photoreceptor with light to form an electrostatic latent image on the photoreceptor;

an image developer configured to develop the electrostatic latent image with a toner to form a toner image on the electrophotographic photoreceptor; and a transferer configured to transfer the toner image onto a receiving material.

15. A process cartridge detachable from an image forming apparatus, comprising:

the electrophotographic photoreceptor according to claim 1; and at least one member selected from the group consisting of a charger, an image developer, a transferer, a cleaner and a discharger.

* * * * *